US006141875A

United States Patent [19]

Andrews

[11] Patent Number: 6,141,875

[45] Date of Patent: Nov. 7, 2000

[54] IN-LINE SHAVING RAZORS WITH TWIN PIVOTING HEADS

[76] Inventor: Edward A. Andrews, 6835 Beach Rd., Troy, Mich. 48098

[21] Appl. No.: 09/429,183

[22] Filed: Oct. 28, 1999

Related U.S. Application Data

[63] Continuation-in-part of application No. 09/326,190, Jun. 6, 1999, which is a continuation-in-part of application No. 09/241,975, Feb. 1, 1999, which is a continuation-in-part of application No. 08/653,515, May 24, 1996, Pat. No. 5,865, 189, which is a division of application No. 08/301,255, Sep. 6, 1994, Pat. No. 5,522,137, which is a continuation-in-part of application No. 08/020,594, Feb. 22, 1993, Pat. No. 5,343,622, and a continuation-in-part of application No. 08/739,990, Oct. 29, 1996, Pat. No. 5,979,056, which is a continuation-in-part of application No. 08/739,364, Oct. 28, 1996, Pat. No. 5,983,499, which is a continuation-in-part of application No. 08/473,473, Jun. 7, 1995, Pat. No. 5,568, 688.

[60] Provisional application No. 60/138,925, Jun. 11, 1999.

[51] Int. Cl.[7] ..... B26B 21/00

[52] U.S. Cl. ..... 30/50; 30/51; 30/53; 30/527; 30/528; 30/529

[58] Field of Search ..... 30/32, 47, 49, 30/50, 51, 53, 527, 528, 529

[56] References Cited

U.S. PATENT DOCUMENTS

| | | | |
|---|---|---|---|
| D. 343,922 | 2/1994 | Ahlgren | D28/46 |
| 839,447 | 12/1906 | Arnold | 30/53 |

(List continued on next page.)

FOREIGN PATENT DOCUMENTS

| | | | |
|---|---|---|---|
| 2632886 | 2/1909 | France | 30/50 |
| 206980 | 2/1909 | Germany | 30/50 |
| 52-15761 | of 0000 | Japan | 30/50 |
| 15761 | 2/1977 | Japan | 30/50 |
| 273152 | 6/1927 | United Kingdom | 30/49 |

*Primary Examiner*—M. Rachuba
*Attorney, Agent, or Firm*—Harness, Dickey & Pierce, PLC

[57] ABSTRACT

In-line razor-blade shaving devices feature two sets of razor blade strips pointing outwardly in opposite directions. The devices are designed for safely and rapidly shaving hair from large body portions such as legs and arms. Each device features an elongated handle arranged in line with an elongated bi-directional razor blade head. Each set of razor blade strips in the head may be provided with one or more straight razor-sharp edges, which point in the same direction, while the blade edges of the two sets point outwardly away from one another, generally in opposite directions. The edges of blade strips of the two sets may be arranged in one common working plane, or each set may be in its own working plane, with the planes at an angle to one another. The working planes are defined by the elongated front and rear guard surfaces of the blade-edge guarding system on the face of the razor head. These guard surfaces contact a user's skin before and after the razor-sharp edges to help ensure safe shaving. The bi-directional head may be constructed in a variety of ways, including in a molded form, in an assembled form, as a replaceable bi-directional cartridge, and as two separate uni-directional razor blade heads arranged in close proximity to one another. These in-line bi-directional razor blade shaving devices represent a new family of wet shaving razor devices. They each can be used with a minimum of effort by sliding the razor blade head back and forth along the skin to be shaved, with shaving occurring in both directions. Some embodiments have two distinct working planes on the head of the shaving device. To use them, the user's wrist rotates at the end of each stroke (or at the beginning of the next stroke), to bring the other working plane, not currently on the skin, into engagement with the skin for the next stroke in the opposite direction.

51 Claims, 15 Drawing Sheets

U.S. PATENT DOCUMENTS

| | | | |
|---|---|---|---|
| 1,044,906 | 11/1912 | Ohlsson . | |
| 1,217,288 | 2/1917 | Donnelly | 30/53 |
| 1,229,824 | 6/1917 | Tewelow . | |
| 1,835,655 | 12/1931 | Lehmann . | |
| 1,976,290 | 10/1934 | Motley | 30/50 |
| 2,547,376 | 4/1951 | Crawford . | |
| 2,794,246 | 6/1957 | Marsh et al. | 30/51 |
| 2,952,910 | 9/1960 | Meohas . | |
| 3,109,237 | 11/1963 | Girouard . | |
| 3,488,764 | 1/1970 | Welsh . | |
| 3,571,927 | 3/1971 | Stone | 30/51 |
| 3,777,396 | 12/1973 | Simonetti | 30/32 |
| 4,213,240 | 7/1980 | Ferraro et al. | 30/47 |
| 4,285,125 | 8/1981 | Chen et al. | 30/53 |
| 4,378,635 | 4/1983 | Burch | 30/58 |
| 4,501,066 | 2/1985 | Sceberras | 30/50 |
| 4,603,477 | 8/1986 | Francis | 30/50 |
| 4,622,742 | 11/1986 | Lee | 30/55 |
| 4,791,724 | 12/1988 | Dumas | 30/48 |
| 4,831,731 | 5/1989 | Eltis | 30/50 |
| 4,976,030 | 12/1990 | Boyd | 30/49 |
| 5,084,968 | 2/1992 | Trotta | 30/50 |
| 5,133,131 | 7/1992 | Hoffman | 30/50 |
| 5,287,624 | 2/1994 | Mondo et al. | 30/50 |
| 5,343,622 | 9/1994 | Andrews | 30/50 |
| 5,426,853 | 6/1995 | McNinch | 30/48 |
| 5,579,580 | 12/1996 | Althaus et al. | 30/50 |
| 5,865,189 | 2/1999 | Andrews | 132/260 |

240
242
243
247
248
250
251
252
253
254
255
256
258
259
262
264
266
268
269
265
15
14
164
257
260
261
263
270
277
278

447
446

400

410
400
26
30
31
31
30
420
426
432
26

446
447
29
29

410
400
430
420
434
434

FIG-37
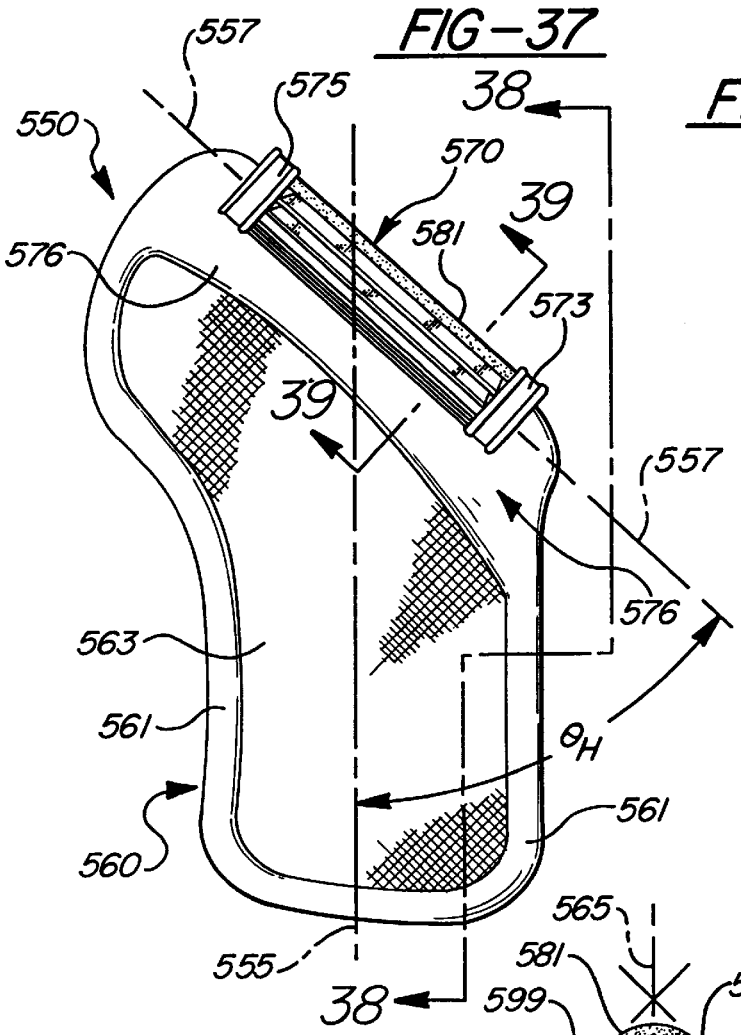
FIG-38
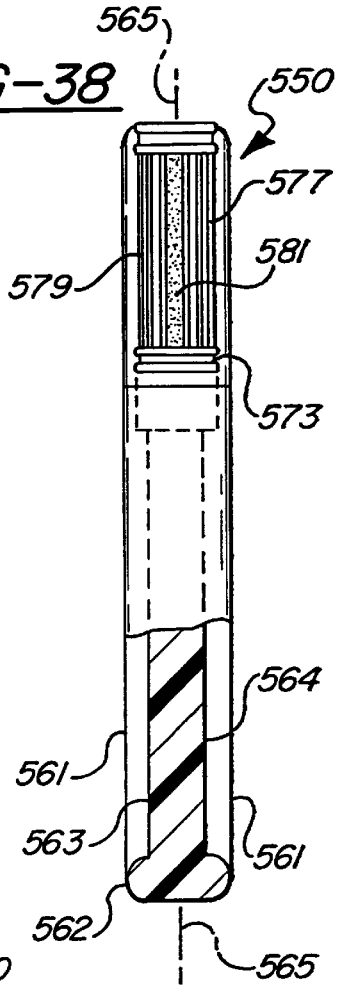
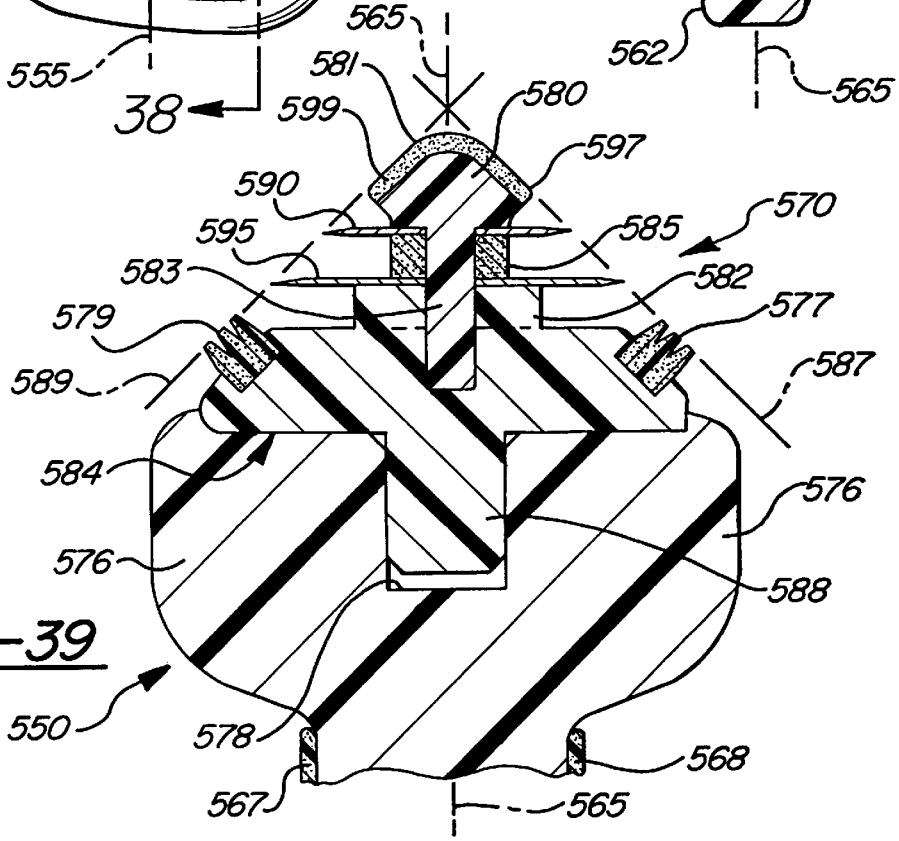
FIG-39

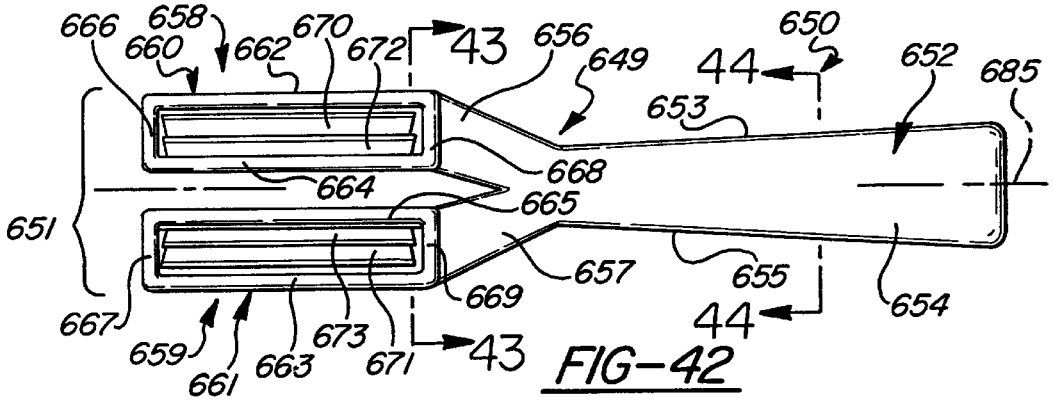
FIG-42
FIG-43
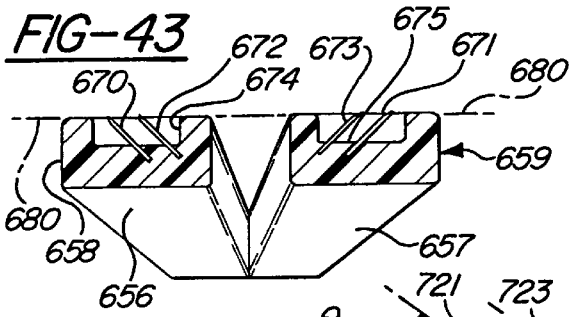
FIG-44
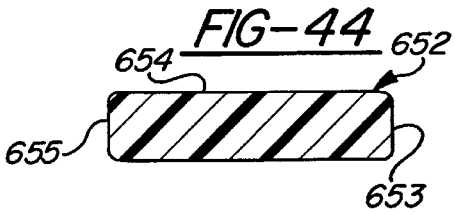
FIG-46
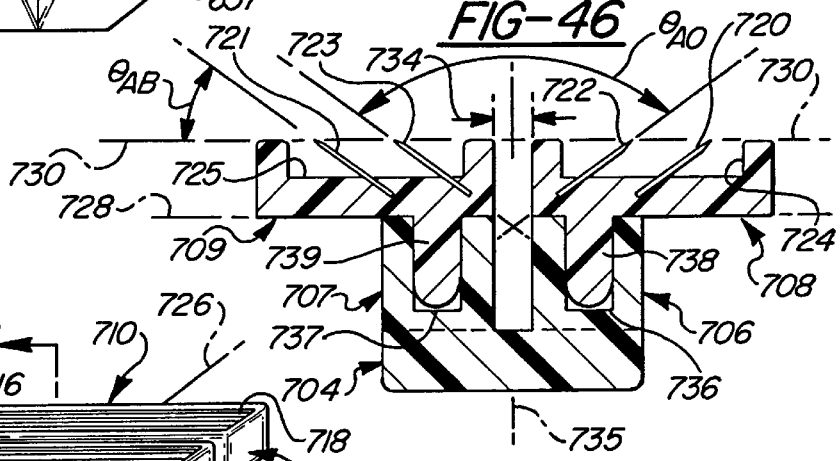
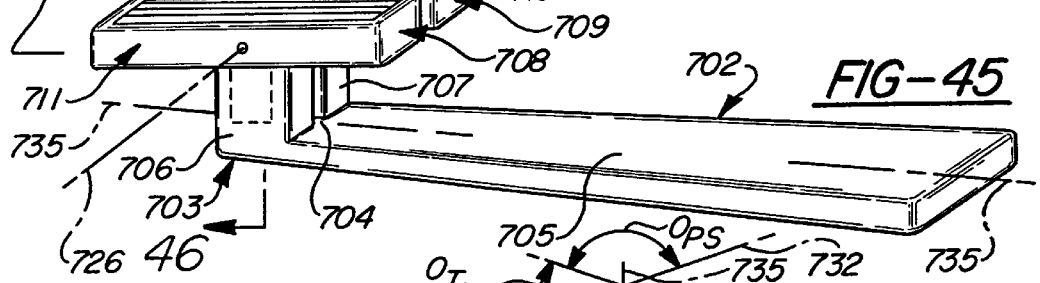
FIG-45
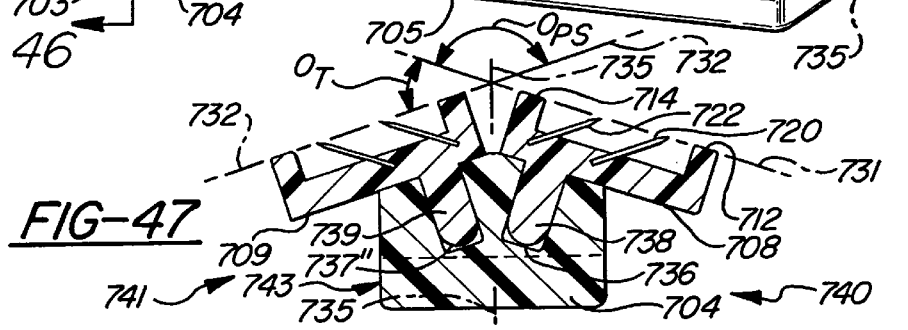
FIG-47

773
772
771
776
750
777
752
768
755
753
751
756
776
754
788
769
757
775
758
789
767F
759

771
752
773
769
796
754
51
757
775
776
774
795
766F
766R
797
767R
780
51
767F
786

788
786
758
753
777
785
762
756
754
768
755
757
785
763
759
786
784
776
772
773

IN-LINE SHAVING RAZORS WITH TWIN PIVOTING HEADS

CROSS-REFERENCE TO RELATED APPLICATIONS

This application claims the benefit of copending provisional application Ser. No. 60/138,925 filed Jun. 11, 1999 and is a continuation-in-part of copending application Ser. No. 09/326,190 filed Jun. 6, 1999, which is a continuation-in-part of copending application Ser. No. 09/241,975 filed Feb. 1, 1999, which is a continuation-in-part of application Ser. No. 08/653,515 filed May 24, 1996, now U.S. Pat. No. 5,865,189 issued Feb. 2, 1999, which is a division of application Ser. No. 08/301,255 filed Sep. 6, 1994, now U.S. Pat. No. 5,522,137 issued Jun. 4, 1996, which is a continuation-in-part of application Ser. No. 08/020,594 filed Feb. 22, 1993, now Pat. No. 5,343,622. This application is also a continuation-in-part of application Ser. No. 08/739,990 filed Oct. 29, 1996 now U.S. Pat. No. 5,979,056, which is a continuation-in-part of application Ser. No. 08/739,364 filed Oct. 28, 1996 now U.S. Pat. No. 5,983,499 which is a continuation-in-part of application Ser. No. 08/473,473 filed Jun. 7, 1995, now Pat. No. 5,568,688. The entire disclosures of all of these prior applications are hereby incorporated by reference herein.

FIELD OF THE INVENTION

The present invention relates in general to manual shaving devices employing at least one elongated straight razor blade arranged in-line with an elongated handle, and in particular to bi-directional manual shaving devices employing an elongated razor blade head, with two sets of outwardly-pointing straight-edge razor blade strips shielded by a blade-edge guarding system, mounted on an in-line handle for safely and rapidly shaving large areas of skin in two opposite directions that are generally perpendicular to the main axes of the in-line handle and razor head.

BACKGROUND OF THE INVENTION

Uni-directional razor blade shaving devices have long been known, starting with the old straight-edge razor with an in-line handle used by barbers more than a century ago. In more recent times, most personal shaving has been done by individuals rather than barbers. Further, the predominant manual wet-shaving devices over at least the last five decades have been based upon the classic T-bar razor, with its elongated razor head and a handle which extends perpendicularly from the bottom of the razor's blade head.

In more recent decades, the quality of the T-bar razor blade head has improved, while its cost has been lowered and user safety increased. The modern wet-shaving razor typically features an angled T-bar handle and an elongated razor head having a blade-edge guarding system located about the razor-sharp edges to minimize the possibility of nicks and cuts, which were more of a problem with older T-bar razor designs, especially for an inexperienced user. Modern safety razor blade heads now feature front and rear elongated guards which establish a common working plane in which the razor-sharp edges of twin parallel razor blade strips are disposed. In this manner, the sharpened blade edges are only exposed by a few thousandths of an inch above the working plane, which helps minimize nicks and cuts. The angled neck on the T-bar handle also made it easier for the user to grip the handle comfortably while holding the razor head at an angle so that the working plane or face of the razor will lay flat against the skin to be shaved.

To further minimize nicks and to more readily allow the razor-sharp blade edges to follow the curving contour of a user's skin, some of the more advanced uni-directional razor blade heads now pivot or swivel while pressed lightly against the user's skin. Also, they often have spring-loaded razor blade strips that move with the undulations in the skin. Examples of such movable razor blade heads in commercial use, which are available in a replaceable cartridge style, include the wet-shaving manual shaving razors distributed by the Gillette Company of Boston, Mass., U.S.A. under the Sensor®, the Sensor Excel®, the Sensor for Women™, and the Mach3™ brand names. Also, a number of uni-directional razor blade head designs that are flexible have been made. Examples in commercial use, that are available in a replaceable cartridge-style, include the wet shaving razors distributed by the Warner-Lambert Company of Morris Plains, N.J., U.S.A. under the Schick Tracer® and Lady Schick® brand names.

In an effort to advance the safety and efficacy of the wet-shaving art, I developed single-head bi-directional wet-shaving devices which are disclosed in my first three earlier patents cited in the first paragraph of this specification. In spite of all of this development, there is still a real need for easy-to-use bi-directional shaving devices specifically designed to rapidly shave large body areas, including the arms and legs. This is an important task which is undertaken periodically by millions of women who shave their legs. It is also performed regularly by those in the medical community who shave patients for surgery or other treatments, by those in the athletic community (e.g., swimmers, wrestlers, body builders, etc.), and by caretakers who shave those who cannot shave themselves. There is a continuing need for improved manual shaving devices to perform these large-body shaving tasks.

Objects.

In light of the foregoing needs, it is desirable to provide still further improvements in bi-directional razor blade systems, structures and cartridges to allow a user to shave large areas of skin on the body, such as the legs and arms, rapidly and safely. With this in mind, I have created a new family of bi-directional razor blade shaving devices, called in-line bi-directional shaving devices, which can be separated into several classes. Each of these in-line shaving devices achieves one and usually several of the following objectives of the present invention.

A first major object of this invention is to provide several different in-line single-head razor devices, each with an elongated head and handle, which can each be used for rapidly and safely shaving large body areas in two opposite directions generally perpendicular to the major axes of the head and handle. A related object is to arrange the handle and head relative to one another so that this task of shaving large body areas bi-directionally can be accomplished in an entirely natural, completely comfortable, and easy-to-use way.

A second major object is to provide compact in-line bi-directional razor blade devices, with the elongated head and handle arranged generally in-line, which are easier to use than present-day uni-directional T-bar razor devices to rapidly shave the legs and arms or other large body areas.

A third object is to provide for several different constructions of a bi-directional straight razor blade cartridge for an in-line razor shaving device, which cartridges can be manually removed from the in-line razor handle and replaced with a fresh cartridge whenever the blades become dull or the user wishes to do so.

A fourth object is to provide an improved method of manual shaving large area body surfaces, namely bi-directional shaving using an in-line razor shaving device having an elongated handle for supporting a single bi-directional razor head generally in-line with the principal axis of the handle, where the user's handgrip on the razor's handle need not be changed as the bi-directional razor head is moved back and forth in opposite directions to shave an area of skin. A related object is to provide a method of shaving using in-line bi-directional razor devices which does not require any significant lifting, tilting or repositioning of the bi-directional razor head relative to the skin, and which substantially reduces the time and effort spent shaving.

A fifth object of the present invention is to provide an in-line wet shaving razor device that will more readily deliver a closer shave than conventional uni-directional dual-blade wet razor systems, by virtue of facilitating shaving the same area of skin from two opposite directions. A related object is to help prepare and condition the skin to be shaved by scraping it with one or two razor blade edges moving in a non-cutting direction, and/or by stretching it out by using front and rear guards which grip and/or smooth the skin from two directions.

A sixth object is to provide an in-line wet shaving razor device that stays sharper longer than a conventional uni-directional razor blade system by virtue of having twice as many shaving edges, and by having flow-through debris passages which allow a user to easily rinse away shaving debris that might otherwise remain on and eventually dull the blade strip edges.

A seventh object is to provide several different constructions of in-line bi-directional razor shaving devices which are particularly economical to manufacture at a cost essentially equal to or slightly more than conventional uni-directional razors.

An eighth object is to provide several different constructions of in-line bi-directional razor shaving devices which are economical to manufacture using a combined handle and razor made from a single elongated piece of molded plastic.

A ninth object is to provide single-head in-line bi-directional razor blade shaving devices wherein two sets of opposed blade strips both make effective use of a single rear guard/lubricant strip centrally located between them.

A tenth object of the present invention is to provide a first class of in-line bi-directional razor shaving devices which have all of the razor-sharp edges of the blade strips arranged in substantially the same working plane in a single head, and which need not be lifted, tilted or turned while speed-shaving in two opposite directions.

An eleventh object is to provide a second class of in-line bi-directional razor blade shaving devices, each having a single head with two sets of razor blade strips, with each set being located in its own working plane that faces away from and intersects the other pair's working plane at an angle in the range of about 5° up to about 15° or so, so that the in-line shaving devices need not be lifted or deliberately tilted or turned while speed-shaving in two opposite directions.

A twelfth object is to provide a third class of in-line bi-directional razor blade shaving devices, each having a single head with two sets of razor blade strips, with each set being located in its own working plane facing away from the other working plane, with the two working planes intersecting one another at an angle of about 20° or more, so that the in-line devices must be deliberately tilted and turned at the end of each stroke (or at the beginning of the next stroke) to engage the other working plane for the next stroke in the opposite direction.

A thirteenth object is to provide a fourth class of in-line bi-directional razor devices which employ uni-directional razor cartridges with straight razor blade strips within a single head to form a single bi-directional razor blade head. A related object is to provide in-line bi-directional shaving devices by using a pair of conventional uni-directional razor cartridges to implement an in-line shaving device having a single bi-directional razor blade shaving head.

A fourteenth object is to provide a fifth class of in-line bi-directional razor blade shaving devices having an effective single bi-directional head formed of two identical uni-directional head portions connected to a single handle through a common neck, a bifurcated neck, or a yoke, with the two uni-directional heads being arranged generally parallel to and in close proximity to one another.

A fifteenth object of the present invention is to provide in-line bi-directional razor blade shaving devices having a bi-directional razor blade head and/or uni-directional half-heads provided with either a pivot mechanism or a shell-bearing mechanism to facilitate minor on-the-fly changes in the orientation of the full head or half-head portions relative to the user's skin which undulates or has gentle contours, without the need for the user to significantly lift, tilt or twist the handle of the razor as the shaving head is moved back and forth in opposite directions.

A sixteenth object is to provide in-line bi-directional razor blade shaving devices with two conventional uni-directional razor blade heads that can move independently in response to skin forces substantially perpendicular to the direction in which the razor head is being moved along the skin, so as to permit the individual heads to have their blade strips bear substantially continuously against a user's skin during back-and-forth shaving, even as the contour of the skin changes.

Still other objects and advantages of the present invention will become apparent from the Summary and the Detailed Description of the Preferred Embodiments of the present invention which follow.

SUMMARY OF THE INVENTION

In response to the above-referenced needs, I envisioned the above-stated objects. I also recognized that it would be desirable if these needs could be met with devices that could be manufactured using conventional elongated razor blade strips with straight razor-sharp edges packaged into a new kind of manual shaving device. I also recognized that it would be advantageous if my earlier bi-directional razor blade structures disclosed in my first three patents cited above as being used with a T-bar handle, could somehow be adapted to the task of rapidly shaving large body areas.

The foregoing needs are met, and the foregoing objects are achieved, by the various embodiments of the in-line bi-directional shaving devices of my present invention. Most embodiments achieve several of the objects stated above. In accordance with a first aspect of my invention, there is disclosed herein an in-line bi-directional shaving device that has a single-head structure with outwardly-pointing razor-sharp blade edges. By "in-line" I mean a head structure that is connected to and supported by a handle structure, where the two structures have their respective principal axes generally arranged in a common plane. This arrangement for an in-line razor blade shaving device that features a bi-directional razor blade head allows a user to speed-shave large skin areas of the body, such as the legs and arms. The bi-directional head is preferably equipped with a blade-edge guarding system, for each set of sharpened razor blade edges, that establishes one or two working planes in which the razor-sharp edges are disposed.

This bi-directional razor blade device is preferably comprised of an elongated bi-directional razor head structure connected to and supported by an elongated in-line handle structure. The head and handle each have a principal axis, and each axis is located in a common central plane, which I sometimes call a plane of symmetry, since the head and handle are both preferably symmetrically arranged about this plane. The device also includes at least first and second elongated razor blade strips supported by the head, each strip having a sharpened blade edge portion extending outwardly generally away from the sharpened edge portion of the other strip. The bi-directional razor head structure also has a blade-edge guarding system preferably provided with: (a) first and second front guard portions spaced from one to another and respectively including first and second longitudinal edges, preferably parallel to one another, which define a common reference plane; and (b) first and second end portions extending generally transversely to the central longitudinal axis of the razor head. The razor head has a face and a central longitudinal axis located between the longitudinal edges. This elongated razor head is preferably symmetrically arranged about the central plane, which preferably is perpendicular to the common reference plane.

The elongated in-line handle structure has a handgrip portion that is connected to the razor head. The handle structure generally extends outwardly away from the razor head in a direction that maintains the principal axis of the handle structure generally within the plane of symmetry. The handle and head are arranged so that the head is supported for manual movement by the user in two opposite directions generally perpendicular to the axis of the handle.

The sharpened blade edge portions of the first and second elongated razor blade strips each preferably extend outwardly at an acute angle relative to the face of the razor head structure so that they each project generally toward their respective longitudinal edges closest to them and away from the central longitudinal axis of the razor head. The blade edge portions each preferably include a straight elongated razor-sharp edge. The razor-sharp edge of the first blade strip is generally positioned in a first working plane defined in part by the first front guard portion. The razor-sharp edge of the second blade strip is generally positioned in a second working plane defined in part by the second front guard portion, which may be coextensive with the first working plane or may be a separate working plane distinct from and at angle to the first working plane, in those embodiments having two distinct working planes.

The handgrip portion of the razor handle structure is arranged and adapted for manually grasping and for moving the handle structure back and forth in first and second directions opposite from one another that are generally perpendicular to the principal axis of the handle. In this manner, hair extending from the skin is shaved in both directions for a closer shave than shaving in one direction alone normally produces. As the razor head is moved in the first direction along a user's skin, the first working plane of the razor head, formed or defined in part by at least the first front guard portion thereof and a rear guard portion, is normally in tangential contact with the skin, thus helping ensure the sharpened edge of the first razor blade strip is at an optimum acute angle for shaving as it traverses across the skin. Upon a reversal of the direction of movement of the handle structure, the razor head moves in the second direction along a user's skin that is opposite the first direction. As the razor moves in this second direction, the second working plane of the razor head, in which the razor-sharp edge of the second razor blade strip is disposed, which is formed or defined in part by at least the second front guard portion and a rear guard portion, is in tangential contact with the skin, once again helping to ensure an optimum angle for shaving. In the single-plane embodiments of the in-line shaving devices of the present invention (i.e., where the first and second working planes are the same), each front guard may serve if desired as a rear guard for the other front guard. The blade-edge guarding system also includes an elongated rear guard for each active razor blade set.

When using an in-line bi-directional shaving device of the type described above, it is not necessary for the user to lift the elongated razor head from the skin during movements in the opposite directions, although this can be done if desired. Instead, a user of my in-line razor blade device may rapidly slide the bi-directional razor head back and forth along the skin to be shaved, while maintaining at least one of the working planes of razor head generally in continuous contact with the skin during movement in the first or second directions. All of the razor blade shaving devices of the present invention can be so utilized, including reversing them and stroking them back and forth in opposite directions, without paying much attention to lifting or repositioning the razor head relative to the user's skin.

The first and second guards form part of the blade-edge guarding system for the in-line bi-directional razor head. This is made possible by the blade-edge guarding system that provides front and rear elongated guards for each set of razor blades. The blade-edge guarding system has surfaces which are present on the face of the razor head. Since the razor blade strips are pointed in opposite directions, only one half of the razor head may be active, that is cutting hair, at a time. The guards are preferably spaced from each razor-sharp edge of the razor blade strip or strips which they are guarding. In a razor head having a single working plane, the front guard of one active blade set may constitute the rear guard of the other blade set. Alternatively, an elongated central rear guard member may be provided that is common to both razor blade sets. Having a front and rear guard for each active blade set renders it very easy to position the proper working plane and associated active half of the face of the razor blade head against the skin without the need to carefully watch or feel the razor blade head in the process.

According to a second aspect of the present invention, there is provided, as shown in some embodiments of the present invention, a bi-directional razor head that includes two working planes at a distinct angle relative to, and facing away from, one another. In those embodiments, only one working plane at a time can be in contact with the skin, if that distinct angle is larger than about 5° or 10° or so. Accordingly, at the end of each stroke with these in-line devices having two distinct working planes at a substantial angle to one another, a modest twist of the wrist may need to be made to position the other working plane in contact with the skin, just before or as the motion in the opposite direction is started. As further explained below, this form of user control will no doubt be preferred by some shavers.

Among the seven different embodiments of the in-line bi-directional razor shaving devices of the present invention that are disclosed below, a number have only a single compact elongated razor head structure that can be characterized as follows. The single bi-directional head razor has at least two razor blade strips. The head supports these first and second razor blade strips with their respective sharpened edge portions extending, that is pointing, in generally opposite directions. The elongated razor head preferably has first and second longitudinal edges, and a longitudinal axis centrally located between the longitudinal edges. In those single-head embodiments with only one working plane, the face is generally flat, and is located between the two longitudinal edges. In those single-head embodiments with two distinct working planes, the face is slanted or curved in the center in the vicinity of a centrally-located elongated rear guard which may be provided with a lubricant strip. Thus, these two working plane embodiments each have two distinct half-faces, angled with respect to one another, between the two longitudinal edges. The sharpened blade edge portion of the first razor blade strip extends outwardly at an acute angle relative to the face of the razor head. It projects generally toward the first longitudinal edge of the head and away from the longitudinal axis of the head. Similarly, the second razor blade strip has its sharpened blade edge portion extending outwardly at an acute angle relative to the face. It projects generally toward the second longitudinal edge of the razor head and away from the longitudinal axis. Thus, the sharpened edges of the first and second blades point generally away from one another.

In preferred embodiments of the single-head bi-directional razor of the present invention, two sets of razor blade strips are provided, and all strips are preferably of the same length. While three razor blade strips may be provided in each set, two are believed sufficient, and even one will work. Consider an embodiment with two pairs of razor blade strips. The first and second strips are arranged as described in the preceding paragraph. A third razor blade strip is supported by the head and has a sharpened edge portion that is arranged closely adjacent to and spaced a short distance from the sharpened edge portion of the first blade strip. In this manner, the first and third blade strips form a first pair of razor blade strips that cut hair substantially simultaneously as the razor is moved in a first direction along the user's skin. Similarly, a fourth razor blade strip is arranged closely adjacent to and spaced a short distance from the second blade strip to form a second pair of razor blade strips. The sharpened blade edge portions of this second pair of blade strips cut hair substantially simultaneously as the razor is moved in a second direction opposite from the first direction along the user's skin.

Several distinctly different embodiments of my in-line single-head bi-directional razor with two sets of razor blade strips as generally described above are disclosed. The razor blade strips may be molded into the razor head, or may be part of an assembled head structure that is designed for holding the blade strips fixedly in place or movably in place. Examples of the molded style of construction and of the assembled style of construction are provided in different embodiments presented herein.

As is well known, modern conventional uni-directional safety razors often have a pair of adjacent razor blade strips mounted parallel to one another between a forward guard bar, a rear glide strip or surface, and blade-end caps or shields. This style of safety razor construction reduces the chance that the razor blade edges will accidentally nick or cut the skin during shaving. As is well known, the two parallel blade strips have their edges projecting into a working plane of the razor that is also in part defined by the surfaces of the guard bar, glide strip or surface and end caps which contact the user's skin. These non-cutting surfaces of the safety razor, which are in or very near to the working plane of the razor, help ensure that the blade edges are presented to and engage the skin of the user to be shaved at a proper angle so as to minimize the chance of nicks or cuts to the skin.

The in-line bi-directional razors of the present invention are preferably constructed in a manner which incorporates those same advantages found in the modern uni-directional safety razors of the T-bar type. However, the in-line bi-directional razor devices of the present invention need to utilize two front guard bars, one for each of two opposite directions of transverse movement of the razor head across the skin, and preferably include at least one glide strip or sliding surface centrally located between the two sets of blades. These front guards may be pliable, if desired, by using a plurality (such as four or five) of soft parallel micro-fins for each front guard, as is found of the Gillette Sensor Excel and Gillette Mach3 uni-directional razor blade cartridges, or they may be deformable elongated soft foam blocks. The blade-end shields, which may take the form of a pair of end caps or raised end portions on the razor head, are configured to shield the end corners of both sets of blade strips from exposure to the user's skin. Further, the in-line bi-directional razor heads of the present invention are preferably constructed to have a face that is symmetrical about a central longitudinal axis and about a central transverse axis.

According to a third aspect of the present invention, the in-line bi-directional razor heads of the present invention may be constructed as disposable cartridges designed to be used with reusable handles. In one embodiment according to this aspect of the invention, the bi-directional cartridge may be formed of molded plastic material. It is preferably constructed as an elongated, narrow member which is configured to be installed upon an in-line razor handle that may include a head support frame mounted on one end of the handle. The cartridge can thus be removed and replaced with a new cartridge when desired. Pairs of parallel, closely spaced, single edge, strip-type razor blades may be embedded in plastic material, with the plastic molded directly around the lower portion of the blade strips, thus anchoring the blade strips in place.

In yet other embodiments, the cartridge may be provided with a main razor blade support structure that is preferably made of any suitable material, including one or more pre-molded plastic parts. This support structure can be of a rigid design or a flexible design, and preferably includes at least a platform structure a little longer than the length of the razor blade strips. These cartridge structures may also include a cap member. The cartridge normally is assembled, with the blade strips being retained in place therein using any conventional means, such as retaining pins, end caps, or blade-retaining bands. These pins, caps and bands are preferably attached to the support structure or base of the head. In the rigid designs, the blade strips may be rigidly fixed in position, or they may be individually spring-loaded. The spring-loaded blades may be confined to move only up and down generally perpendicularly to the working plane, or they can be confined, so as to be to move back and forth in a direction generally parallel to the working plane. In the flexible designs, the blade strips are allowed to move with head in a direction that is substantially perpendicular to the direction of head travel during use and to the longitudinal axis of the cartridge.

In some embodiments of my bi-directional cartridges, the razor head of the cartridge is rigidly fixed relative to the handle. If desired, embodiments can be provided where the cartridge head pivots or swivels relative to the handle, typically on pivot pins or shell bearings mounted to the bottom side of the razor handle, or a neck or yoke extending from one end of a handle. In such alternative embodiments, the entire bi-directional cartridge may pivot relative to the handle, with a conventional return spring being used to bias it back to a nominal centered position in the absence of external forces.

Still other constructions are possible. For example, other embodiments can be provided where individual uni-directional cartridges which make up one-half of the bi-directional head, and arranged to individually pivot, and/or may be individually equipped with a return-to-center spring, such as the type found in conventional pivoting uni-directional cartridges used on commercially available T-bar wet razors.

In all styles of construction of my in-line bi-directional razors, I prefer to have both sets of sharpened blade edges arranged parallel to the central longitudinal axis of an elongated head, with the first and second set of blade edges pointing in opposite directions. The sharpened edges of the blade strips may point in opposite directions at an obtuse angle relative to each other, while being disposed at an acute angle relative to their own respective working plane within the razor head.

The razor head may be constructed as a disposable cartridge or as a permanent extension of the handle, and it can be made in many different sizes and shapes, as illustrated by the various embodiments. In still other embodiments I have contemplated the razor heads are preferably made to be of a relatively conventional size and shape, and need not differ much in size from common commercially available uni-directional T-bar razor heads. Further, these heads can be used with handles whose handgrip portion looks very much like conventional commercially available handles used on T-bar razors. If desired, the razor blade strips can be made longer than the usual 35 mm to 38 mm length (1.38" to 1.5"), and can be about 50 mm to 52 mm (about 2") or more long.

Although most of the razor heads of my invention are shown with and contemplate the use of a double pair of razor blade strips, the bi-directional razors of the present invention need not be so complicated. Two single blades that extend in opposite directions, rather than twin-blade pairs, can be used. This style of construction provides a thinner width or profile for the bi-directional razor blade head, so that it could be easily used in the tightest of places to be shaved. A single-blade design having only two opposed razor-sharp edges is simpler still, and may also be used. This double-edged single razor blade approach may be used and extended to most of the other embodiments, by simply removing the third and fourth razor blade strips and eliminating if desired the corresponding portion of the support structure associated with the removed blade strips. In virtually every instance, this could be used to reduce the width of the razor head, if desired.

The in-line bi-directional razor shaving devices of the present invention disclosed herein can be categorized into six general classes, which, in my opinion, will meet the needs and shaving preferences of the many different potential users of my in-line bi-directional razor shaving devices. In a first class of the bi-directional razors, which is exemplified by the first and fourth embodiments and the individual heads of the sixth and seventh embodiments herein, the sharpened edge portions of the first and second sets of blade strips (which point to generally opposite directions) are all arranged in a single common working plane. While these embodiments all have four blade strips, each could be implemented with only two opposed blade strips, if desired, with the sharpened blade edges pointing away from one another and yet being arranged in a common plane.

In a second class of in-line bi-directional razor blade devices according to the present invention, each set of blade edges are in their own separate working plane. This class of in-line bi-directional razor is exemplified by the second and fifth embodiments shown in the Figures. They each have two working planes that intersect one another at an angle of only several degrees, such as from about 5° or 10° to less than about 20°, and preferably in the range of about 8° to about 15°. Since the skin on most large body areas is generally somewhat compliant, this slight difference in angle between the first and second working planes of the razor blade still enables the in-line bi-directional razor to be used in those compliant areas without lifting or noticeably turning or tilting the handle of the razor while moving back and forth in opposite directions. In other words, the bi-directional shaving head normally need not be lifted or deliberately tilted or turned while shaving in two opposite directions. To the extent that any tilting or turning is required, it happens virtually automatically, due to the natural biomechanical motions of a user dragging exposed cutting razor blade strips across the skin to be shaved. In other words, the user's hand and/or wrist will automatically turn or give a little without the user really consciously having to turn either the hand or wrist in order to fully engage the other working plane for the stroke in the opposite direction.

In a third class of in-line single-head bi-directional razor blade shaving devices of the present invention, there are two sets of blade strips, each in their own working plane, with the two working planes being angled considerably more than 15° from one another, such as about 20° apart, up to about 120° or so apart, with the working planes being arranged to face away from one another. Preferably the angle between the two planes is in the range of about 30° to about 100°, with a narrower range of about 35° to about 90° being presently preferred. This class of in-line bi-directional razors is exemplified by the second, third fourth and fifth embodiments of the present invention. Since the working planes for the two sets of blades are angled so far apart, it is normally not possible for both set of blade edges to cut hair, each in its own direction, while the head and handle both remain in the same relative position to the skin being shaved, since most skin is not that soft or yielding. Accordingly, the user of this class of in-line bi-directional shaving devices must deliberately tilt or turn the handle and thus razor head itself to place the in-line razor head into the two different cutting positions or inclinations. Note that for this (and all other classes of my in-line shaving devices) the handgrip of the user on the handle of the in-line razor shaving device may and preferably does remain the same, as the shaving head is moved back and forth by the user; only the user's wrist need turn.

This third class of my in-line bi-directional razors thus enables the two sets of blade edges, each in its own distinct working plane angled distinctly apart from the other working plane, to be successively presented, from opposite directions, to a smooth stretch of skin to be shaved. In other words, each working plane, in a successive fashion, each at a different time and stroke, engages the skin, with the user changing the direction and the inclination of the razor head at or near the end (or the beginning) of each stroke in what normally is (or should be) a rather fluid and seemingly continuous motion. The in-line construction of the elongated razor head and handle of the shaving devices of the present invention in this third class encourage a user to quite naturally and quickly change the direction and orientation of the razor head to present the other working plane to the skin by simply turning the wrist, thus allowing the user to rapidly shave back and forth. With this (and all other classes of my in-line devices), only one set of razor sharp edges of the blade strips are active, that is in shaving contact with the skin, at any one time. With this third class of in-line shaving devices, the angle of inclination between the working plane is sufficiently great so that even an inexperienced user will understand that the non-cutting blade edges are not in contact with the skin.

Accordingly, this third class of in-line bi-directional shaving devices has benefits over those of the first class. An inexperienced user of an in-line razor shaving device may feel as though the razor-sharp edges pointing in two opposed directions represent a complicated stroking/shaving routine, even though this is not the case. Or such a user may be uncomfortable with the notion of placing two sets of opposed sharpened razor blade edges upon the skin at once. This third class of devices will give that user a feeling of greater control or safety since the non-cutting working plane is clearly off of the skin, which the user may prefer. This in turn may encourage those who might otherwise be timid about shaving with manual razors to begin with to have the confidence to try the in-line bi-directional shaving devices of the present invention, and in so doing, realize this in-line shaving device is both effective and safe.

In a fourth class of in-line bi-directional shaving devices of the present invention, there is provided a single bi-directional head with is formed from two preferably identical elongated uni-directional razor blade cartridges. Examples include the third embodiment shown in the Figures. These cartridges each preferably have straight razor blade strips mounted in their own platform or base, which plugs into or otherwise securely engages a complementary support structure or trough on the common single bi-directional head. The working planes of the two uni-directional cartridges may be co-planar, thus performing in the same manner as the in-line devices in the first class of embodiments of the present invention. Alternatively, the two uni-directional cartridges may be arranged so that their razor-sharp blade edge is (or edges are) each in a distinct working plane, which working planes may be arranged at an angle facing away from one another and intersecting in the range of about 5° to about 15° or so. When the two uni-directional cartridges are so arranged, the resulting in-line shaving structure performs in the manner described with respect to the second class of in-line bi-directional shaving devices of the present invention. Alternatively, if desired, the uni-directional cartridges may each be arranged so that their working planes are facing away from one another at a still greater angle, such as about 20° or more. When so constructed, the in-line shaving devices of this fourth class perform like the third class of in-line bi-directional devices described above.

In a fifth class of in-line bi-directional shaving devices of the present invention, there are two separate bi-directional head structures arranged end-to-end in a common plane on a single handle. The sixth embodiment shown in FIGS. 21 and 22 illustrates this class of in-line device with its two bi-directional heads arranged in a common plane. This extra-long construction provides a twin bi-directional head to allow large skin areas, such as the chest, stomach or back, to be shaved more rapidly, since two swathes of hair may be cut with each stroke of this in-line shaving device. Each individual bi-directional head structure can be implemented in the manner of those shown in the second, third or fifth embodiments. Accordingly, the shaving techniques associated with the first, second or third class of in-line shaving devices of the present invention may be achieved using suitably made in-line shaving devices in this class.

In a sixth class of in-line shaving devices of the present invention, there are two end-to-end bi-directional shaving heads on a single handle arranged so that the working planes of their faces intersect one another. The seventh embodiment shown in FIGS. 23 and 24 is representative of this class of devices. Like the in-line shaving devices in the fifth class, each head in this sixth class of in-line shaving devices may be implemented like those shown in the second, third or fifth embodiments. Like the fifth class of my in-line shaving devices, this sixth in-line class of shaving devices allows for more rapid shaving. Since the working planes of the respective bi-directional head structures are angled toward one another as shown, this sixth class of in-line shaving devices is particularly well-suited for shaving large-area curved body surfaces, such as the arms, legs or sides of the torso.

Advantages of the In-Line Razors of the Present Invention.

The in-line bi-directional razors of the present invention are believed to more readily deliver a closer shave than conventional uni-directional dual-blade wet razors. First, it is easier to shave in two opposite directions with the in-line bi-directional razor of the present invention than with a uni-directional razor on a T-bar handle, since the user's grip on the handgrip portion of the handle of the in-line razor device need not be changed in order to pass the razor across an area of skin to be shaved from two opposite directions. Second, as is well-known, an area of skin is normally shaved closer when a razor is passed across the skin in two opposite directions. Third, in those "single plane" embodiments of the present invention where the razor blades in opposed directions both bear upon the skin simultaneously, the non-cutting blades scrape against the skin, which may well assist in providing a closer shave. In these "one working plane" embodiments of my in-line bi-directional razors, as the forward-moving set of blades cuts hair, the trailing set of blades typically is dragged across the skin. This dragging action may help stretch the skin and thereby facilitate a closer shave by the active blades. Further, the scraping of the skin by the hard sharp edges of the non-cutting blades should loosen dry skin, debris and may also help individual strands or stubbles of hair to stand up further, so they can be cut more closely on the return stroke by those same blades. This scraping action should also have the beneficial effect of helping to spread out more uniformly whatever thin layer of lubricating material remains on or is deposited upon the skin being shaved after the active blades pass over it. The lubricant may be shaving soap lather, shaving cream, or the lubricant from a slowly-dissolving conventional lubricant strip provided on the central rear guard of the razor that is left on the skin.

The in-line bi-directional razor shaving devices of the present invention typically contain twice as many blade edges as does a conventional uni-directional razor. With advances in razor blade metallurgy, manufacture and/or surface protection, blade edges in most present day dual-blade razors corrode more slowly than blades of yesteryear. So, razor blades in daily use tend to dull from use rather than corrosion. By providing twice as many blade edges as are found in a conventional razor head, my in-line bi-directional razor heads may well last almost twice as long, since each blade is essentially doing one-half the cutting of the blades in a uni-directional razor.

Another advantage of my in-line bi-directional shaving devices is that it still can be lifted off of the skin at the end of the stroke in each direction (or at any point in the stroke), if desired. A substantially continuous fluid motion for stroke reversal can still be maintained under such circumstances. For example, the user on the return stroke in the opposite direction can rapidly place the rear longitudinal edge of the active portion of the bi-directional shaving head on the skin and with a very slight natural roll of the wrist can tilt or rotate the razor blade head so that the active blade edges engage the skin on the fly. Thus, a new user of my in-line bi-directional razor (even my single-plane razors), is not forced to immediately use a strictly back-and-forth motion where the razor head is kept on the skin when shaving in order to begin to make use of my in-line razor devices. Instead, the user can initially lift the razor off of the skin, and then with a little practice, can proceed to do so less and less as he or she begins to feel comfortable with the safety of bi-directional shaving technique.

The various constructions of my in-line bi-directional razor blade devices described below are believed to be particularly economical to manufacture. In developing my single-head in-line bi-directional head designs, I recognized that having all of the blades or blade strips arranged relatively near to one another helps reduce the overall width of the head, thus making it easier to handle and less expensive to manufacture and assemble. Further, in my various designs, I often attempted to reduce the number of overall components required, especially the number of pieces that would need to be separately made and/or handled during assembly.

In this regard, in many of the embodiments of the in-line bi-directional razor blade shaving devices of the present invention, the centrally located glide or lubricant strip, located between the two sets of blade strips, does double duty. The glide area or strip is in use no matter which set of blade edges is doing the cutting of hair. Further, the top surface of this common strip (even when generally curved such as in some of my embodiments) is substantially within and forms part of the structure that defines the working plane (or planes) for the first and second set of blade edges.

Also, I wanted to create structures and components which are easy to make and assemble using automatic equipment in order to achieve very low unit costs per in-line razor head. As a result, the individual components of the bi-directional heads can be made using conventional materials and machinery, and then can be assembled using well-known techniques, to form the completed in-line bi-directional razor head, such as: (i) stacking plastic parts together so that they can be interlocked and fastened together using press-fit plastic pins, or (ii) assembled and retained together with metal end-piece retaining bands in the manner used by the Gillette Company to form its Sensor® and Mach3™ uni-directional razor cartridges.

For purposes of illustrating the features and advantages of the present invention, the accompanying Figures, in the interest of clarity, at times exaggerate the size, spacing, clearances and/or relative sizes of or between certain parts of the in-line razor head structures and/or their associated handles, necks or yokes. By the studying of the Figures in the drawings and reading the following detailed description and subjoined claims other objects, features, operating principles, and advantages of the in-line bi-directional razors and methods of the present invention will become apparent.

BRIEF DESCRIPTION OF THE DRAWINGS

In the drawings, where the same reference numerals refer to like items or features in the different views, there are illustrated seven embodiments of the manual in-line bi-directional razor blade devices of the present invention, all useful for speed-shaving, wherein:

FIG. 1 is a perspective view of this speed-shaving device from its razor head end, with the outer and side guards of the blade-edge guarding system of the head removed from around the two sets of razor blade strips to more clearly reveal the bi-directional razor blade geometry, and showing the in-line handle offset from and connected to one end of the razor head;

FIG. 2 is side perspective view of the FIG. 1 device with the blade-edge guarding system in place on the razor head;

FIG. 3 is a top or face view of the FIG. 1 device showing the parallel arrangement and relative spacing of the two sets of outwardly-pointing razor blade strips between the two outer edge (front) guards and the transverse end guards, and showing an elongated central lubricant strip between the two sets of razor blade strips;

FIG. 4 is an enlarged end cross-sectional view of the head structure taken along line 4—4 of FIG. 3 showing the bi-directional blade arrangement and the outer guard members and central lubricant strip arranged in a single working plane, with the two sets of the elongated parallel razor blade strips having their blade edges located in the working plane and pointing outwardly away at an acute angle from the center of the razor head; and FIG. 5 is an enlarged cross-sectional view taken along line 5—5 of the handle in FIG. 1.

FIG. 6 is a side perspective view of the device showing the elongated handle offset from the razor head structure;

FIG. 7 is a top view of the FIG. 6 device showing the two sets of razor blade strips pointing outwardly, away from a centrally-located elongated strip portion serving as the rear guard of both razor blade sets;

FIG. 8 is an enlarged cross-sectional view of the razor head structure taken along line 8—8 of FIG. 7 showing the bi-directional blade arrangement and how the exterior front guard members and rear guard member form two working planes arranged at an angle to and facing away one another; and FIG. 9 is an enlarged cross-sectional view of the device's handle taken along line 9—9 of FIG. 7.

FIG. 10 shows, in transverse cross-section from a view like that of FIG. 8, the razor head structure with the two elongated cartridges in place within the troughs and ready for use; and FIG. 11 shows in a view like FIG. 10, the elongated razor blade cartridges removed from their respective troughs formed in the head structure.

FIG. 12 is a side perspective view of the device showing its generally flat handle arranged in a common plane with the elongated razor head structure, with the cap ready to be slid on the head;

FIG. 13 is a top view of the device showing the face of the head with its bi-directional blade arrangement and blade-guarding system;

FIG. 14 is an enlarged cross-sectional view taken along line 14—14 of FIG. 13 showing the two sets of razor blade strips arranged in a common plane defined by the blade-edge guarding system; and FIG. 15 is an enlarged cross-sectional view taken along line 15—15 of FIG. 13 showing the handle shape; and FIG. 16 is an end view of the razor head as in FIG. 14 taken from the direction of arrow 16A in FIG. 13 with the cover installed on the head.

FIG. 17 is a side perspective view showing the bi-directional razor blade head separated from the handle and showing the elongated channel into which one end of the handle can be inserted;

FIG. 18 is a top view of the FIG. 17 device shown in an assembled state, with the handle inserted into the complementary channel generally indicated by hidden lines;

FIG. 19 is an enlarged cross-sectional view taken along line 19—19 of FIG. 18 showing the bi-directional blade arrangement, the two working planes, and a central lubricant strip of the razor head, with the handle in place within the channel of the razor head; and FIG. 20 is an enlarged cross-sectional view taken along line 20—20 of FIG. 18 showing the handle's shape.

FIG. 21 is a side perspective view showing that the two working planes of the first and second bi-directional head portions are co-planar and directly in line with the handle; and FIG. 22 is a top view of the FIG. 21 device more clearly showing the bi-directional blade arrangement of each head structure portion.

FIG. 23 is a side perspective view of the device showing the angle between the two working planes as less than or equal to 170°; and FIG. 24 is a top view of the FIG. 23 device showing the blade arrangements of the individual bi-directional head portions.

FIG. 25 is a side elevational view of the in-line bi-directional razor blade device shown held in a user's hand and set down transversely upon a curved body member, namely the thigh of a leg (shown in partial cross-section);

FIG. 26 is a view of the bottom of the device in FIG. 25 showing the side profile of the thin elongated handle and the two sets of opposed razor blade edges with a central (speckled) lubricant strip therebetween;

FIG. 27 is a view of a woman using the FIG. 25 body shaver to shave hair from an upper calf portion of her left leg (with the device shown somewhat larger than its preferred size, for clarity of illustration);

FIGS. 28 and 29 are a side elevational view and a transverse cross-sectional view respectively, of a lightweight plastic storage cover having a generally cylindrical cross-section as best shown in FIG. 29, with a cross-hatched central gripping portion to enable a user to remove the cover from the razor blade strip structure of the FIG. 25 device, which the cover fits over;

FIGS. 30 and 31 are transverse fragmentary cross-sectional views of the FIG. 25 device taken along lines 30—30 and 31—31 respectively of FIG. 25, which help illustrate a preferred internal construction of the base support structure and the razor blade platform structure mounted therein, and the flow-through spaces provided between the parallel razor blade strips at regular intervals, as best seen in FIG. 31; and FIG. 32 illustrates two cross-sectional views of the type shown in FIG. 30 illustrating the shaving action in two opposite directions which can be achieved on a large body area, such as the thigh, depicted in longitudinal cross-section.

FIG. 33 is a side-elevational view showing the overall shape of the handle and bi-directional razor blade cartridge, with the profile of a plastic cap shown in phantom in place over the razor blade cartridge; and FIG. 34 is a view of the device from the bottom of FIG. 33, with the cap again shown in phantom in place over the razor blade cartridge; and FIG. 35 is a cross-sectional view taken along line 35—35 of FIG. 33 showing the cartridge inserted into a trough in the handle, with the cap removed therefrom; and FIG. 36 is a cross-sectional view like FIG. 35 but showing the cap installed upon the cartridge and cartridge removed from the handle.

FIGS. 37 through 39 illustrate a tenth embodiment of an in-line bi-directional razor blade device having an elongated in-line handle shown projecting outwardly away at an angle from the rear side of the bi-directional razor blade head, where:

FIG. 37 is a side perspective view of the device showing the bi-directional head structure mounted on a handle having a large textured inner surface and widened rim about its perimeter for easy gripping;

FIG. 38 is an end elevational view in partial cross-section taken along line 38—38 of FIG. 37 showing the relative thicknesses of the bi-directional razor blade head and the rim and inner textured grip portions of the handle; and FIG. 39 is an enlarged cross-sectional view taken along line 39—39 of FIG. 37 showing two sets of bi-directional razor blade strips formed from two flat razor blades mounted on a straight elongated platform and retained by an elongated cap member having multiple parallel pins spaced from one another, one of which pins is shown.

FIG. 40 is a side elevational view of the device showing one side of its bi-directional razor blade structure (with the other side being a mirror-image thereof) snapped onto a handle portion having a textured inner surface surrounded by a thicker rim for easy gripping; and FIG. 41 is a top view of the face, in partial cross-section, taken along line 41—41 of FIG. 40, which shows the central lubricant strip and razor blade edges of the razor blade head, and a cut-away of the handle further showing the rim and textured area.

FIGS. 42 through 44 illustrate a twelfth embodiment of an in-line bi-directional razor blade device having an elongated handle and two razor blade strip half-head portions which each contain a pair of outwardly-pointing razor blade strips, the razor head portions being connected to a Y-shaped neck of the handle leading to a unitary handgrip portion, where:

FIG. 42 is a plan view of the device showing the faces of two uni-directional head halves of the overall bi-directional razor blade head structure spaced from one another and connected to the Y-shaped neck of the handle;

FIG. 43 is an enlarged cross-sectional view taken along line 43—43 of FIG. 42 showing the opposed blade arrangement and the front and rear guards associated with each blade set, which although arranged in separate heads, are still in a common working plane; and FIG. 44 is an enlarged cross-sectional view taken along line 44—44 showing the generally rectangular transverse cross-sectional shape of the handle.

FIGS. 45 through 47 illustrate a thirteenth embodiment of an in-line bi-directional razor blade device having an elongated in-line handle and a pair of removable plug-in uni-directional razor blade head portions, each containing a pair of outwardly-pointing razor blade strips, the head portions being detachably connected together by a common neck portion arranged as a generally U-shaped yoke or cross-section connected to one end of the handle, where:

FIG. 45 is a side perspective view of the device showing its handle and U-shaped yoke at one end thereof connected to the two uni-directional razor blade heads arranged generally parallel to and spaced from one another; and FIG. 46 is an end view in partial cross-section of the FIG. 45 device taken along line 46—46 of FIG. 45, showing the two blade strip sets having their sharpened edges arranged in a common plane.

FIG. 47 shows a variation of the FIG. 45 device, taken from the same view as FIG. 46, and showing that the two elongated uni-directional razor blade head structures may be arranged parallel to one another with their faces tilted at an angle away from one another, thus forming a device having two working planes, similar to the fifth embodiment shown in FIGS. 17 through 20.

FIG. 48 is a front end perspective view of the device showing the release buttons for detaching the two cartridges mounted on a pair of shell-bearing connection members which permit each cartridge to swivel about its own central elongated axis located near the working plane into which the razor-sharp edges of its individual razor blades project;

FIG. 49 is a side elevational view of the FIG. 48 device;

FIG. 50 is a top view of the FIG. 48 device; and

FIG. 51 is an enlarged fragmentary cross-sectional view taken along line 51—51 of FIG. 49 showing one possible construction for the razor blade cartridges, and showing that each set of blade strips may have their razor-sharp edges arranged in a plane defined by flexible elongated front and rear guards in each cartridge.

FIG. 53 is a side elevational view of the device;

FIG. 54 is a side perspective view of the device taken from the distal end of the handle, which shows more clearly the yoke and two removable razor blade cartridges;

FIG. 55 is an end elevational view taken from the right side of FIG. 53 showing the two uni-directional cartridges arranged with their working planes at a distinct angle to one another; and FIG. 56 is an enlarged cross-sectional view taken along line 56—56 of FIG. 53 showing the internal construction of the razor blade heads, each with three spring-loaded razor blade strips mounted therein, which heads each pivot independently about its own elongated hollow supporting axis during use.

DETAILED DESCRIPTION OF THE PREFERRED EMBODIMENTS

Numerous in-line bi-directional razor blade devices and razor head structures therefor are shown in the Figures and discussed herein. While these embodiments are presently preferred, they are still only exemplary of the various possible in-line bi-directional razor blade devices and razor heads of the present invention. As explained further below, I contemplate that, within the scope of the present invention, variants of my in-line bi-directional razor devices may readily be constructed based upon my teachings herein.

All of my in-line bi-directional razor blade head structures are preferably symmetrical about a common plane of reference that runs along the longitudinal axis of the device. This includes my single effective head designs formed from two uni-directional razor blade heads, which have an overall longitudinal axis centrally located between the two uni-directional razor blade heads which are preferably arranged with their individual longitudinal axes parallel to one another, and which may be spaced apart from one another. Unless otherwise indicated, my bi-directional head structures are also symmetrical about their central transverse axis. Thus, those in the art should appreciate that, in general, the descriptions herein of one side, end, or section of any given razor head will also serve to describe the other half of the symmetrical structure on the opposite side of the longitudinal axis or central transverse axis.

Figures 1, 2, 3, 4, 5:
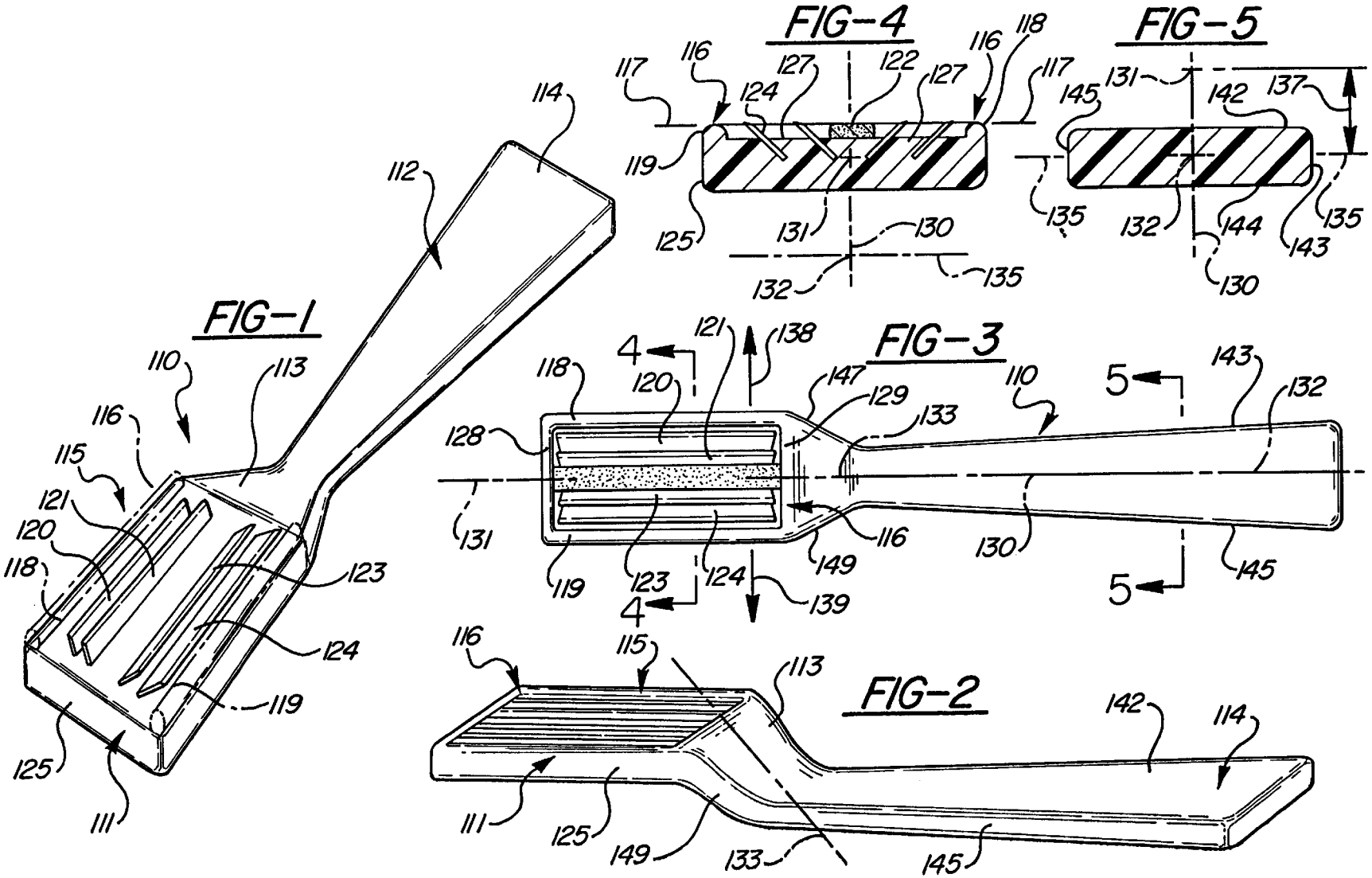
FIGS. 1 through 5 illustrate a first embodiment of an in-line bi-directional razor blade device having a straight elongated handle connected to one end of a flat razor head structure, where.

FIGS. 1 though 5 illustrate a first embodiment of the present invention. This embodiment shows my in-line bi-directional razor blade shaving device in one of its simpler forms, with all of the sharpened edges of its razor blade strips located in a common working plane. FIG. 1 illustrates, in perspective, in-line bi-directional razor device 110, while remaining FIGS. 2 through 5 show various aspects of the FIG. 1 device. Razor 110 is preferably formed of any suitable molded plastic material to provide a head 111 and an integral handle 112. The handle may have an upper end portion or neck 113 which is preferably molded integrally with the head and a lower handgrip portion 114. As shown, handgrip 114, which is generally flat, may increase in width with increasing distance from head 111.

Head 111 has the general shape of an elongated, narrow rectangular strip or bar. It has a substantially flat, exposed shaving face 115, which includes a generally rectangular rim-like blade-edge guarding system 116 partially shown in phantom in FIG. 1, and shown solidly in FIGS. 2 through 4. Guarding system 116 includes required longitudinally-arranged first and second front guard portions 118 and 119, shown in phantom in FIG. 1, and shown solidly in FIG. 4, and optional transversely-arranged end guard portions 128 and 129, as best seen in FIGS. 3 and 4. These guard portions preferably each have relatively flat elongated face surfaces, as generally shown, with rounded edges and outside corners to prevent inadvertent scratching of the skin to be shaved. Guard system 116 also includes an optional elongated central rear guard portion 122, shown in FIGS. 2–4. Rear guard 122 may have a smooth plastic surface, or may be provided with a conventional lubricant strip bonded thereto. The flat face surfaces of front guard portions 118 and 119 and rear guard portion 122 are arranged in and together define a common working plane 117. Plane 117 generally is coextensive with that portion of face 115 which is placed in contact with a user's skin. Plane 117 is also the plane into which the razor-sharp edges of the razor blade strips project and extend. The skin of the user is very substantially protected from undesired cuts and nicks from the razor-sharp blade edges by this blade-edge guarding system 116. As shown in FIGS. 3 and 4, central strip 122 functions as a rear guard for both pairs of razor blades.

As seen in FIG. 1, head 111 is provided with a first set of straight elongated razor blades 120 and 121, and a generally opposite second set of straight elongated razor blades 123 and 124. These blades are each formed of a narrow, very thin, single, straight, razor blade strip having a razor-sharp outer edge. Typically, the strip will be flat and have a thickness of about 0.005 inch (0.13 mm) or less. The overall width of each blade strip is preferably in the range from about ⅛ inch (3.2 mm) to about ¼ inch (6.5 mm). As best shown in FIG. 4, each blade strip has an inner portion, for example, portion 126 of strip 120, which is embedded within lower platform section 125 of head 111, and an outer portion with a razor-sharp edge, for example razor-sharp portion 127 of strip 120, which extends outwardly from head 111 for cutting hair (or hair stubble) by shaving it at the skin line. The blade edges in each set are preferably parallel to one another and to the blade edges in the other set of blade strips. The sets of sharpened blade edges are arranged at acute opposite angles to working plane 117, so that the razor-sharp edges of the first set of blade strips 120 and 121 cut in when head 111 is moved in a first direction, while razor-sharp blade edges of the second set of razor strips 123 and 124 cut when head 111 is moved in a second opposite direction. Thus, while one pair of blade edges is cutting, the other pair is merely dragging behind, riding along upon the skin. If rear guard 122 is omitted, as it may be if desired, these dragging non-cutting blade edges will also serve as part of the rear guard, in that they will help establish the working plane for the set of blade edges which are doing the cutting. The front guard of the set of non-cutting blade strips being dragged along will also serve as part of the rear guard to establish the working plane for the set of blade edges which are doing the cutting.

In terms of overall dimensions, face 115, by way of example, may be about ⅜ inch (9.5 mm) to about ½ inch (12.7 mm) or larger in width and about 1 ½ inch (38 mm) in nominal length. Head 111 may be about 3/16 inch (4.8 mm) to about ¼ inch (6.4 mm) or more in thickness. In practice, these dimensions for head 111 may vary considerably. For example, the length may be about 1 inch (2.5 cm) to about 2.75 inches (7 cm) or longer, but in general it can be seen that the head has a narrow, generally rectangular elongated shape. Handle 112, including neck portion 113, may be between just under about 3 inches long (about 7.5 cm) to just over about 6 inches long (about 15 cm) or longer. In order to allow head 111 to be made using conventional razor blade strips having a length on the order of 1.3 inches (32 mm) to about 1.5 inches long (about 38 mm), the overall length for the head, including end guard portions, is preferably about 1.5 inches (about 38 mm) to about 1.7 inches (about 44 mm).

As shown in the drawings, the pairs of blade strips 120, 121 and 123, 124 are closely adjacent to each other, for example, on the order of about 1/32 inch (0.8 mm) to about 1/16 inch (1.6 mm). Central rear guard/lubricant strip 122 may have any suitable width, for example, about 3/32 inch (2.4 mm) to about 3/16 inch (about 5 mm). Strip 122 preferably has a length substantially coextensive with the length of the razor blade strips, as shown in FIG. 3. Strip 122 may extend substantially fully between end portions 128 and 129. The width of rear guard 122 and spacings between the razor blade strips may be varied as desired. Also, guard 122, along with the other guard portions 118,119, 128 and 129, may be integrally formed in plastic (not shown) with the lower portion 125 of razor head 111. Thus, for example, rear guard 122 may be formed as an elongated integral mesa projecting above flat inner surface 127 of razor head 111. If desired, a thin lubricant strip may be bonded or otherwise attached to the top of this mesa. Inner surface 127 of platform 125 is preferably rimmed on all four sides by blade-edge guarding system 116. Elongated front guards 118 and 119 preferably have exposed face surfaces that each essentially describe an elongated straight broad line residing in the working plane 117. If desired, transverse end guards 128 and 129 may have face surfaces which are slightly raised so as to extend slightly above working plane 117, especially near rear guard 122, since skin is generally pliable.

Rear guard 122 can also be elevated somewhat, if desired. In such an instance, the exposed face surfaces of front guard 118 and rear guard 122 would specifically define the first working plane into which razor-sharp edges of blade strips 120 and 121 extend. Similarly, the exposed face surfaces of front guard 119 and rear guard 122 would specifically define the second working plane into which razor-sharp edges of blade strips 122 and 123 extend. In this example, there can be an angle of a few tenths of a degree up to about 5° or even about 10° between the two working planes, as illustrated in some of the further embodiments.

Preferably, each of the blades 120, 121,123 and 124 is formed of conventional flat stock razor blade material, such as a stainless steel alloy. Alternatively, the blade material may be sintered metal, such as a hard carbide, or any other suitable razor blade alloy material. The blades may also be provided with a micro layer of any conventional or suitable anti-corrosion and/or anti-wear material. The blade strips are preferably pre-sharpened, cut to length, and then installed in base portion 125 of head 111 during construction of razor 110. The blade strips may be embedded in the head of the razor during the molding of the razor head. Alternatively, they may be inserted in slots or sockets provided in a molded head or a head made from assembled pieces for the purpose of receiving the blades. The blades may be fastened in their sockets by the molding of plastic around them, or adhesively, or by any conventional or suitable mechanical fastening means, including cold-headed plastic pins, as illustrated in later embodiments of the present invention. Blade strips 120–124 are each preferably continuous, of uniform width, and extend along almost the entire length of head 111. Opposed end portions of the blade strips may be positioned under the opposed end guards 128 and 129 (not shown), which end guards may be hollow or made or rimmed in conventional metal bands for this purpose, if desired.

The two opposing pairs of blades extend outwardly at equal and opposite acute angles relative to face 115 and working plane 117 of the head of razor 110. This acute angle may be any suitable value, such as in the range of about 5° to about 40°, with angles in the range of 15 to 35° being presently preferred.

Several further observations may be made regarding the overall geometry of shaving device 110. Device 110 has a central longitudinal plane 130 (as best seen in FIGS. 3, 4 and 5) in which central longitudinal axis 131 of head 111 and central longitudinal axis 132 of handle 112 both lie. Plane 130 is sometimes referred to herein as the plane of reference or the plane of symmetry, since in virtually all embodiments of the present invention, the one half of the shaving device on one side of this plane is a mirror image of the other half of the shaving device on the other side of this plane. As can be best seen in FIGS. 4 and 5, axes 131 and 132 are not coincident, even though they lie in the same plane 130, as can be seen when razor 110 is examined from a plan view (e.g., from the top) as in FIG. 3. Head 111 and handle 112 are preferably arranged so that their axes 131 and 132 are parallel. (However, head 111 and handle 112 may be slightly angled relative to another, so that axis 132 intersects axis 131 at some point, if desired, preferably near the center of head 111.

FIGS. 4 and 5 show central plane 130 as a line, with the parallel axes 131 and 132 (which extend into and out of the paper) appearing as dots on line 130, to show their relative spacing. Neck 113 also has a central axis 133, which also lies in plane 130, and is shown arranged at an angle of about 45° relative to axes 131 and 132. (But, as will be seen in later embodiments, this neck angle may be anywhere from 0° to about 90°, as desired.) Neck 113 is preferably of a moderate length, on the order of about ¼ inch (about 6 mm) to roughly ¾ inch (about 20 mm). When axis 133 is arranged at a suitable angle, neck 113 provides an offset between the working plane 117 from the central transverse plane 135 of handle 112, as shown in FIGS. 2 and 4. Preferably this offset distance, as indicated by vertical dimension 137 in FIG. 5 (which also shows the location of transverse plane 135) is preferably on the order of about 0.5 inch (about 12 mm) to about one inch (about 25 mm). This offset may be made smaller or larger if desired. In general, having the handle or rearwardly offset from the shaving head, as shown, allows the fingers of the user to avoid rubbing against a skin surface, or through shaving lather. For example, if someone had lathered a hairy stomach area with shaving cream, this lateral offset would help the user's fingers stay above the shaving cream, rather than wiping through it, while shaving the stomach. Thus, the lateral offset is preferably ⅝ inch (about 16 mm) or greater.

The manner in which in-line bi-directional shaving device 110 is used has already been described in the Summary of the Invention with regard to the first class of shaving devices of the present invention. Thus, it will only be briefly reviewed here. While gripping handle 112, a user places razor head 111 against the skin to be shaved and moves head 111 back-and-forth in the directions of arrows 138 and 139 shown in FIG. 3. These arrows define first and second opposite directions generally perpendicular to axes 131 and 132. Note that these razor blades may be moved in directions that are at an angle (anywhere from 0° to 45° or more) to axes 131 and 132, and still cut hair. But it is preferred to make the back-and-forth motions of razor head 111 substantially perpendicular to axes 131 and 132, for optimum performance. This helps ensure that the same regions of the skin are shaved from two opposite directions. With reference to FIG. 3, when razor 110 and its head 111 are moved upwardly along the skin, as indicated by arrow 138, the razor-sharp edges of the first set of razor blade strips 120 and 121 are active and cut hair, while the edges of the second set of razor blade strips 123 and 124 drag along the skin, without cutting. Then, when razor 110 and its head 111 are moved downwardly along the skin, as indicated by arrow 139, the razor-sharp edges of the second set of razor blade strips 123 and 124 are active and cut hair, while the edges of first set of razor blade strips 120 and 121 drag along the skin, without cutting.

As can best be seen in FIG. 4, the first set of blade strips 120, 121 have their razor-sharp edges positioned in a first working plane defined principally by elongated front and rear guard portions 118 and 122. Note that, to a much lesser degree, end portions 128 and 129 may also be used to help define this working plane, particularly if their face surfaces are substantially level with the working plane. The second set of blade strips 123 and 124 have their razor-sharp edges positioned in a working plane defined principally by elongated front and rear guard 119 and 122. Again, end portions 128 and 129, to a much lesser extent, may also help define this second working plane. As shown in FIG. 4, these working planes in shaving device 110 are shown coincident with common plane 117. Razor 110 may be used in almost any direction when shaving legs, arms, stomachs or any other large areas of the body to be shaved. Razor 110 may even be used to shave the face of another or the user's own face, if desired.

I prefer to have the in-line bi-directional razor blade shaving devices of the present invention, including razor device 110, used on the arms and legs by having the shaving strokes in the first and second directions run along generally parallel to the major axis of the limb being shaved. In other words, a user shaving her arm may first stroke downwardly, in the direction from the elbow toward the wrist, and then upwardly, in the opposite direction from the wrist to the elbow. Similarly, a person shaving a leg may stroke first downwardly in the direction from the knee to the ankle, and then upwardly in the direction from the ankle to the knee. When shaving other areas of the body, such as the stomach or face, I prefer to have most of the strokes made along the lines of least curvature on the skin surface, i.e., the lines that curve the least, rather than the most. For example, on the stomachs of a fit and trim person, this generally would be an upward and downward motion, rather than one generally parallel to the waist line. Preferably, head 111 of razor device 110 is provided with a removable cover or cap (not shown) that may be like the cover shown in FIGS. 12, 13 and 16.

The handgrip portion 114 of handle 112 has upper and lower flat face surfaces 142 and 144, and flat opposed side surfaces 143 and 145. Face surfaces 142 and 144 are preferably parallel to one another and to plane 135. Handgrip portion 114 is shown gently tapering from a broad distal end to a smaller neck area, so that the distance between sidewalls 143 and 145 decreases continuously as the distance to neck portion 113 decreases. At the narrowest width of handle 112, sidewalls 143 and 145 of handgrip 114 connect to sidewalls 147 and 149 of neck 113, which flares outwardly to meet the outer sidewalls of the base portion 125 of razor head 111. Alternatively, handle 112 may be shaped in a configuration which is more curved or straighter than shown, as desired.

Figures 6, 7, 8, 9, 10, 11:
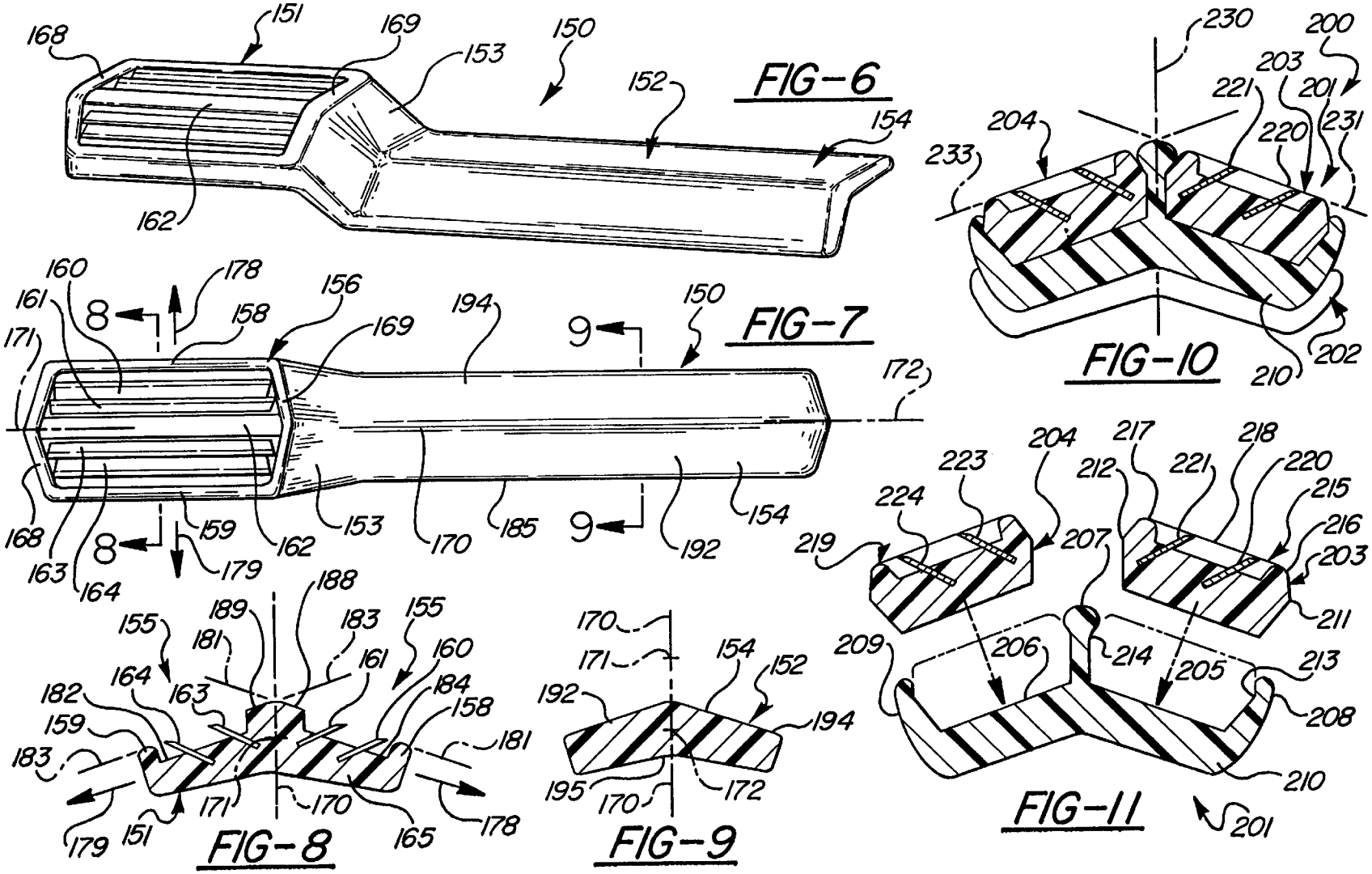
FIGS. 6 through 9 illustrate a second embodiment of an in-line bi-directional razor blade device having a straight elongated handle connected in-line through an angled neck portion to one end of a bi-directional razor blade structure that has two working planes at an angle to one another, where.
FIGS. 10 through 11 illustrate a third embodiment of an in-line bi-directional razor blade device similar in all respects to the FIG. 6 device except for having a wider handle and a thicker and wider razor head structure, in which is provided two elongated troughs generally parallel to the longitudinal axis of the handle for frictionally receiving two elongated razor blade cartridge structures therein, where.

FIGS. 6 through 9 illustrate a second embodiment of the present invention, namely in-line bi-directional shaving device 150, which includes elongated head 151 arranged in-line with elongated handle 152. Handle 152 includes offset neck portion 153 and handgrip portion 154. Face 155 of razor head 151 has a shallow upside down V-shape when viewed in transverse cross-section, as best seen in FIG. 8. The transverse cross-section of handgrip 154 has a similar inverted V-shape, as shown in FIG. 9, as does the cross-section of neck portion 153.

FIG. 7 shows that razor head 161 includes a rim-like blade-edge guarding system 156, including required elongated first and second front guard portions 158 and 159, which are preferably flat and smooth. System 156 may optionally include transversely-arranged end guard portions 168 and 169, which, as shown, may be bowed slightly outwardly, if desired. Like guarding system 116 in the FIG. 1 embodiment, guarding system 156 preferably has rounded edges and outer corners to help protect the skin of the user from undesired cuts and nicks by the razor-sharp blade edges. As shown in FIG. 6, end guards 168 and 169 also have an inverted V-shape in transverse cross-section, with relatively flat opposed elongated half face surfaces, facing slightly away from one another, as generally shown. Guarding system 156 also includes a required elongated centrally-located rear guard portion 162, shown in FIGS. 6–8. The exposed face surface of rear guard 162 may be smooth plastic as shown, or it may be provided with a lubricant strip (not shown). As shown in FIG. 8, the face of rear guard 162 is divided into two elongated smooth generally flat half-faces 188 and 189. The generally flat elongated face surface of first front guard 158 and first flat half-face 188 of rear guard 162 form and define a first working plane 181. Similarly, the elongated flat face surface of second front guard 159 and second flat half-face 189 of second rear guard 162 form and define a second working plane 183. The angle of separation between the first and second working planes is significant, and is shown in FIG. 8 as about 40°. This angle may be in the range of about 15° to about 100°, is preferably in the range of 20° to 80°, and most preferably is in the range of about 30° to about 60°.

As seen in FIGS. 6 through 8, head 151 is provided with a first set of elongated straight razor blades 160 and 161, and a generally opposed second set of elongated straight razor blades 163 and 164. These blades may be made and installed like the razor blade strips in the FIG. 1 embodiment. Each blade strip has an inner portion embedded in inner surface 182 or 184 of the lower platform section 165 of head 151, and an outer portion with a razor-sharp edge which extends outwardly from head 151 for cutting hair or hair stubble by shaving it at the skin line. The blade edges in each set of blade strips are preferably parallel to one another and to the blade edges in the other set of blade strips. The blade edges of blade strips 160 and 161 cut hair when the first working plane 181 is placed on the skin and razor head 151 is moved tangentially along the skin in the direction indicated by arrow 178. Similarly, the razor-sharp edges of blade strips 163 and 164 cut hair when the second working plane 183 of razor head 151 is placed on the skin and is moved in a second direction 179 generally opposite to first direction 178. The blade edges are preferably parallel to the plane of symmetry 170 of device 150, which is discussed next.

As shown in FIGS. 7 through 9, razor blade device 150 is symmetrically arranged about central longitudinal plane 170, in which the central longitudinal axes 171 and 172 of head 151 and handgrip 154 both lie. Also, as in all of my embodiments, and as shown, blade edges of the two opposed sets of blades are equidistant from symmetry plane 170. Specifically, the razor-sharp edges of front blades 160 and 164 are equidistant from plane 170, and the razor-sharp edges of rear blades 161 and 163 are also equidistant from plane 170. In all of my embodiments, the front blade edges are spaced slightly farther from plane 170 than are the rear blade edges.

Central longitudinal axes 171 and 172 of head 151 and handle 152 are preferably parallel to one another, as shown, and in virtually all other embodiments herein. This is a preferred arrangement, since a user quickly learns how to judge the precise tilt or lie of the bi-directional razor blade head against his or her skin by mentally noting the angle of inclination of the handle relative to the area of skin being shaved.

However, in all my embodiments, the longitudinal axis of the handle may be inclined relative to the longitudinal axis of the head, if desired, as long as both axes remain in the plane of symmetry. By way of example with respect to FIGS. 6–9, axis 172 may be inclined relative to axis 171, as desired, as long as both axes remain in the symmetry plane 170. Specifically, axis 172 may be oriented so as to tilt handle 152 toward the exposed razor blade strips by an angle from 5° to about 30°, or away from the exposed razor blade strips by an angle of about 5° to about 50° if desired. Preferably, such an angle of handle inclination away from the exposed blade strips would be between about 10° and about 40°, with an angle between about 15° and about 30° being most preferred, if the handle is to be tilted at all. In this later inclined handle situation, it is also preferred that the axis 172 of the handle intersect axis 171 of the head near the center of head 151. In such a case, neck portion 153 may still be used to provide a transition between the head and handle, or it may be eliminated, as desired. Also, the neck portion even may be attached to the rear of base portion 165 of razor head 151, including at any desired location, near the geometric center of head 151, rather than at one end thereof, as shown in FIGS. 6 and 7. Those skilled in the art should appreciate that these same kinds of inclined handle variations can be used with most other embodiments of the present invention, if desired.

In FIG. 7, side surfaces 183 and 185 of handgrip portion 154 are generally shown tilted a slight angle, although the corresponding opposed edges of surfaces are arranged parallel to one another. As can be seen in FIG. 8, the side surfaces of base portion 165 of razor head 151 are also arranged at the same tilted angle, in order to provide the same stylish common design appearance on both razor head 151 and handgrip 154.

An advantage of the inverted V-shaped cross-section of handle 152 is that it provides a shallow depression 195 on the back surface of handgrip 154, into which a user may place his or her thumb when grasping the handgrip for shaving. Also, front face surface of handgrip 154 has two distinct elongated flat half-face surfaces 192 and 194 arranged at an angle to one another, which preferably mimics (i.e., is substantially equal to) the separation angle between the working planes 181 and 183. These two angled half-faces 192 and 194 advantageously substantially conform to the natural curvature of a user's fingers opposite an opposed thumb that is positioned on the other side of handgrip 154, which occurs as the user wraps his or her fingers and thumb around handgrip 154 when using device 150 to shave.

FIGS. 10 and 11 show a third embodiment of the present invention, in assembled and exploded cross-sectional views, namely in-line bi-directional shaving device 200. Device 200 includes an elongated twin-cartridge razor head 201 arranged in-line with handle 202. Handle 202 is constructed like handle 152 in the previous embodiment, except that handle 202 is wider, as wide as cartridge head 201, as can be seen in FIG. 10. Like all other embodiments of my present invention, device 200 is symmetrically arranged about longitudinal plane of symmetry, which is shown as a vertical line 230 in FIG. 10. Length of razor head 201 is preferably 1.5 times to three times or more as long as the transverse width of head 201.

Razor head 201 carries two elongated uni-directional cartridges 203 and 204 whose working faces and working planes are angled away from the plane of symmetry 230 and from each other as shown. This results from cartridges 203 and 204 being installed into elongated troughs 205 and 206, which are each tipped away from plane 230 at an angle precisely equal to one-half of the separation angle between the working planes. Troughs 205 and 206 are formed by longitudinally-arranged elongated central wall portion 207, longitudinally-arranged elongated sidewall portions 208 and 209, and flat interior bottom surfaces and transversely arranged end walls (not shown) of base portion 210 of head 201.

As shown in FIGS. 10 and 11, the outwardly-facing side surfaces of cartridges 203 and 204 are complementary to the inwardly-facing, side surfaces of troughs 205 and 206. For example, cartridge 203 includes two outwardly-bowed, sloped sidewalls with elongated apex edges 211 and 212, which edges fit into corresponding elongated recesses 213 and 214 in the sidewalls of trough 205. The top bulbous portion of central wall 207 curves out partially into the trough area, as do the inwardly-inclined top portions of sidewalls 208 and 209. Walls 207, 208 and 209 are preferably made sufficiently thin so as to be somewhat bendable or compliant, to allow the cartridges to be snappingly engaged into the troughs. Thus, the sidewall features of the cartridges mechanically engage complementary features of the troughs, thus holding the cartridge in place in the trough, until a user deliberately snaps the cartridge out of the trough. This of course may be done when a user wishes to replace a cartridge having spent or dull razor blade strips with fresh razor-sharp edges. In all embodiments having twin uni-directional cartridges, replacement of both cartridges at the same time is recommended. The end walls (not shown) of the cartridges 203 and 204 each preferably have a gripping surface, or a raised transverse rib. Such a mechanical feature allows a user to pinch the cartridge from the opposed ends so as to be able to safely extract it from its trough by pulling upwardly, away from the trough, from one or both ends of the cartridge. Preferably, the transversely-arranged end walls (not shown) of the troughs are at least partially cut away to allow a user's fingers to get a suitable grip upon each cartridge.

Cartridges 203 and 204 are preferably identical in construction. They appear different in FIGS. 10 and 11, because one is generally rotated 180° from the orientation of the other. In this manner, they together provide two sets of opposed razor blade strips, with each set pointing in generally opposite directions. Each cartridge contains a pair of razor blades arranged at the same acute angle to its working plane, as defined by its blade-edge guarding system. For example, cartridge 203 includes blade-edge guarding system 215 formed from elongated front and rear guard portions 216 and 217 and transversely-located end guard portions, such as end guard portion 218. Similarly, cartridge 204 has a blade-edge guarding system 219 formed from elongated front and rear guards and optional end guards, just like cartridge 203. The top exposed surfaces of blade-edge guarding system 215 of cartridge 203 form working plane 231, into which the razor-sharp edges of blade strips 220 and 221 project, while the top exposed surfaces of blade-edge guarding system 219 form working plane 233 into which the razor-sharp edges of blade strips 223 and 224 project.

As best shown in FIG. 10, the two sides of the upper exposed surface of central wall 207 immediately adjacent symmetry plane 230 are preferably arranged to be generally in-line with, and form a lateral extension of, the rear guard surfaces for working planes 231 and 233. This forms a larger effective area of flat contact for the rear guards of cartridges 203 and 204. This larger flat area for each rear guard should help improve the ease with which a user of shaving device 200 is able to place each working plane of razor head 201 upon the skin to be shaved as the razor head it is repetitively stroked back and forth in two opposite directions.

Figures 12, 13, 14, 15, 16:
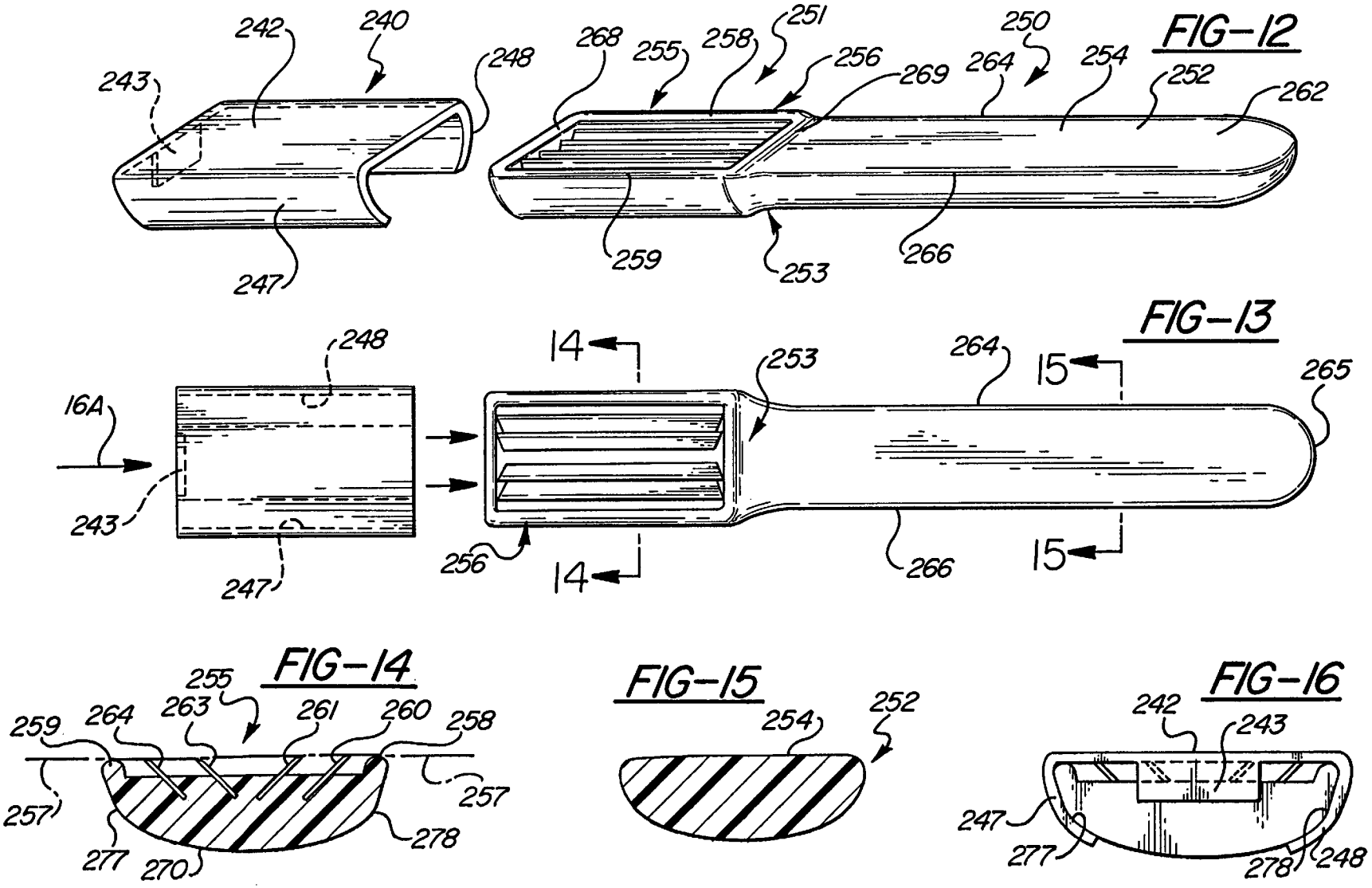
FIGS. 12 through 16 illustrate a fourth embodiment of an in-line bi-directional razor blade device having a straight elongated handle connected directly inline to one end of a flat razor head structure which does not have a central lubricant strip or centrally-located rear guard, but which includes a blade-covering cap member, where.

FIGS. 12 through 16 show a fourth embodiment of the present invention, namely in-line bi-directional shaving device 250 with elongated razor head 251 arranged in-line with an elongated handle 252. Razor head 251 has two sets of opposed outwardly-pointing razor blade strips. Notably, no central rear guard is provided in this embodiment. This permits the two sets of opposed blade strips to be positioned closer together, to provide a four-bladed bi-directional head with a narrower width. A protective cover or cap 240 is provided, which can be inserted over head 251, when device 250 is not in use, as shown in FIG. 16, to protect the user from inadvertently contacting the razor-sharp edges.

In FIG. 12, face 255 of razor head 251 is shown to be defined in part by rim-like rectilinear blade-edge guarding system 256 having two elongated front guard portions 258 and 259 with optional transversely-located end guard portions 268 and 269. The upper exposed surfaces of system 256 define a working plane 257 into which the razor-sharp edges of the two opposed sets of razor blade strips 260, 261 and 263, 264 project.

Face 255 is shown substantially flush with planar face surface 262 of handgrip portion 254. Upper elongated side edges 264 and 266 of handle 252 are shown parallel to and spaced from one another, and interconnected by rounded distal end portion 265. The width of handgrip 254 is slightly less than the width of head 251, and thus neck portion 253 expands gently outwardly as the distance to head 251 decreases, to provide a gently curved stylish transition between head 251 and handgrip 254.

Cap 240 includes a generally flat top wall 242, and a centrally-located end wall 243 and inwardly-curving sidewalls 246 and 247 which all depend downwardly from top wall 242. Elongated interior corner edges 248 and 249 formed respectively at the intersection of top wall 242 and sidewalls 246 and 247 are spaced and sized to slide over and almost snugly engage corresponding external surfaces of head 251. Cover 240 may take any suitable shape which has an interior hollow volume that conforms to the razor head's overall configuaration. In other words, for the FIG. 1 embodiment, the cap may have a generally hollow rectangular transverse cross-section, with an open bottom and substantially closed top. For razor heads having a generally semicircular cross-section, like somewhat flattened semicircular transverse cross-section of head 251 of shown in FIG. 12 and 14, with its inwardly curved side surfaces 277 and 278, a cover having corresponding, slightly larger side walls 247 and 248, is appropriate. Such covers may be made of any conventional or suitable material, including transparent ortranslucent plastic, such as suitable density polystyrene or polyethylene. Such a cover may be formed of a molded plastic in a trough-like shape, to fit snugly over the sidewalls of razor head, so as to cover up the razor-sharp edges of the blade strips when the head is not in use. The cover is preferably dimensioned so that it may be manually pushed over the head and will remain in place due to friction and the bending forces generated by placing the cover over the head, which bias the sidewalls of the covert remain depressed against the head until the cover is manually pulled off.

While a cover is not shown with each of the embodiments herein, those skilled in the field should appreciate that a cover like cap 240 can be and preferably is provided with each embodiment. For those embodiments with a razor head having a transverse cross-section that has V-shape, the top surface of the cover should be provided with a complementary V-shaped cross-section. For those embodiments having twin uni-directional razor blade heads, one large cover, or two smaller covers, one for each uni-directional cartridge, may be provided. Round or elongated holes (not shown) may also be provided in the top flat surface of the cover so as to provide for ventilation. In this manner, moisture remaining on a covered razor head, perhaps from the head being rinsed off after shaving, will eventually evaporate. Such holes are preferably sufficiently small in size and/or transversely or diagonally arranged so that a user's thumb or finger will not come in contact with the razor-sharp blade edges, even when pressing on the cover directly over the blade strips.

FIGS. 17 through 20 show a fifth embodiment of the present invention, namely in-line shaving device 300, which has an elongated cartridge-style bi-directional head 301 arranged in line with and detachable from handle 302. Handle 302 includes a proximal insertion or neck portion 303 and elongated hand grip portion 304. As shown, the entire length of handle 302 may have an identical transverse cross-sectional shape if desired. Preferably, the cross-sectional shape of at least neck portion 303 can be any practical shape which can be interlockingly received within a correspondingly-shaped cavity 305 in the rear surface 325 of head 301. This cross-sectional neck and handle shape may be a pentagon, for example, as is shown at distal end surface 306 in FIGS. 17 and 20. Specifically, pentagonal handle 302 has elongated twin upper half surfaces 307 and 308, generally opposed side surfaces 309 and 310, and bottom surface 311.

Figure 17:
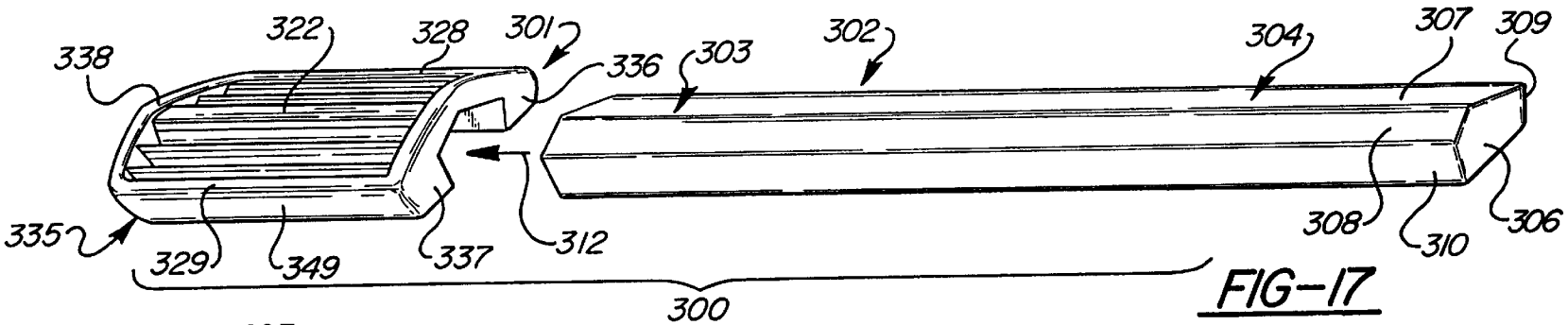
FIGS. 17 through 20 illustrate a fifth embodiment of an in-line bi-directional razor blade device having a replaceable head structure (i.e., cartridge) with two working planes, which head separates from its elongated handle, where.
Figure 18:
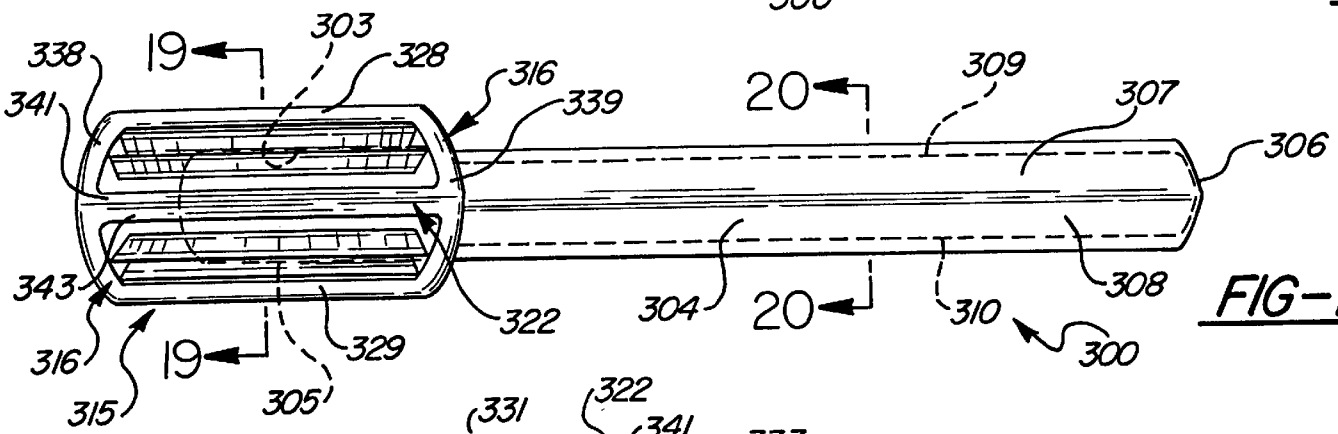
Figure 20:
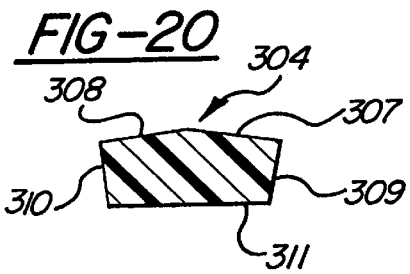
Figure 19:
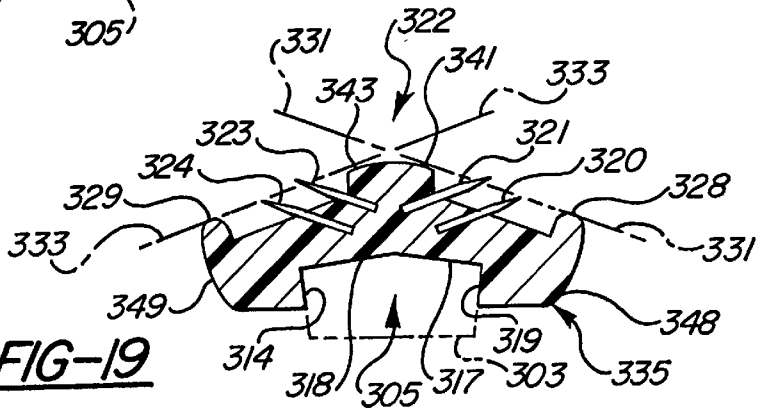

Proximal end 303 of handle 302 is inserted, as indicated by arrow 312 in FIG. 17, into elongated centrally-aligned open cavity 305 in rear surface 325 of base portion 335 of head 301. Proximal end 303 is preferably inserted at least about two-thirds of the way along the length of head 301, as shown in FIG. 18. As shown in FIG. 19 and 20, elongated cavity 305 includes four interior surfaces, including upper surfaces 317, 318 and opposed side surfaces 319, 320. These interior surfaces are complementary to and snugly engage against upper surfaces 307, 308 and side surfaces 309, 310 of handle 302. Generally speaking, a rear connection mechanism for attaching removable bi-directional cartridge 301 to handle 302 is preferred, since it does not interfere with the appearance or utility of the working side or front face 315 of bi-directional cartridge 301.

While one suitable connection mechanism for interconnecting head 301 and the handle been shown, variations are clearly possible. For example, any suitably handle shape which can be removably locked into a complementary connection portion formed in the rear side of base portion 335 can be used, including handles having circular, oval or triangular transverse cross sections, provided that a trough, hole or slot of complementary shape is provided in base portion 335. Those in the art should appreciate that this male-female connection arrangement can be reversed, with the male connection mechanism being provided on base portion 335 of razor head 301, and the female connection portion being provided in proximal neck portion 303 of handle 302. Further, any other detachable mechanical interconnection between head 301 and handle 302 may be used for removably, yet rigidly, interconnecting an elongated handle to a razor head may be used, including conventional mechanical slide mechanism and/or a shaft and socket mechanism with a spring-loaded ball-detent. These comments with regard to detachable connection mechanisms for removably attaching the bi-directional razor head to the handle maybe applied to all of my embodiments of the present invention. In other words, even though a handle and razor head are shown internally formed, those skilled in the art should appreciate that, if desired, the handle and razor head can be made detachable. Similarly, the uni-directional heads or cartridges shown herein in any of the embodiments may be made detachable in several different ways, using various different connection mechanisms, if desired.

As shown in FIG. 19, bi-directional razor head 301 preferably has a bladeedge guarding system 316 including first and second elongated front guards 328 and 329, centrally located elongated rear guard 322, and optional transversely-arranged end guard portions 338 and 339, as best seen in FIGS. 17 and 18. These guard portions preferably each have relatively flat elongated face surfaces, as generally shown, with rounded edges and outside corners. Opposed sets of razor blade strips 320, 321 and 323, 324 are respectively positioned between first and second elongated front guards 328 and 329 on either side of rear guard 322. Guard 322 may be provided with a thin lubricant strip on its surface, as shown in FIGS. 18 and 19. As with razor head 151 in the second embodiment, head 301 has two working planes 331 and 333 which are angled away from one another. In the FIG. 19, the angle of inclination between the two planes shown to be about 40°, but may be any suitable value, as was previously discussed with respect to the second embodiment.

Working plane 331, into which razor sharp edges of blades 320 and 321 project, is defined by front edge guard 328 and a rear guard formed from exposed elongated half-surface 341 of central guard 322. Similarly, working plane 333, into which razor-sharp edges of blades 323 and 324 project, is defined by front edge guard 329 and a rear guard formed from exposed elongated half-surface 343 of central guard 322. It is noteworthy that the razor-sharp edges of rear blades 321 and 323 are shown to project a little bit further through the working plane, more so than the razor-sharp edges of forward razor blade strips 320 and 324. This difference of projection may be any suitable value, and typically will be on the order of 0.0005 inch (12 microns) to about 0.0025 inch (50 microns). In other words, rear razor blade strips 321 and 323 advantageously extend farther into and/or through the working plane so they have greater exposure, in order to produce an enhanced shaving action. Having the rearward blade edge slightly more exposed or elevated relative to the working plane of a twin razor blade set is also taught, for example, in my earlier U.S. Pat. No. 5,522,137 for bi-directional razor blade heads (see FIG. 22 and accompanying text) on T-bar razor handles.

In operation, a user places his or her thumb on surface 311 of handgrip 304 and wraps his or her fingers around opposed surfaces 307 and 308 of handgrip 304. Then, as with the other embodiments, the respective working planes 331 and 333 of bi-directional head 301 are successively moved across the skin to be shaved in first and second opposite directions, just as was described for the second embodiment.

When the razor blade strips of head 301 become dull or spent, the user may replace head 301 by grabbing suitable non-cutting base portion 335 and sliding head 301 off of proximal end 303 of handle 302. To do this, a user firmly holds handgrip 304, and forces head 301 in the direction of arrow 312 by pressing against exterior end surfaces 336 and 337 of, and/or by gripping and tugging on exterior side surfaces 338 and 339 of, base portion 335. Head 301 can then be replaced with another new identical head having fresh razor blade strips.

Figure 21:
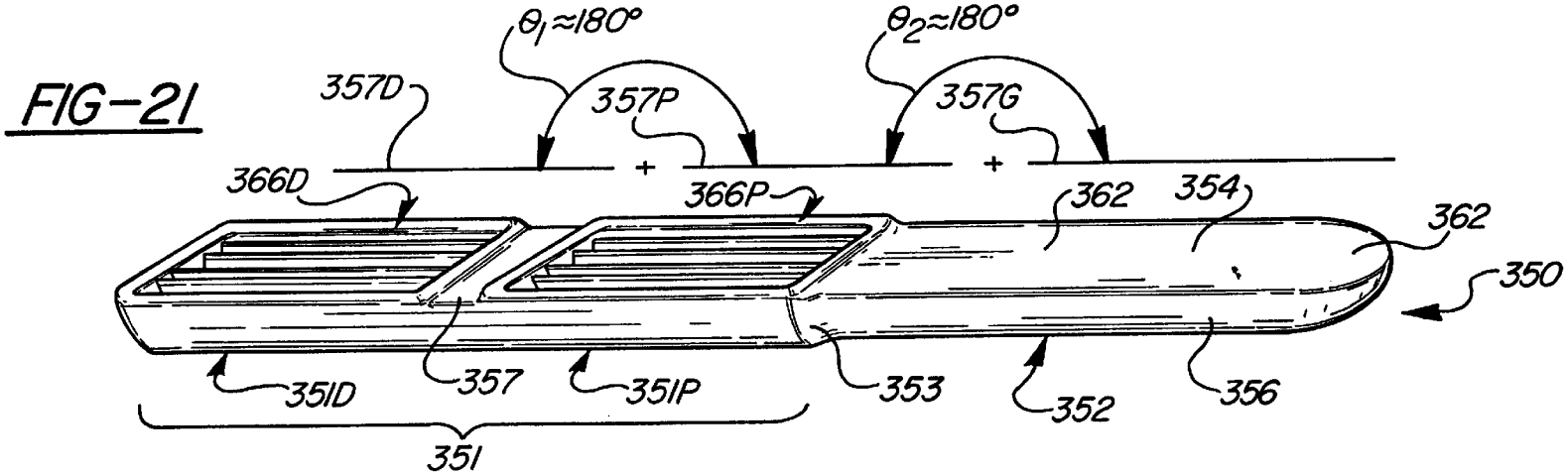
FIGS. 21 and 22 illustrate a sixth embodiment of an in-line bi-directional razor blade device having two complete bi-directional razor blade head portions arranged end-to-end in a common plane, where.
Figure 22:
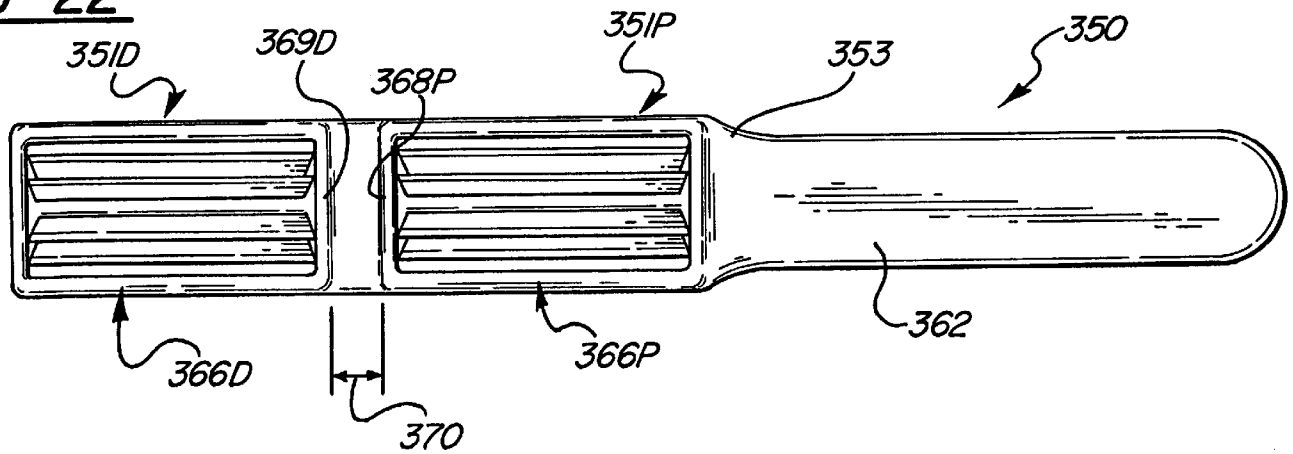

FIGS. 21 and 22 show the sixth embodiment of my invention, namely in-line bi-directional shaving device 350 which includes a razor blade shaving head structure 351 with two complete bi-directional razor blade head portions 351D and 351P arranged end to end, that is in-line with each other, and also in-line with elongated handle 352. (The suffix D stands for "distal" to the near end of handle 352 and user's hand, while the suffix P stands "proximal" to the near end of handle 352 and user's hand.) In terms of construction, the individual elongated razor blade head portions and handle are identical to the fourth embodiment shown in FIGS. 12–16. Briefly, handle 352 includes neck portion 353 and handgrip 354. Handgrip portion 354 includes an upper flat surface 362, rounded distal end 365 and a flattened semicircular surface 356 opposite flat face 362. Head portions 351D and 351P respectively include blade-edge guarding systems 366D and 366P. A plain base portion segment 357 separates the two closest end guard portions 369D and 368P from one another. This portion 357 has a longitudinal dimension 370 shown in FIG. 22, which may be any suitable dimension, for example, from about 0.1 inch (2.5 mm) to about 0.4 inch (10 mm) or more.

Lines 357D and 357P respectively represent the relative orientation of working planes of razor heads 351D and 351P. Line 357G represents the relative orientation of the plane of the top surface 362 of handgrip 354. As shown by angle $\theta_1=180°$, these two working planes are preferably aligned with one another, that is co-planar. Also, as shown by angle $\theta_2\approx180°$, these working planes are also preferably substantially co-planar with the flat face 362 of handle 352.

The benefit of shaving device 350 is that it may be used to effectively shave larger areas of skin more quickly than an in-line bi-directional shaving device, like device 250, having only one bi-directional razor head 251. If desired, handle 354 may be offset rearwardly from the working planes of head portions 366D and 366P, in the same manner that the handles of the FIG. 1 and FIG. 6 embodiments are shown offset from (or alternative described ways in which they may be offset from) their respective bi-directional razor blade heads. For reasons previously explained, it is preferable that the longitudinal axes of head portions 351D and 351P be kept parallel with the longitudinal axis of handle 352.

Figure 23:
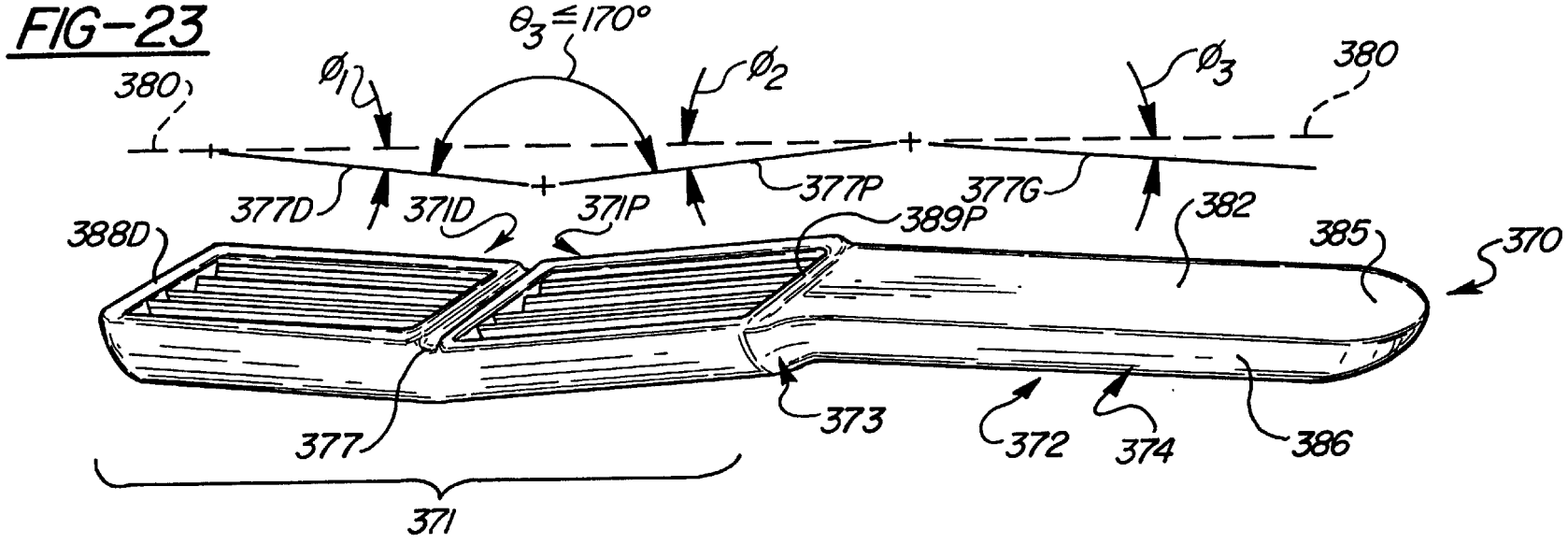
FIGS. 23 and 24 illustrate a seventh embodiment of the present invention similar to the sixth embodiment but with the two bi-directional razor head portions sloped inwardly relative to one another, as shown, where.
Figure 24:
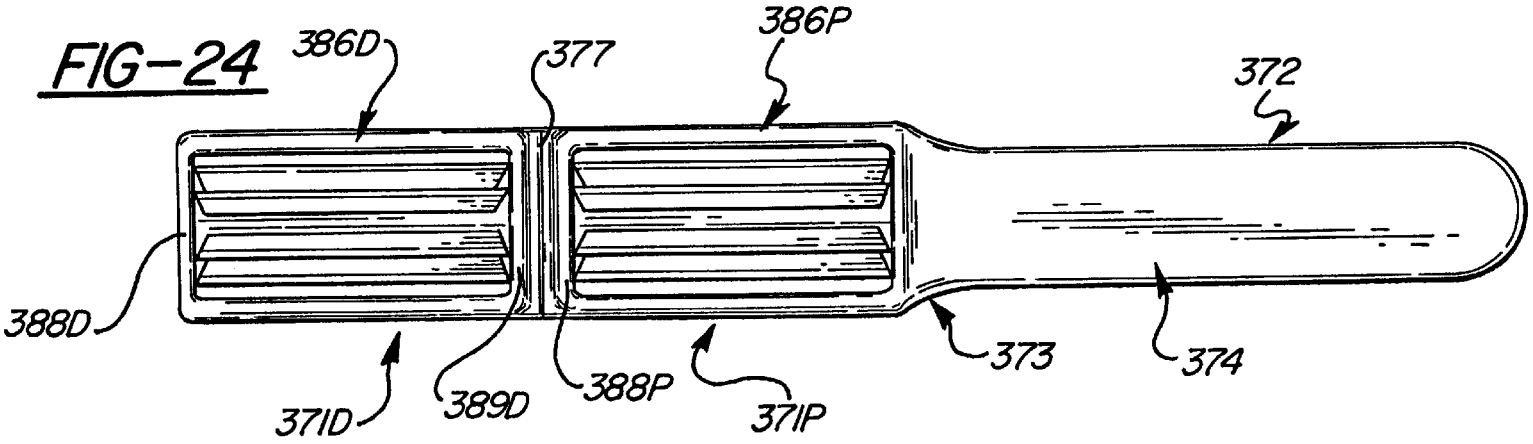

FIGS. 23 and 24 show the seventh embodiment of my invention, namely in-line bi-directional shaving device 370 which includes an extra long head structure 371 with two complete elongated bi-directional razor blade head portions 371D and 371P arranged end-to-end, in-line with each other and with elongated handle 372. In terms of construction, these individual elongated razor blade head portions and handle are identical to the fourth embodiment shown in FIGS. 12–16. Also, the construction of this embodiment is identical to the sixth embodiment, with the exception that individual head portions 371D and 371P slope inwardly toward one another, and handle 372 slopes slightly away, as will now be further explained.

Handle 372 includes neck portion 373 and handgrip 374. Handgrip portion 374 includes an upper flat surface 382, rounded distal end 385 and a flattened semicircular surface 386 opposite flat face 382. Head portions 371D and 371P respectively include rectilinear blade-edge guarding systems 386D and 386P. A plain base portion segment 377 may still separate the two closest end guard portions 389D and 388P from one another, just like plain portion 357 does in FIG. 22.

Lines 377D, 377P and 377G respectively represent the relative orientations of working planes of razor heads 371D and 371P and of planar handle face 372. As shown by angle $\theta_3\leqq170°$, these two working planes are preferably longitudinally tilted inwardly toward one another. Dashed line 380 represents an overall longitudinal plane formed even with the top exposed surfaces of the two outer end guard portions 388D and 389P. This plane 380 is thus parallel to the overall major longitudinal axis (not shown) of device 370. The angle $\phi_1$ and the angle $\phi_2$ further illustrate the angles of inclination of the two razor heads and their respective working planes relative to this overall longitudinal plane. Any suitable value of the angle $\theta_3$ that is desired may be used for this inward inclination. Preferably this angle $\theta_3$ is less than or equal to about 170°, with values for $\theta_3$ of between 100° and 170° being preferred, and with a value for $\theta_3$ between 120° and 165° being most preferred. Also, the magnitude of angle $\phi_1$ and of angle $\phi_2$ are preferably equal, or substantially equal, such as within ten degrees of one another. Further, note that $\phi_1+\phi_2+\theta_3=180°$ since these three angles are all three included angles of a triangle. If desired, handle 372 may be offset, like the handles in the first and second embodiments are relative to their razor blade heads. Or handle 372 may be inclined by tilting it toward the exposed razor blade strips (not shown), or by tilting it away from the longitudinal axis of device 370. This latter condition is shown, and angle $\phi_3$ represents the angle of inclination of the handle face 382 relative to plane 380. Angle $\phi_3$ may be any suitable value, such as about 0° to about 45°. If an inclined handle is to be used, I prefer that angle $\phi_3$ be made equal to angle $\phi_1$ and/or angle $\phi_2$, and that each of these angles be kept equal to about 35° or less.

A benefit of shaving device 370 is that it may be used to more quickly shave areas of skin on curved limbs, such as the arms and legs, than even two-headed in-line shaving device 350. This is because razor blade device 370, when used to stroke up-and-down along a limb, such as an arm or leg, will bear against the skin to be shaved with two different transverse lines of shaving contact on the skin simultaneously. Thus, since two stripes of skin will be shaved simultaneously when shaving with device 370, this device may well be substantially faster man shaving with a single-head in-line bi-directional shaving device of the type shown, for example, in the first three embodiments herein.

I prefer to see the face 382 of handle 372 kept parallel to plane 380, so as to make handle 372 axially in-line with the major longitudinal axis of shaving device 370. I believe this arrangement makes it easiest for a user to have (or to quickly develop) a good sense for those precise areas of the curved skin surfaces to which the razor blades of the two heads 371D and 371P are tangent, thereby allowing the user to more accurately guide and control the simultaneous shaving action of the twin razor heads 371D and 371P.

Figures 25, 26, 27, 28, 29:
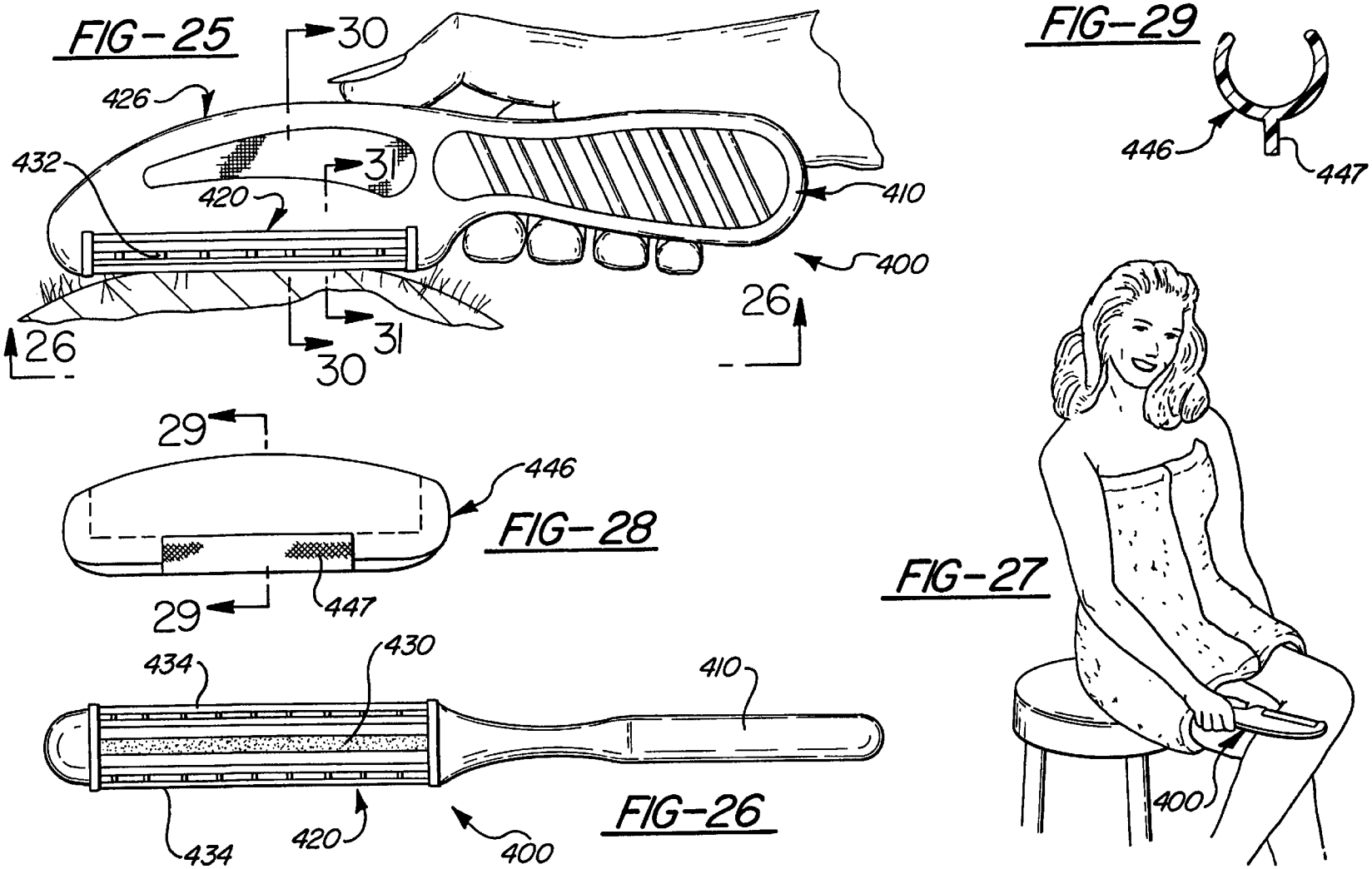
FIGS. 25 through 32 illustrate an eighth embodiment of an in-line bi-directional razor blade device having a bi-directional razor blade structure with two sets of extra-long straight razor blades whose razor-sharp edges are arranged in two distinct working planes defined by outer guard members and a centrally-located rear guard member/lubricant strip, where.

FIGS. 25–32 show the eighth embodiment of my invention, namely in-line razor blade bi-directional shaving device 400. Specifically, FIGS. 25 and 26 show a side view and a bottom view, respectively, of device 400, including handle portion 410, shaving head portion 420 and base support structure 426. Head portion 420 which is preferably constructed as a razor blade head assembly, and may be a removable cartridge or permanently installed. Handle portion 410, portion 420 and base support structure 426 are symmetrically arranged as shown along the common central longitudinal plane 415. Head 420 of device 400 is disposed toward the front of device 400 opposite along the generally convex side of, and is supported by base support structure 426. As can be seen in FIG. 25, handle portion 410 and base support structure 426 are preferably formed as single, continuous piece of material, which may be plastic (as shown by the cross-hatching in FIGS. 30–31), metal, any other suitable material or a combination thereof.

Figure 30:
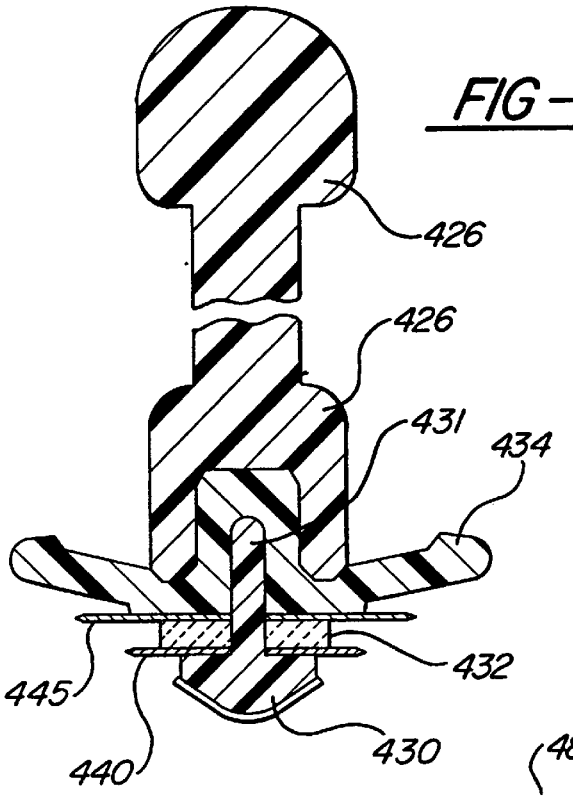
Figure 31:
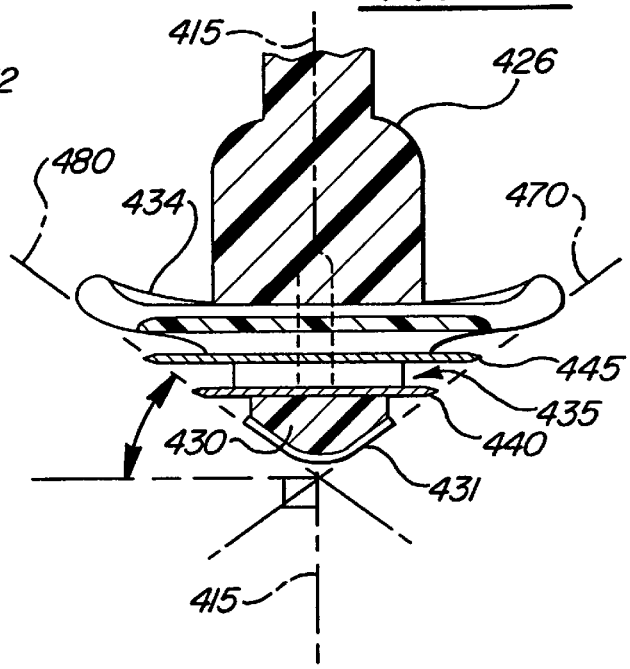

As best shown in FIGS. 25, 26, 30 and 31, in-line device 400 preferably includes bi-directional razor blade structure 420 built upon and including an elongated symmetrical platform 434 and includes two closely spaced razor blade strips 440 and 445 that are arranged to parallel to one another and to the flat surfaces of the walls of the trough in support structure 426 into which platform structure 434 of razor blade head 420 is mounted. As can best be understood by viewing FIGS. 25, 30 and 31, head structure 420 may be made rigid or generally flexible by using flexible component parts. For example, razor blade strip members 440 and 445 are thin and may be made to be flexible at least in the elongated direction. Razor blade head structure 420, both before and after assembly, has a flat geometry in its elongated direction and generally appears to have an overall mushroom-like shape when viewed in cross-section, such as shown in FIG. 30. The bottom of platform 434 is shaped to be complementary to and snugly engageable in elongated mounting trough in support structure 426, as shown in FIGS. 30–31. This technique of using flexible platforms, flexible blade strips and flexible cover members which are conformed to the trough of the mounting structure may be employed with any suitable embodiment herein described. Alternatively, rigid platforms, blade strips and cover members may be used.

As shown best in FIGS. 25, 26, 30 and 31, razor blade shaving head 420 preferably includes: first straight-edge razor blade strip 445, blade spacers 432, second straight-edge razor blade strip 440 and blade cap structure 430, and each are provided, sequentially, upon and above blade support platform 434. As shown in FIGS. 30–31, locking pins 431, which preferably are four to eight in number as desired, operate to secure blade cap structure 430, blade strips 440 and 445 and spacers 432 to blade support platform 434. Locking pins 431 each have an elongated shaft that passes through, and enlarged pin head that is received in, respective spaced complementary recesses 433 within blade cap structure 430. The shafts are snugly engaged in complementary holes located in the central longitudinal plane of platform 434. Thin elongated lubricant strip 431 may be provided on the generally rounded top surface of blade cap structure 430 for lubricating the skin during use of this in-line blade shaving device. As is well known, lubricant strip 431 is typically constructed of a depletable lubricating substance that gradually wears away with use.

Figure 32:
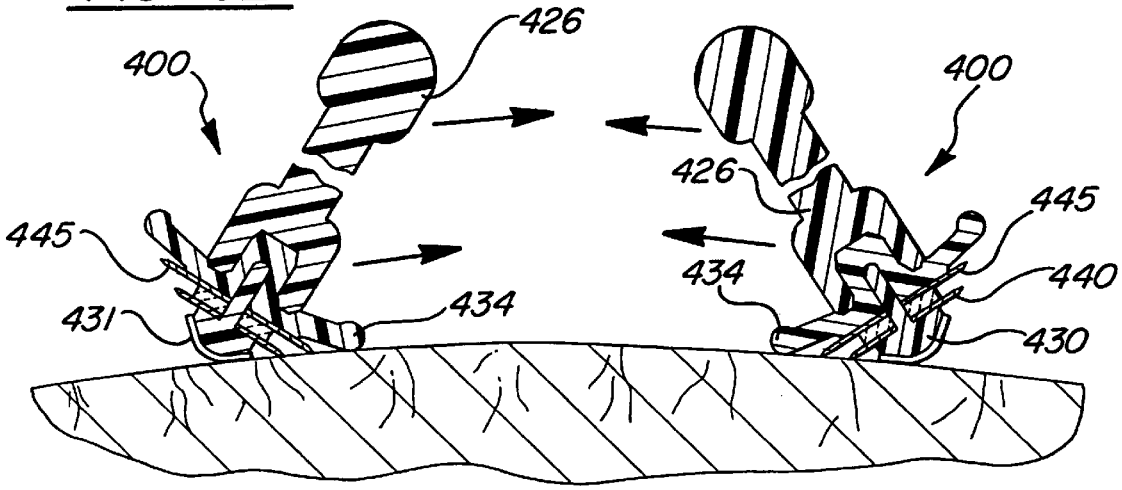

As shown in FIGS. 24, 31 and 32, the straight razor blade edges of razor blade device 400 may be used upon curved skin surface 462 for the cutting or shaving hairs 460 from that surface. Although the razor blade edges of the cutting structure 420 are straight, they nonetheless are advantageous to the shaving of gently curving hairy body surfaces, such as the lower legs shown in FIG. 27, or the thighs, as shown in FIG. 32. In particular, when the skin and underlying tissue of these areas of the body are somewhat pliable, the straight razor edges can shave hair a reasonably wide swath of skin, especially if the skin is slightly deformed by light pressure from the razor head, transmitted through the front and rear guards of the active working plane that bear against the skin being shaved.

As best seen in FIGS. 30–31, in-line razor blade head 420 is preferably constructed with a plurality of razor blade strips 440 and 445, each provided with two opposed razor-sharp cutting edges. Razor blade strip 440 is narrower in width than razor blade strip 445. In this manner, and as best shown in FIGS. 31 and 32, a bi-directional hair-shaving razor device results. Specifically, FIG. 31 illustrates, by its diagonal intersecting dashed lines, that razor blade device 400 is constructed so that its razor head 420 includes two flat working planes 470 and 480 for shaving. These working planes are established and defined by cooperation between the outer rounded edges of the blade support platform 434 and the flattened edge surfaces on either side of the apex of the cap member 430. In other words, one rounded outer edge and one flattened edge surface serve, as best shown in FIG. 31, as the rear and front guards of one side of the safety razor edges, which guards are spaced in close proximity to the razor-sharp blade edges. In practice, these flat working planes may be formed in part as shown using part of the top profile of cap member 430 upon which the lubricant strip 431 sits. Preferably, working planes 470 and 480 are established in a symmetrical fashion about the central plane 415 represented by the dashed vertical centerline shown in FIG. 31.

As also can be readily seen in FIG. 32, razor head 420 has two working planes 470 and 480 which has been designed to shave hairs when either of the working plane 470 or the working plane 480 is moved across a skin surface substantially coincident with and parallel to the skin surface. As shown, the sharpened razor blade edges are angled relative to their respective working planes so as to be able to shave hair projecting from the skin. As shown in FIG. 32, the manual tilting of the in-line razor blade device 400 to an angle to the right suitable for bringing the working plane 470 into contact with the skin, followed by tilting device 400 to an angle in an opposite direction (to the left in FIG. 32) so that working plane 480 comes into contact with the skin, allows the in-line razor blade device 400 to shave bi-directionally, that is, upon sliding movement of the device along the skin in the direction of the tilt of the device. Thus, as shown in FIG. 32, a back-and-forth bi-directional shaving exercise can be accomplished using this device by alternatively tilting the in-line razor blade device 400 in alternate directions and sliding the shaving head portion of device 400 in that direction along the skin surface. FIG. 31 shows the use of the in-line razor blade device 400 upon skin surface 462, such as a human leg.

As can be best seen in FIGS. 30–31, the components of razor blade structure 420 are all constructed in a symmetrical configuration relative to or about the central vertical longitudinal plane 415 of device 400. In other words, lubricant strip 431, pins 431, blade cap structure 430, flexible razor blade strips 440 and 445, blade spacers 432 and blade support platform 434 are all symmetrically arranged about this longitudinal vertical plane. As can best be seen in FIGS. 30 and 31, the components from bottom to top are of increasing width, from the apex region of cap member 430, which is the outermost component, all the way to the innermost interior component, namely, base support member 434 with its outer front guard edges that extend outwardly farthest from the vertical plane. This change in width from the outermost part, that is, the apex region of cap member 430, to the front guard edges of the blade support platform member 434, provides the two flat working planes 470 and 480 in which the sets of straight sharpened razor blade edges are positioned. Further, as best shown in FIG. 31, the flat working planes are substantially equiangularly disposed about the central vertical longitudinal plane of device 400.

Placing a pair of straight sharpened razor blade edges substantially in a straight working plane defined by nearby straight front and rear guards is well-known in the conventional uni-directional T-bar safety razor blade art. Those skilled in the art should appreciate that the present construction shown in FIGS. 25–32 applies such principles to a in-line razor blade device 400 having two sets of front and rear guards that define flat working planes 470 and 480, in which the straight blade edges are situated, all as described above and shown in the Figures, to provide for rapid bi-directional shaving using an in-line device. Those skilled in the art should appreciate that the other embodiments of the body shaving devices of the present invention which are shown in detail in the following Figures and described in detail below make use of the same basic flat working plane architecture and other key features and principles of operation that have just been described in connection with the in-line body shaving device 400 shown in FIGS. 25–32.

FIG. 31 also shows a particular feature of the blade support platform 434, where flow-through spaces or passages 435 are included at regular intervals. As can best be seen in FIG. 31 and FIG. 25, these spaces 435 are formed by the open regions between spacers 432, and are also formed by the flat valleys between the flat mesa-like areas of platform 434 containing the circular openings through which pins 431 pass. These flow-through openings 435 provide a location for hair stubble that is cut during the shaving process to accumulate. Openings 435 also serve as holes through which water may run when cut stubble is being rinsed away, such as occurs when using the well-known technique of holding a razor blade head of a shaving device under running water from a faucet to rinse away the shaving debris from a manual razor.

FIGS. 28 and 29 show a lightweight plastic storage cover 446 having a substantially cylindrical cross-section. Cover 446 includes a substantially flat projecting gripping portion 447 for facilitating placement and removal of cover 446 on razor blade structure 420. Cover 446 may be made of plastic material, which is preferably transparent as indicated by the dotted lines. It should be appreciated that any other well-known material for covers found on manual shaving devices may be used to cover the exposed to razor-sharp edges of razor blades 440 and 445.

Figure 35:
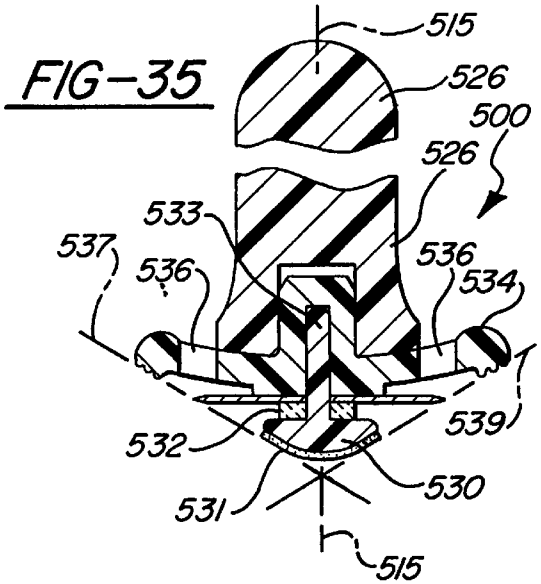
FIGS. 33 through 36 illustrate a ninth embodiment of an in-line bi-directional razor blade device having an elongated handle and a removable cartridge having a single, flat razor blade with two opposed razor sharp edges, where.
Figure 36:
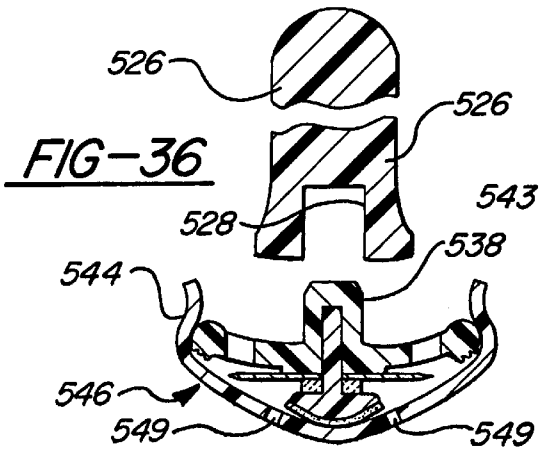
Figure 33:
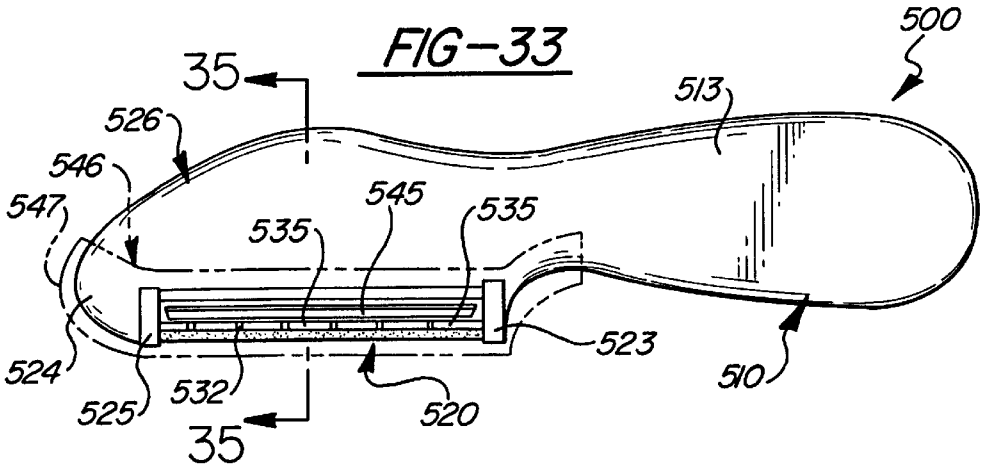
Figure 34:
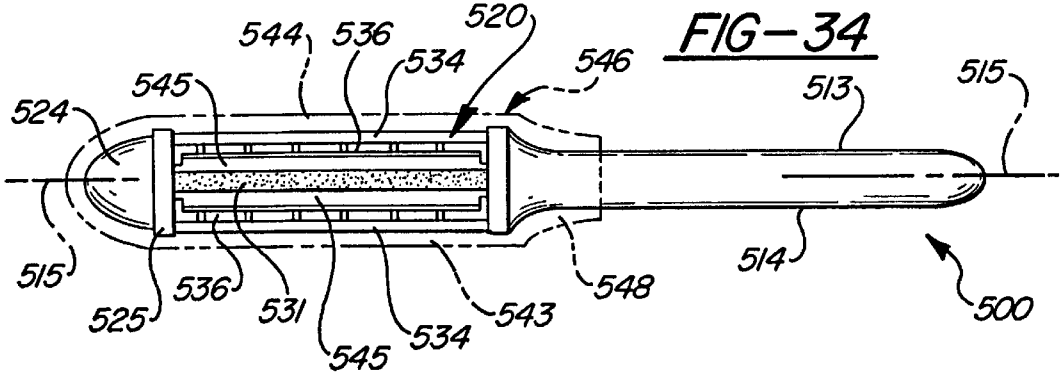

FIGS. 33–36 show the ninth embodiment of my invention, namely in-line razor blade bi-directional shaving device 500. Specifically, FIGS. 33 and 34 show side and bottom views, respectively, of device 500, while FIGS. 35 and 36 show device 500 as generally viewed in cross-section taken along line 35—35 of FIG. 33. Device 500 is constructed much like device 400 in the previous embodiment, except that its razor head is preferably an insertable cartridge having only a single elongated straight razor blade rather than two such razor blades. Device 500 includes substantially rigid handle portion 510, shaving head portion or cartridge 520 and substantially rigid base support structure 526, as shown. Head portion 520 is preferably constructed as a razor blade head assembly, as shown, and may be a removable cartridge or permanently installed, and may be generally rigid or flexible, like head 420. As in device 400, handle portion 510, portion 520 and base support structure 526 of device 500 are preferably symmetrically arranged as shown along common central longitudinal plane 515. Handle portion 510 and base support structure 526 are preferably formed as single, continuous piece of material. Handle 510 is generally elongated in the direction of plane 515, is sized to be comfortably gripped by an average adult woman's hand and may have two generally parallel sides 513 and 514.

In-line razor device 500 preferably includes a bi-directional razor blade structure 520 built upon elongated symmetrical platform 534. Head 520 includes a single blade strip 540 arranged to parallel to the flat top surfaces of the walls of trough 528 in support structure 526 into which platform structure 534 of razor blade head 520 is snugly mounted. Elongated generally rectangular bottom 538 of platform 534 is shaped to be complementary to elongated mounting trough in support structure 546, as shown in FIGS. 35–36.

As shown in FIGS. 33–34, razor blade shaving head 520 preferably includes end caps or guards 523 and 525 which extend slightly further outwardly from plane 515 than does the outer front guard portions of platform 534. Razor head 520 also includes a single elongated double-edged razor blade strip 545, six blade spacers 532, and blade cap structure 530, as shown. As shown in FIG. 35, a plurality of locking pins 531, evenly spaced from one another, engage correspondingly arranged holes in platform 534 to secure cap structure 530, blade strip 545 and spacers 532 to platform 534. Thin elongated lubricant strip 531 is optionally provided upon on generally rounded top surface of blade cap structure 530.

As best seen in FIGS. 35 and 36, the razor-sharp opposed edges of razor blade 545 are respectively positioned in working planes 537 and 539 of razor head 520. Like the working planes of razor head 420, planes 537 and 539 are defined by elongated front and rear guards respectively located on the support platform 534 and cap 530. The angle of inclination from plane 515 to each of the working planes 537 and 539 is preferably in the range of 30° to 80°, with 50° to 75° being more preferred.

Like device 400, device 500 has been designed to shave hairs when either of its working planes 537 or 539 is moved across a skin surface substantially coincident with and parallel to the skin surface. Its sharpened razor blade edge is at an acute angle relative to its respective working plane so as to be able to efficiently shave hair projecting from the skin. The back-and-forth bi-directional shaving exercise generally illustrated in FIG. 32 can also be accomplished with device 500 by tilting device 500 in alternate directions and sliding it along the skin surface.

As can be seen in FIGS. 35–36, the components of razor blade structure 520 are all constructed in a symmetrical configuration relative to and about the central vertical longitudinal plane 515 of device 500. Flow-through spaces or passages 535 are included at regular intervals in razor head 520, and are like passages 435 in head 420. Passages 535 are formed by the open regions between spacers 532, and serve the same purpose as passages 435. Platform 534 is also provided with a two parallel sets of flow-through passages 536, as shown in FIGS. 34–35, to help make it easier to flush shaving debris from razor head 520.

FIGS. 33–34 show in phantom a lightweight elongated plastic storage cover 546 having a flattened bowl-like cross-section, as shown in FIG. 36. Cover 546 fits over razor head 520 when head 520 is not in use and is repeatedly removable and reusable. Cover 546 (and also cover 446) may be provided with a series of small slots or holes 549 to allow water droplets and moisture on razor head 520 to evaporate, while the cover is on the razor head. Cover 546 includes thin elongated semi-flexible or deformable opposed sides 543 and 544 which taper inwardly and outwardly as shown, and may be snugly engaged over the outer portions of platform 534, as best shown in FIG. 36. Further, cover 546 includes substantially semi-spherical bulbous distal end portion 547 which fits over bulbous distal end portion 524 of support structure 526. Cover 546 also includes proximal end portion 548 shaped to fit semi-snugly over end cap portion 523 and portion 513 of handle 510. Like cover 446, cover 546 provides protection against accidental cuts when handling or transporting razor blade device 500 when device 500 is not in use. Covers 446 and 546 may also be made of any other suitable material, besides plastic, such as metal.

Devices 400 and 500 each preferably have an overall length in the range of about 4.7 inches (about 12 cm) to about 8.5 inches (about 22 cm). Razor head 420 and 520 each preferably have an overall length in the range of about 1 inch (about 2.5 cm) to about 3 inches (about 7.5 cm), with a length in the range of about 1.3 inches (about 3.3 cm) to about 2.5 inches (about 6.5 cm) being more preferred. Handles 410 and 510 preferably are about 3 inches (about 7.5 cm) to about 5.5 inches (about 14 cm) long, with lengths of about 4 inches (about 10 cm) to about 5 inches (about 13 cm) being more preferred.

FIGS. 37–39 show the tenth embodiment of my invention, namely in-line razor blade bi-directional shaving device 550. FIG. 37 shows a side elevational view and FIG. 38 shows an end view taken along line 38—38 of FIG. 37. FIG. 39 shows an enlarged fragmentary cross-sectional view taken along line 39—39 of FIG. 37. Device 550 includes handle portion 560, razor head portion 570 and head support portion 576, all arranged as shown. Handle 560 and razor blade support structure 576 are preferably a one-piece, substantially rigid construction, but could be made as separable interlocking pieces if desired. Handle 560 is preferably sized to be easily gripped by the hand of an average-size woman.

Handle portion 560 is generally flat, thin and elongated, and has a generally centrally-located major axis 555, as shown in FIG. 37. Elongated razor blade head 570 has a central-located major axis 557. Axis 555 and axis 557 are shown at substantial angle $\theta_H$ to another. This handle-to-razor head angle $\theta_H$ may be in the range of 10° to about 80°, with the range of 25° to about 65° being more preferred, and the range of 40° to 60° being most preferred.

Handle 560 includes rim 561 which extends around the handle's perimeter up to support portion 576. Rim 561 preferably has a generally rounded cross-section 562, shown in FIG. 38. Rim 561 surrounds a shallow recessed flat textured grip area 563 and a textured grip area 564, which is a mirror image of grip area 563. Grip areas 563 and 564 may have an enhanced gripping surface created by molding or stamping any suitable pattern into the plastic material that forms handle 560 and support structure 576. Further or alternatively, thin layers, strips or pad-like spots of thin gripping layers 567 and 568 may be provided on recessed grip regions 563 and 564 in place of the textured surface, as shown in FIG. 39. Textured layers 567 and 568 may be made from any suitable material including non-skid rubber, foam or polymer sheet material, and may be bonded by epoxy or any other suitable adhesive or any other known attachment technique to surfaces 563 and 564. Rim 561 which rises above surfaces 563 and 564 further assists a user on device 550 maintain a secure grasp on handle 560 at all times.

As shown in FIG. 38, handle portion 560 and razor head portion 570 are symmetrically arranged about a common vertical plane indicated by dashed line 565 in FIG. 38. Similarly, as shown in FIG. 39, the component parts of razor head 570 are symmetrically arranged about this same plane 565. Axes 555 and 567 preferably lie in plane 565.

Bi-directional razor blade head structure 570 is built upon or is mounted to elongated support structure portion 576. Head 570 includes two double-edged flat razor blades 590 and 595 arranged parallel to one another and to the flat top surfaces of the walls of elongated, generally rectangular centrally located trough 578 in support structure 576. Central internal key portion 588 of platform structure 584 of razor blade head 570 is inserted into this trough. Key portion 588 is an elongated generally rectangular solid sized and shaped to be complementary to and snugly mount in trough 578, as shown in FIG. 39.

As shown in FIGS. 37–38, razor blade shaving head 570 preferably includes end caps 573 and 574 which may each include a centrally located, spring-loaded thin metal retaining band or clip to help keep the end caps securely fastened to the remainder of razor head 570, such as the outer end portions of platform 584. Razor head 570 preferably includes elongated double-edged razor blade strips 590 and 595, which are held in place by stacked sets of spaced-apart blade spacers 585 and generally cylindrical blade-supporting mesas 582, and blade cap structure 580, all interlocked together as best shown in FIG. 39 by a plurality of locking pins 583 (like those used in the two previous embodiments), evenly spaced from one another. Pins 583 secure cap structure 580, blade strips 590 and 595 and spacers 585 to blade support platform 584, by fitting tightly into holes provided in mesas 582 and the main part of platform 584. Thin elongated lubricant strip 581 is preferably provided upon on generally rounded top surface of blade cap structure 580. As can be understood from FIGS. 37 and 39, flow-through spaces or passages are included at regular intervals in razor head 570, and are like passages 435 in head 420. These passages are formed by the open regions between spacers 585 and between mesas 582, and serve the same purpose as passages 435. Note that there are two rows of such passages, with a first row above blade 490 and a second row above blade 495.

As shown in FIG. 39, the razor-sharp opposed edges of razor blades 590 and 595 are just barely project into their respective working planes 587 and 589 of razor head 520. Like the working planes of razor heads 420 and 520, working planes 587 and 589 are defined by elongated front and rear guards respectively located on the outer arm portions of support platform 584 and centrally-located cap member 580. Front guard members 577 and 579 are each formed from an elongated block of molded soft pliable foam or polymer material which is inserted into corresponding elongated recesses formed in the outer surfaces of the arm portions of platform 584. Preferably, front guards 577 and 579 are provided with a plurality of elongated parallel resilient wiper portions, each preferably of wedge-shaped cross-section as shown. These wiper portions, sometimes called micro-fins, are spaced from one another and provide a softer comfortable touch to the user's skin. Such micro-fins are conventionally used now on certain Gillette uni-directional razor blade shaving devices, and thus need not be further described here. Rear guard members 577 and 579 are respectively formed of the generally flat, opposed half surfaces 597 and 599 of lubricant strip 581. Thus, working plane 587 is defined by the generally planar surfaces of the micro-fins of guard member 577 and the rear guard member formed from the generally flat half surface 597 of lubricant strip 581. Similarly, working plane 589 is defined by the planar surfaces of the micro-fins of guard member 579 and a rear guard member formed from half surface 599 of lubricant strip 581.

The angle of inclination from plane 565 to each of working planes 587 and 589 are in general preferably in the same ranges as those described or shown in the working planes of the two previous embodiments. These angles may be varied as needed to achieve an optimal shaving angle between each working plane and those razor blade edges of blades 590 and 595 which project into that working plane. As shown in FIG. 39, the two working planes may be oriented in the neighborhood of more than 40° from one another if desired. The angle of inclination for each working plane relative to central plane 565 is preferably the same, as shown in FIG. 39.

Device 550 has been designed to shave hairs when either of its working planes 587 or 589 is moved across a skin surface substantially coincident with and parallel to the skin surface. Like the previous devices 400 and 500, the back-and-forth bi-directional shaving exercise generally illustrated in FIG. 32 can also be accomplished with device 550 by tilting it in alternate directions and sliding it along the skin surface in each direction.

Device 550 preferably has an overall length in the range of about 3.5 inches (about 9 cm) to about 5.5 inches (about 14 cm), with an overall length in the range of about 4 inches (10 cm) to about 5 inches (12.5 cm) being preferred. Razor head 570 preferably have an overall length in the range of about 1 inch (25 mm) to about 2 inches (50 mm), with a length in the range of about 1.2 inch (3 cm) to about 2 inches (5 cm) being preferred. An overall razor head length of about 1.5 inches (about 3.6 cm) is most preferred. The maximum thickness of device 550 as measured across razor head 570 is preferably in the range of about 10.4 inch (10 mm) to about 1 inch (25 mm), with a range of about 0.5 inch (12 mm) to about 0.75 inch (about 18 mm) being preferred. Rim 561 of handle 560 is preferably about 0.3 inch (7 mm) to about 0.8 inch (20 mm) in maximum thickness with a range of about 0.4 inch (10 mm) to about 0.6 inch (16 mm) being most preferred.

Figure 40:
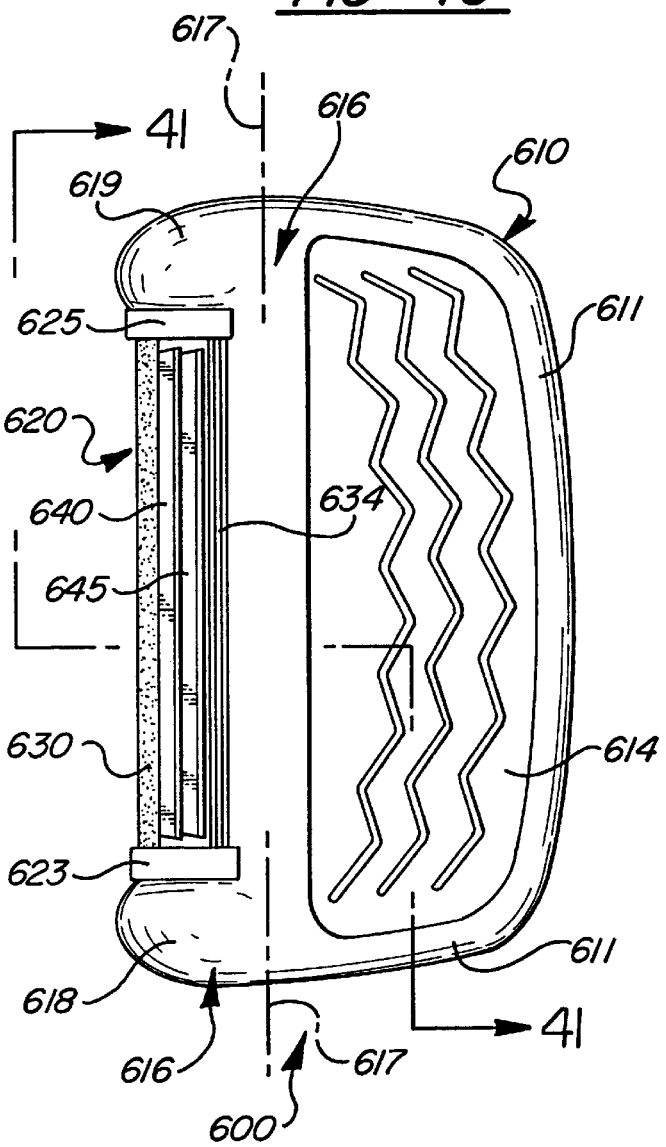
FIGS. 40 and 41 illustrate an eleventh embodiment of a bi-directional razor blade device 600 having an in-line handle and bi-directional head, where.
Figure 41:
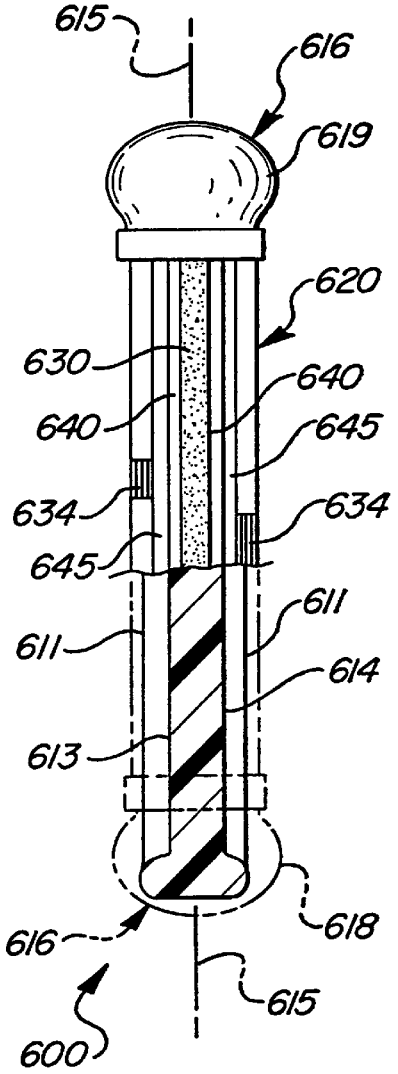

FIGS. 40 and 41 illustrate an eleventh embodiment of an in-line bi-directional razor blade device 600, with FIG. 40 being a side elevational view, and FIG. 41 being a partial cross-sectional view taken along line 41—41 of FIG. 40. Device 600 has a generally thin elongated handle 610 arranged in-line and symmetrically about a common central plane 615 with razor head support section 616 and bi-directional razor blade head 620. In other words, handle 610, support section 616 and razor head 620 are all symmetrically arranged about common plane 615. Razor head 620 has two sets of straight-edge razor blade strips whose respective razor-sharp edges are positioned in one of two distinct working planes arranged at a distinct angle with respect to one another. Each blade strip is generally thin, flat and elongated, with its razor-sharp edge pointing outwardly generally away from the common plane 615. Further, each blade strip within a set is mounted parallel to the other blade strip in the set, and is generally arranged parallel to major axis 617 of blade support structure 616. FIG. 40 shows rim 611 extending around the perimeter of handle 610, thereby encircling finger-grip area 614. FIG. 41 is a partial cross-sectional view taken along line 41—41 of FIG. 40 showing the front appearance of razor head 620 and the relative thickness of the parts of handle 610.

This eleventh embodiment, like the eighth and tenth embodiments, may be constructed with two razor blades 640 and 645 which are have two opposed razor-sharp edges pointed outwardly. As in other embodiments of the invention, the razor-sharp edges project into a working plane established by an elongated front guard and elongated rear guard. Opposed arm portions of razor blade platform 634 each have an external surface provided with a series of elongated ridges which form the front guard for its respective working plane. The rear guards are formed from the sloped generally flat half-faces of cap member 630, which may optionally include a lubricant strip layer as before. Razor head 620 includes end cap portions 623 and 625 which serve to terminate and guard the end corners of razor blade strips 640 and 645. As shown in FIG. 41, handle 610, razor head support structure 616 and bi-directional head 620 are all formed symmetrically about the centrally-located plane represented by line 615. Razor head support structure 616 is preferably provided with bulbous end sections 618 and 619 to help reduce the chance of any sharp corners or edges of razor head 620 accidentally snagging any skin or clothing of a person using device 600 to shave any portion of his or her body.

Device 600 has been designed to shave hairs when either one of its working planes is moved back-and-forth in the bi-directional shaving exercise generally illustrated in FIG. 32, by tilting device 600 in alternate directions and sliding it along the skin surface to be shaved. The angle of inclination from central plane 615 to each of working planes defined by the respective pairs of front and rear guards may be arranged to be in the same ranges as those described or shown in the three previous embodiments, or any of the previous embodiments having two distinct working planes arranged at an angle to one another. If required or desired, double-edged blades 640 and 645 can each be split in half, with the halves separated, and arranged at an angle to one another in a manner like that shown in the second, third or fifth embodiments. In this manner, device can be modified to have working planes that are separated by substantially less of an angle than is shown in FIG. 41.

Device 600 preferably has an overall length in the range of about 2.5 inches (6.5 cm) to about 5 inches (about 12.5 cm), with an overall length in the range of about 3 inches (7.5 cm) to about 4 inches (10 cm) being preferred. Razor head 620 preferably have an overall length in the range of about 1.25 inch (3.2 cm) to about 3.5 inches (about 9 cm), with a length in the range of about 1.2 inches (3 cm) to about 3 inches (7.5 cm) being more preferred. An overall razor head length of about 1.4 inch (3.5 cm) to about 2.5 inches (6.5 cm) is most preferred. The thicknesses for razor head 620 and handle 610 are preferably the same as the dimensions given for the tenth embodiment.

The maximum width of device 600, as measured perpendicularly to axis 617, preferably is in the range of about 1.6 inches (4 cm) to about 3 inches (7.5 cm), with a range of about 2 inches (5 cm) to about 2.75 inches (7 cm) being more preferred. about 2.5 inches (6.5 cm) to about 5 inches (about 12.5 cm), with an overall length in the range of about 3 inches (7.5 cm) to about 4 inches (10 cm) being preferred. Razor head 620 preferably have an overall length in the range of about 1.25 inch (3.2 cm) to about 3.5 inches (about 9 cm), with a length in the range of about 1.2 inches (3 cm) to about 3 inches (7.5 cm) being more preferred. An overall razor head length of about 1.4 inch (3.5 cm) to about 2.5 inches (6.5 cm) is most preferred. The thicknesses for razor head 620 and handle 610 are preferably the same as the dimensions given for the tenth embodiment. The maximum width of device 600, as measured perpendicularly to axis 617, preferably is in the range of about 1.6 inches (4 cm) to about 3 inches (7.5 cm), with a range of about 2 inches (5 cm) to about 2.75 inches (7 cm) being more preferred.

FIGS. 42 through 44 illustrate my twelfth embodiment, namely in-line bi-directional razor blade device 650 having a bi-directional razor head structure or section 651 supported by elongated substantially rigid handle 652 including bifurcated neck portion 649 that supports the two uni-directional razor blade strip half-head portions 658 and 659 of head section 651. FIG. 42 is a plan view of device 650 showing the faces of two uni-directional head halves of the overall bi-directional razor blade head section 651 spaced from one another and rigidly connected to substantially rigid Y-shaped neck 649 of handle 652 at one end only. FIG. 43 is an enlarged cross-sectional view taken along line 43—43 of FIG. 42 showing the opposed blade arrangement and the front and rear guards associated with each blade set, which although arranged in separate heads, are still in a common working plane 680. FIG. 44 is an enlarged cross-sectional view taken along line 44—44 showing the generally rectangular transverse cross-sectional shape of handle 652.

As shown in FIG. 42, generally flat handle 652 has a flat front face 654 and a flat rear face and straight sides 653 and 655 which taper inwardly from the distal end of the handle down to neck portion 649. Device 650 is symmetrically arranged to about a common central plane 685 with two razor head-half portions 658 in 659 of head structure 651 arranged on opposite sides of this plane. Neck half-portion 656 supports first half-head portion 658 from one end thereof. which has rectangular rim 660 surrounding a generally rectangular shallow recess 674 in which blades 670 and 672 are embedded at an acute angle to working plane 680. Rim 660 includes elongated outer surface 662 and inner surface 664 which respectively serve as front and rear guards to this blade set. Distal and proximal end portions 666 and 668 protect and enclose the corners of razor blade strips 670 and 672. The exposed upper surfaces of rim 660 serve to define the working plane 680 for the razor blade edges of blade strip 670 and 672 which project into that working plane. Similarly, second half-head portion 659 includes a generally rectangular rim 661 comprised of front guard 661, rear guard 665 and distal and proximal end portions 667 and 669. These elongated exposed upper surfaces of rim 661 define working plane 680 for razor blade strips 671 and 673 embedded in floor 675 of the rectangular recess of head 659.

Half-portions 656 and 657 may be integrally molded or otherwise formed of the same material with the main part of handle 652 and with main parts of half-head portions 658 and 659, as shown. Alternatively, half-head portions 658 and 659 may be separately constructed as replaceable uni-directional cartridges. If this approach is used, then suitable complementary mating end connection mechanisms are provided on proximal ends of heads 658 and 559 and the respective adjacent ends of half-neck portions 656 and 657 so as to be able to join and interlock the respective head portion and neck portion together, and detach them at will. In this manner, spent or dull cartridges may be replaced with new cartridges.

As shown in FIG. 43, the exposed straight razor-sharp edges of razor blade strips 671 through 674 all lie in a common working plane 680. Thus, bi-directional razor head 651 has two sets of straight-edge generally thin, flat, elongated razor blade strips, with each set having its razor-sharp edges pointing outwardly generally away from the common plane 685. Rear guards 664 and 665 may be given a thin lubricant strip layer as in previous embodiments. Device 650 has been designed to shave hairs when either one of its working planes is moved back-and-forth in alternate directions and sliding it along the skin surface to be shaved in the bi-directional shaving exercise generally illustrated in FIG. 32, without any lifting or tilting of device 650.

Device 650 preferably has an overall length in the range of about 5 inches (12.5 cm) to about 8 inches (about 20 cm), with an overall length in the range of about 6 inches (15 cm) to about 7.5 inches (17.5 cm) being preferred. Razor head 651 preferably has an overall length in the range of about one inch (2.5 cm) to about 3.5 inches (about 9 cm), with a length in the range of about 1.2 inches (3 cm) to about 3 inches (about 7.5 cm) being more preferred. An overall razor head length of about 1.4 inch (3.5 cm) to about 2.5 inches (6.5 cm) is most preferred. The maximum width of device 650, as measured perpendicularly to plane 685, preferably is in the range of about 1 inch (2.5 cm) to about 2 inches (5 cm), with a range of about 1.25 inches (3.2 cm) to about 1.75 inches (4.5 cm) being more preferred. Razor head 651 and handle 652 are preferably kept relatively thin as shown in order to save on material, and make device 650 lighter.

FIGS. 45 through 46 illustrate my thirteenth embodiment, namely in-line bi-directional razor blade device 700. Device 700 is shown in FIG. 45 from a side perspective view and, in FIG. 46, from an end view in partial cross-section taken along line 46—46 of FIG. 45. Device 700 is like device 650, in that it has a bi-directional head structure 701 having an elongated handle 702 including a neck portion 703 which is bifurcated and connected to two separate uni-directional razor heads that comprise head structure 701. Head 701 is comprised of a pair of uni-directional razor blade heads 708 and 709, each containing a pair of outwardly-pointing razor blade strips. Like device 650, device 700 is symmetrically arranged to about a common central plane 735 that bisects handle 702, so that the two razor head-half portions 708 and 709 of head structure 701 are arranged on opposite sides of this plane. Device 700 differs from device 650 in that its neck 703 is comprised of flat portion 704 and two rectangular blocks 706 and 707 extending upwardly from the flat planar surface 705 of handle 702. Head portions 708 and 709 are each rigidly connected to common neck portion 703 through these blocks and may be detached as desired. Blocks 706 and 707 are parallel to and spaced from another, preferably by a short distance in the range of about 2 mm to 8 mm, as shown in FIG. 46. The height of blocks 706 and 707, between their respective heads and flat neck portion 704 is preferably the same, as shown in FIG. 46. This height preferably is in the range of 2 mm to 25 mm with heights of 8 mm to 15 mm being most preferred.

Blocks 706 and 707 may be placed adjacent to one another or may be integrally formed as a common block if desired. Neck 703 formed by flat neck portion 704 and blocks 706, and 707 as shown constitutes a generally U-shaped yoke which is connected to one end of the handle, and which supports the two uni-directional heads.

In FIG. 46, blocks 706 and 707 are shown include generally rectangular central troughs 736 and 737. These are shown open on one end, but could be open on both opposite ends if desired. Correspondingly-shaped rearwardly extending posts 738 and 739 of half-head portions 708 and 709 are insertably positioned within these troughs as shown in FIG. 46. The top surfaces of blocks 706 and 707 are flat and lie in a single plane indicated by line 728. The corresponding areas of the bottom spaces of heads 709 and 710 are also flat. Thus, posts 738 and 739 are pushed inwardly until these two sets of flat surfaces are in contact with one another as shown. This ensures that the faces of heads 708 and 709 are parallel to another so that their respective working planes will be parallel to one another and will lie along common plane 730 as shown.

As shown in FIGS. 45 and 46, uni-directional half-head portions 708 and 709 each include a pair of blade strips encircled by a generally rectangular perimeter rim. For example, blade strips 720 and 722 are partially embedded in half-head portion 708 within generally rectangular recess 725 within rim 710. Rim 710 includes elongated outer surface 712 and inner surface 714 which respectively serve as front and rear guards to this set of blade strips 720 and 722. Distal and proximal end portions 716 and 718 of rim 710 protect and enclose the corners of razor blade strips 720 and 722. The exposed upper surfaces of rim 710 serve to define the working plane for the razor blade edges of blade strip 720 and 722, and the blade edge are positioned to just barely project into that working plane.

Similarly, blade strips 721 and 723 are partially embedded in half-head 709 within generally rectangular recess 724 within its rim 711. Blade strips 721 and 723 are arranged parallel to one another, just like blade strips 720 and 722 are arranged parallel to one another. These two sets of blade strips are at an obtuse angle $\theta_{OA}$ relative to one another, and respectively point generally outwardly away from one another, as shown. Further, the blade strips are preferably set at the same acute blade angle $\theta_{AB}$ relative to common working plane 730.

Head portions 708 and 709 are preferably constructed to be fully symmetrical about central transverse plane 726, which bisects these head portions and is parallel to working plane 730. One advantage of such a symmetrical construction is that the uni-directional cartridge heads 708 and 709 may then be identical to one another, and can be interchanged, thus reducing manufacturing costs, since only style of uni-directional head need be made, rather than two.

FIG. 47 shows, in partial fragmentary cross-sectional form, a bi-directional in-line device 740, which has the same handle as the device 700 in FIG. 45, but has a different bi-directional head structure 741, by virtue of the use of a different neck portion 743. As noted in FIG. 47, bi-directional razor head 741 uses the same uni-directional cartridges as shown in FIGS. 45 and 46 as indicated by reference numerals 708 and 709. Neck 733 includes a common extender block 745 on top of flat neck portion 704, which takes the place of blocks 706 and 707. Block 705, includes the two troughs 736 and 737 which receive posts 738 and 739 protruding from the bottom of cartridges 708 and 709. Basically, device 740 serves to illustrate that the two elongated uni-directional razor head cartridges 708 and 709 may be arranged with their major axes generally parallel to one another, but with their faces tilted at an angle $\theta_T$ away from one another, thus forming an in-line bi-directional shaving device having two working planes 731 and 732, similar to the fifth embodiment shown in FIGS. 17 through 20. Working planes 731 and 732 are thus tilted away from one another at angle $\theta_T$ that the blade planes of razor blade strips 722 and 723 are separated by an obtuse angle $\theta_{PS}$.

Device 700 preferably has an overall length in the range of about 3.5 inches (9 cm) to about 7 inches (about 17.5 cm), with an overall length in the range of about 4.5 inches (12.5 cm) to about 6.0 inches (15 cm) being preferred. In other words, because of the rear connection, the overall length of razor blade device 700 and device 740 may be somewhat smaller than device 650, if desired. The overall lengths of bi-directional razor heads 701 and 740 are preferably the same as those given above for razor head 651. Another advantage of the tilted head the construction of device 740 is that the maximum width of its bi-directional razor head 741, as measured perpendicularly to plane 735, will be slightly less than the width of the otherwise same bi-directional head arranged in the same plane, like in FIG. 45. As with device 650, the rear guards may be provided with a thin lubricant strip layer, if desired.

Devices 700 and 740 have both been designed to shave hairs when either one of its working planes is moved back-and-forth in alternate directions and sliding it along the skin surface to be shaved in the bi-directional shaving exercise generally illustrated in FIG. 32. With device 700, there is no need for any lifting or tilting of the device between strokes in opposite directions. With device 740, lifting the device from the skin is not required, but a slight twist of the wrist substantially equal to the angle $\theta_T$ must be made at the end of each shaving stroke in order to place the other working plane into contact with the skin for the stroke in the opposite direction, as previously described with regard to other two-plane bi-directional in-line shaving devices disclosed herein.

Figure 48:
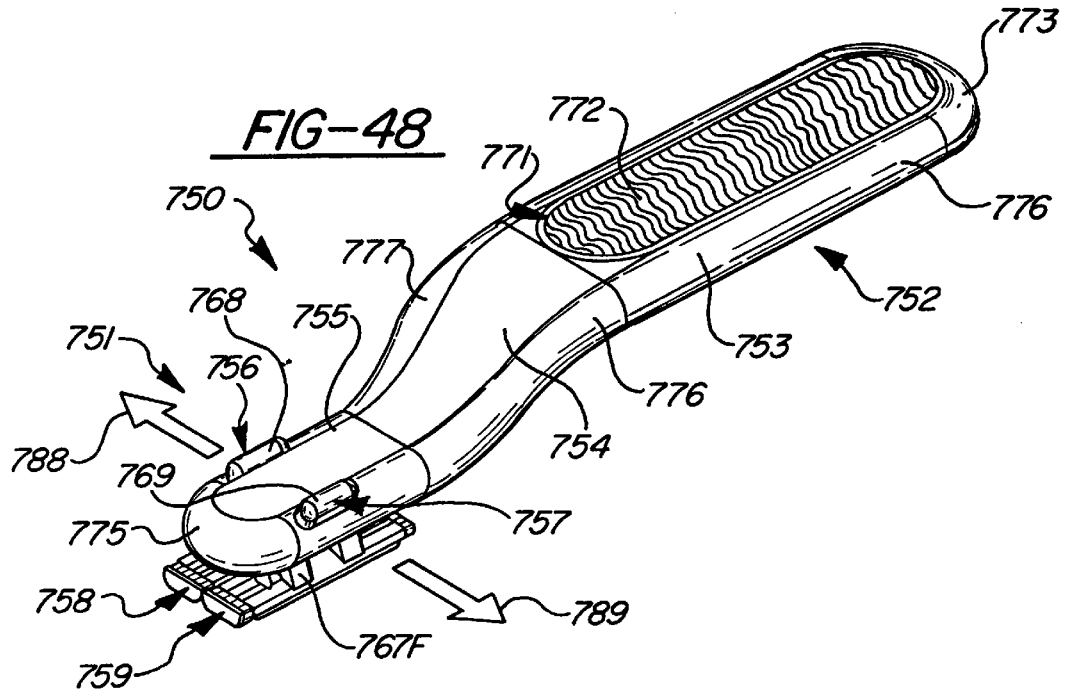
FIGS. 48 through 51 illustrate a fourteenth embodiment of an in-line bi-directional razor blade device having a pair of removable uni-directional razor blade cartridges, each having a pair of spring-loaded razor blade strips pointed outwardly away from the central vertical plane of the elongated handle as viewed in FIG. 48, where.
Figure 49:
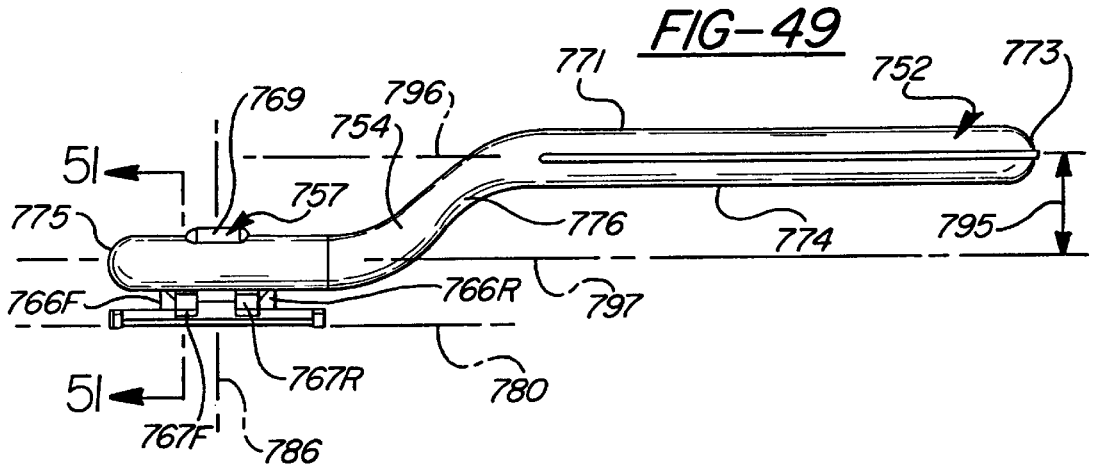
Figure 50:
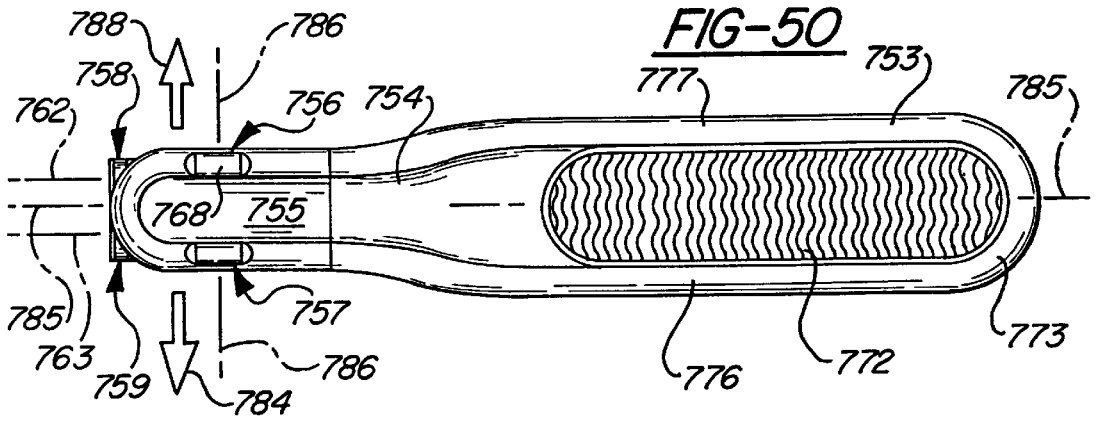
Figure 51:
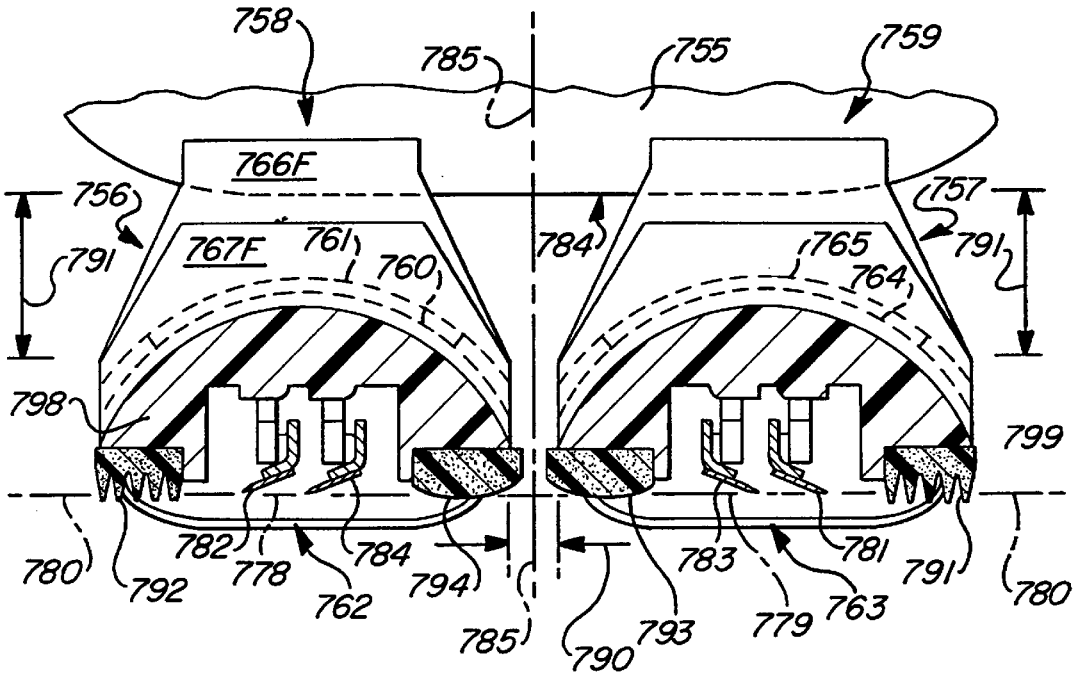

FIGS. 48 through 51 illustrate my fourteenth embodiment, namely in-line bi-directional razor blade device 750 which has bi-directional head 751 and stylish elongated handle 752. Head 751 is comprised of a pair of removable replaceable uni-directional razor blade cartridges 758 and 759. Each cartridge has a pair of razor blade strips whose razor-sharp edges point outwardly, generally away from the other cartridge, as best shown in FIG. 51. FIG. 48 is a front end perspective view of device 750, and FIGS. 49 and 50 are top and side views. FIG. 51 is an enlarged fragmentary cross-sectional view taken along line 51—51 of FIG. 49 which shows one possible construction for the uni-directional razor blade cartridges. As noted below, cartridges 758 and 759 are preferably identical in construction, and the remainder of device 750 is fully symmetrical about its elongated vertical plane 785, making whatever is found one side of device 750, such as a cartridge or pivoting cartridge mechanism, also be found, in mirror image, on the other side of plane 785.

Handle 752 includes three interconnected sections: generally flat elongated main hand-grip section 753, generally curved transition section 754, and generally flat head-end or neck section 755. Sections 753–755 may be made of molded plastic and/or stamped metal, and may be solid or hollow, and may be molded as one-piece or may be assembled from separate pieces. Neck section 755 may be considered part of the supporting structure for bi-directional head 751, as well as part of handle 752. Transition section 754 serves to place cartridges 758 and 759 substantially below handle section 752.

As best seen in FIGS. 48 and 50, generally flat surface 771 of section 753 of handle 752 may be provided with a thin textured insert 772 to improve a user's grip upon the handle. Insert 772 is preferably made of a non-skid soft pliable rubber or polymer material and may have a generally oval appearance as shown. An identical insert (not shown) may be provided on the opposite flat surface 774 of section 753.

Sections 753 and 755 may be provided with gently rounded semi-cylindrical end portions 773 and 775 respectively, as shown, to improve the appearance of the overall handle. For similar reasons, the various side portions 776 and 777 of section 753, 754 and 755 may have correspondingly rounded edges as shown. The surfaces of handle 752 may be provided with alternate grip-enhancing surface textures or inserts, if desired.

As shown in FIG. 51, uni-directional razor blade heads 758 and 759 each contain a pair of outwardly-pointing razor blade strips. Device 750 is symmetrically arranged about common central plane 785 that vertically bisects handle 752, whose portions are preferably symmetrically arranged about this plane as shown. Razor head-half portions 758 and 759 of head structure 751 are also arranged symmetrically about, generally parallel to, and on opposite sides of this plane. Device 750 differs from devices 650 and 700 in that its neck section 755 is comprised of a lower flat portion 784 (see FIG. 51) from which projects the pivotal razor-head connection mechanisms 756 and 757 that extend outwardly from surface 784. Mechanisms 756 and 757 preferably permit uni-directional razor blade heads to respectively pivot about individual axes 762 and 763 that are spaced from and substantially are parallel to central plane 785, as best illustrated in FIGS. 50 and 51. Uni-directional head portions 758 and 759 are thus free to pivot in response to undulations or curves in the skin being shaved, as head-end section 755 and device 750 moves over the body surface to be shaved in first and second opposite directions indicated by arrows 788 and 789 in FIGS. 48 and 50.

The individually-operated cartridge connection mechanisms 756 and 757 are preferably identical and serve to retain and to selectively release uni-directional cartridges 758 and 759 respectively, in order to replace spent cartridges. When pushed downwardly, buttons 768 and 769 of mechanisms 756 and 757 operate to retract outer movable members mounted on section 755, like members 766F and 766R shown in FIG. 49 that are associated with button mechanism 757, away from the corresponding stationary cartridge-mounted members 767F and 767R. Members 766F, 766R, 767F and 767R, which may be molded in plastic, are preferably formed as complementary interlocking parts of shell bearing connections that enable that cartridge 759 to pivot along axis. Preferably conventional return-to-center springs (not shown) are provided for biasing each of the cartridges back to its respective nominal at-rest position shown in FIG. 48 and 51.

FIG. 51 shows, by arcuate dashed lines 760 and 761 concentrically arranged about a pivot axis indicated by point 762, the location of the inner and outer bearing surfaces for the shell bearing connection mechanism used with cartridge 758. Arcuate dashed lines 764 and 765 concentrically arranged about a pivot axis indicated by point 763, show the location of the inner and outer bearing surfaces for the shell bearing connection mechanism used with cartridge 759. These pivot axes are preferably located below nominal working plane 780 associated with cartridges 758 and 759. FIG. 51 shows an enlarged cross-sectional view of the two uni-directional razor blade cartridges 758 and 759. These cartridges may be generally constructed, if desired, in the manner of conventional Gillette Sensor® razor blade cartridges, as disclosed for example in U.S. Pat. No. 4,6212,424 or U.S. Pat. No. 5,661,907, the disclosures of which are hereby incorporated by reference. Such conventional uni-directional cartridges are also equipped with cartridge heads which pivot about a nominal at-rest position relative to their T-bar handle, through the use of conventional shell-bearing connections between the platform of the razor blade head and the complementary grooved shell bearing connection members found on the end of the reusable razor blade handle nearest the uni-directional cartridge. Such shell bearing connections are well-known from their long use in Gillette Sensor cartridge razor blade products. Exemplary constructions of same are disclosed, for example, in U.S. Pat. Nos. 4,756,082 and 5,661,907, which are both hereby incorporated herein by reference.

Connection mechanisms 756 and 757 are parallel to and spaced from another, preferably so that there is a short distance 790, preferably in the range of about 1 mm to 5 mm, separating the two uni-directional cartridges 756 and 757, as shown in FIG. 51. This separation distance 790 is preferably large enough to prevent either cartridge under normal use from pivoting into and colliding with the other cartridge. The height 791 of members 756 and 757, between their respective heads and flat surface 784 of neck portion 755 is preferably the same, as shown in FIG. 51. This height preferably is in the range of 3 mm to 8 mm with a height in the range of 4 mm to 6 mm being more preferred. Note that the neck formed by flat neck portion 755 and the block-like elements or members 756 and 757 as shown may be deemed to constitute a generally U-shaped yoke which is centrally connected to the proximal end section of the handle which supports the two uni-directional heads of device 750.

An in-expensive throw-away version of bi-directional head 751 and handle 752 may be made if desired, by using a simpler handle having a similar overall shape, or a straight shape. Also, connection mechanisms 756 and 757 may be integrally formed in a common block if desired. Further, the cartridges 758 and 759 may be permanently fixed in place, rather than being allowed to pivot while being used, if desired.

As best understood from FIGS. 48, 49 and 51, uni-directional half-head portions 758 and 759 each include a pair of spaced-apart, elongated generally parallel metal alloy blade strips mounted on elongated angled metal blade support plates. These angled metal plates, and hence the blade strips, may be spring-loaded for movement substantially perpendicular to the skin to be shaved, if desired, in the manner shown and described in conjunction with FIGS. 48 through 54 in my U.S. Pat. No. 5,522,137, which is hereby incorporated herein by reference. For example, in FIG. 51 blade strips 782 and 784 are shown to be spring-loaded to platform 786 of cartridge 758, and blade strips 781 and 783 are shown to be spring-loaded to platform 787 of cartridge 759.

In cartridge 758, elongated pliable finned member 792 and pliable elastomer member 794 respectively serve as front and rear guards for the razor-sharp edges of blade strips 782 and 784. Together front and rear guards 792 and 794 define working plane 778, into which the razor blade edges of blade strips 782 and 784, just barely project. In cartridge 759, elongated pliable finned member 791 and inner pliable elastomer member 793 respectively serve as front and rear guards for the razor-sharp edges of blade strips 781 and 783. Guard members 791 and 793 establish the working plane 779 of cartridge 759. Exposed surfaces of rear guard members 793 and 794 are gently rounded as shown to make it easier for these members to readily travel over undulations or curves in the user's skin without tending to bite into, snag or bunch up the skin. As in device 650, rear guards 791 and 793 may be provided with a thin lubricant strip layer, if desired. As shown in FIG. 51, the two sets of razor blade strips shown in FIG. 51 are nominally positioned in the same plane 780. In other words, the working planes 778 and 779 of cartridge heads 758 and 759, when the cartridges are in their "at-rest" positions, are also aligned with plane 780.

As shown in FIGS. 49 and 57, distal and proximal end portions 786F and 786R of platform structure 788 protect and enclose the corners of razor blade strips 782 and 784. These end portions preferably extend lower than the adjacent working plane, and thus help ensure that the razor-sharp edges do not inadvertently start to dig into the user's skin during use of device 750. Like the uni-directional cartridges of the previous embodiments, uni-directional razor heads 758 and 759 and their connection mechanisms are preferably constructed to be fully symmetrical about a central transverse plane 786, best shown in FIG. 50, which bisects these head portions and is parallel to working plane. This yields those advantages previously noted in the previous embodiment, including that uni-directional cartridge heads 758 and 759 may be made identical to one another, and are interchangeable.

Figure 52:
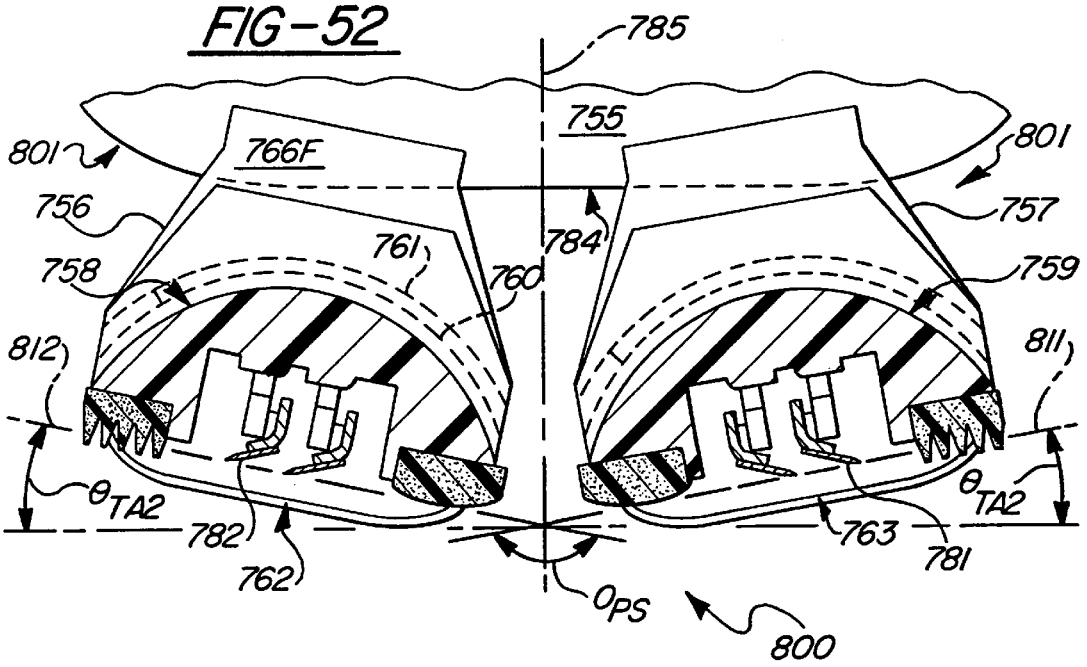
FIG. 52 illustrates a fifteenth embodiment, which shows that the two uni-directional razor blade cartridges of the embodiment of FIGS. 48–51 can be arranged to be nominally at rest with their respective working planes of each cartridge been arranged at an angle to one another, by tilting the shell bearing supports in the handle.

FIG. 52 shows my fifteenth embodiment, in partial fragmentary cross-sectional form, which bi-directional in-line device 800. This device has the same handle 752 as device 750 in FIGS. 48–51, but has a slightly different bi-directional head structure 801, by virtue of the tilting of each of the attached cartridges outwardly at an angle. As can be seen in FIG. 52, bi-directional razor head 801 uses the same uni-directional cartridges 758 and 759 as shown in FIGS. 48–51, with the difference being that the connection mechanism members are respectively installed at a slight outwardly tilted angles $\theta_{TA1}$ and $\theta_{TA2}$ as shown, relative to plane 780 which parallel lower surface 784 of head-end section 755, like the thirteenth embodiment. Preferably angle $\theta_{TA1}$ equals $\theta_{TA2}$. Thus, when cartridges 758 and 759 are at rest, their working planes are at an angle to one another. Basically, device 800 serves to illustrate that the two elongated uni-directional razor head cartridges 758 and 759 may be arranged with their major axes generally parallel to one another, but with their faces tilted at an angle twice $\theta_{TA1}$ away from one another, thus forming an in-line bi-directional shaving device having two working planes 811 and 812. Working planes 811 and 812 are thus tilted away from one another at angle $\theta_T$ so that the blade planes of opposed razor blade strips 781 and 782 of cartridges 758 and 759 are separated by an obtuse angle $\theta_{PS}$.

Devices 750 preferably has an overall length in the range of about 4 inches (10 cm) to about 8 inches (about 20 cm), with an overall length in the range of about 5 inches (about 12.5 cm) to about 7 inches (about 17.5 cm) being preferred. The overall length of hand-grip section 753 preferably is in the range of 3 inches (about 7.5 cm) to about 5.5 inches (about 14 cm), with a range of the 3.5 inches (about 9 cm) to 4.7 inches (about 12 cm) being more preferred. As best seen in FIG. 49, the total offset distance 795 by having transition region 754, as measured from major central axis 796 of section 753 to major central axis 797 of section 755, is preferably in the range of 0.4 inches (about 1 cm) to about 2 inches (about 5 cm), with a range of 0.6 inches (about 1.5 cm) to about 1.2 inches (about 3 cm) being more preferred.

The overall length of head-end section 755 and bi-directional razor head 751 is preferably the same as that given above for razor head 651. Conventional uni-directional cartridges having an overall length of about 1.5 inches (about 3.8 cm) are among the most preferred in terms of length for use in device 750. The overall width across both cartridges on head 751, which is noted as distance 799 in FIG. 51, preferably is in the range of 1.5 cm to about 3 cm, with the range of 1.8 cm to about 2.5 cm being more preferred. The preferred height of each uni-directional cartridge is about 0.4 cm to about 0.8 cm.

One advantage of the pivoting head mounting of uni-directional cartridges is that the heads can more closely track undulations in the skin over which the razor cartridge doing the shaving (sometimes called the active cartridge) is being moved. In one sense, the trailing head simply goes along for the ride, since its blades are pointed away from the skin, and only the leading or active cartridge cuts hair. Nonetheless, that trailing cartridge, due to its pivotal mounting, also tracks the skin closely over any undulations or gentle curves that are present in the skin. Thus, the working plane of each of the cartridges, whether shaving or not, follows the undulations and profile of the skin closely. Further, a user will find it natural to place more weight or pressure on the trailing cartridge during the stroke than on the active or leading cartridge. Among other advantages, this method of use allows the user to land the rear or trailing cartridge on the skin as part of a forward stroke, and almost immediately thereafter, very slightly rotate the handle 752 so that the active cartridge touches the skin, but only lightly. In this manner, the user will, with confidence, be able to rapidly back and forth, and almost effortlessly glide the twin cartridges along the skin in a rapid shaving action as he or she does so, if pressing the active razor with unnecessary force into the skin to be shaved.

Devices 750 and 800 have both been designed to shave hairs when either one of its working planes is moved back-and-forth in alternate directions, that is sliding it along the skin surface to be shaved in the bi-directional shaving exercise generally illustrated in FIG. 32. With device 750, there is no need for any lifting or tilting of the device between strokes in opposite directions. With device 800, lifting the device from the skin is not required, but a slight twist of the wrist substantially equal to the angle $\theta_T$ may be made at the end of each shaving stroke if desired. in order to help place the other working plane into contact with the skin for the stroke in the opposite direction, as previously described with regard to other two-plane bi-directional in-line shaving devices disclosed herein. However, since cartridges 758 and 759 will pivot, it is possible, when angles $\theta_{TA1}$ and $\theta_{TA2}$ are sufficiently small, such as under 20°, to simply slide head 801 along the skin to be shaved without lifting or rotating the head between strokes in opposite directions.

FIGS. 53 through 56 illustrate a sixteenth embodiment of the present invention, namely in-line bi-directional razor blade device 850 having a distributed head structure 851 and an elongated stylish handle 852. Handle 852 includes a generally straight handgrip section 853, a transition section 854 and a bifurcated neck section 855, all connected as shown. Head structure 851 includes pair of identical replaceable uni-directional razor blade heads, namely cartridge structures 858 and 859 attached thereto through a generally U-shaped yoke 856, which is both part of bifurcated neck section 855 and may also be considered part of head structure 851. Neck section 855 has a descending central yoke portion 864 connected to two diverging yoke half-portions 862 and 863 symmetrically arranged on either side of vertical central plane 860 which bisects head 851 and handle 852. Yoke portions 862 and 863 are preferably integrally formed with descending central yoke section 864, but may be formed as separate interlocking pieces if desired. Handle 852 including neck section 855 may be constructed of plastic, metal or any other suitable material, and maybe hollow or solid, or integrally-molded as one piece or made as separately molded pieces that are snapped or otherwise interlocked together. The overall size of device 850 and its razor blade cartridges are preferably within the ranges of overall size is given for the last four previous embodiments. Preferably the overall length of each of the uni-directional razor blade cartridges is about 1.5 inches (about 3.8 cm).

Figure 53:
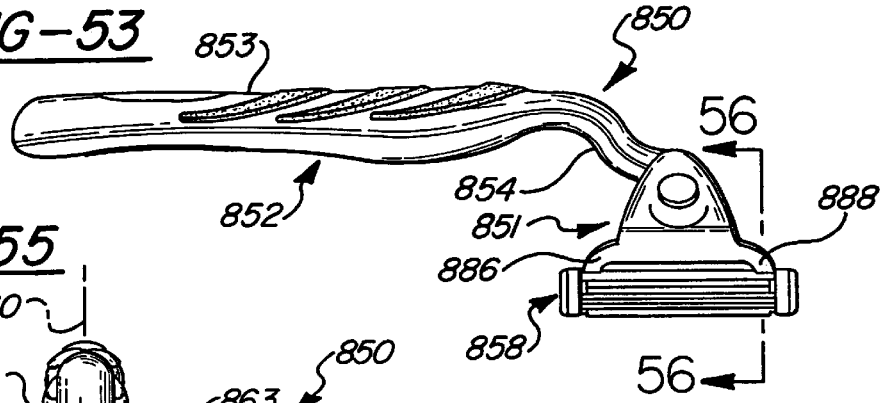
FIGS. 53 through 56 illustrate a sixteenth embodiment of an in-line bi-directional razor blade device having an elongated handle and a pair of replaceable uni-directional razor blade head cartridge structures attached thereto through a generally C-shaped yoke, where.
Figure 55:
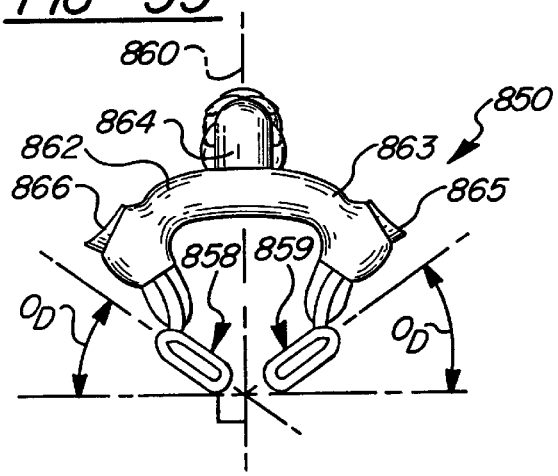
Figure 54:
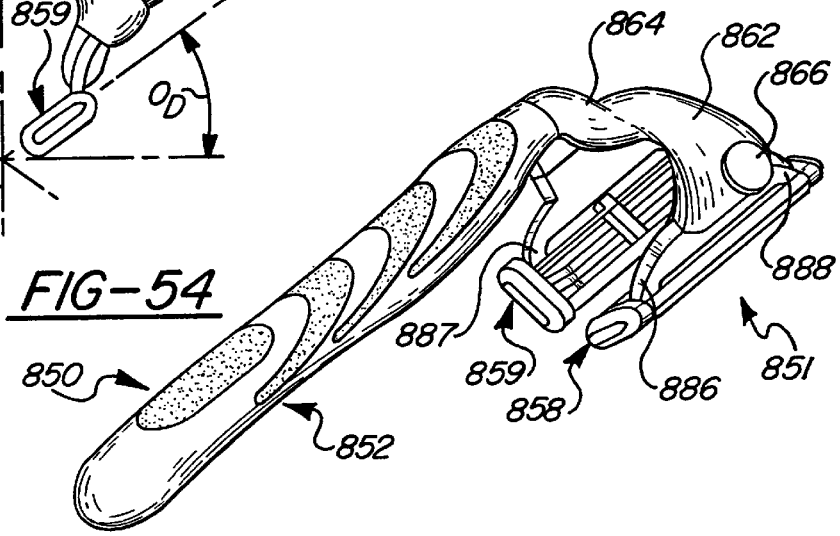
Figure 56:
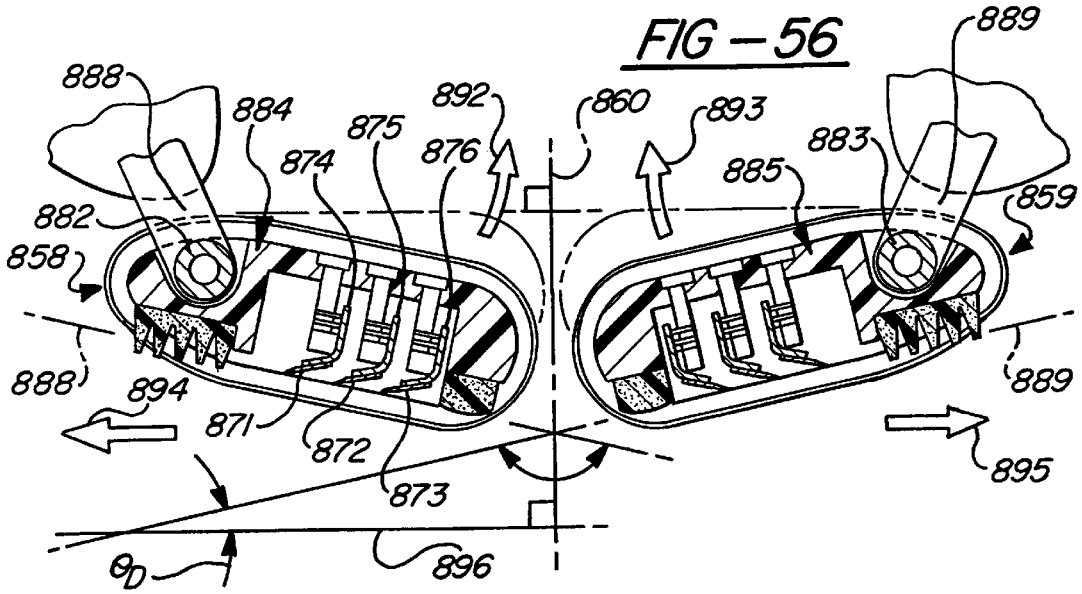

FIG. 53 is a side elevational view of device 850; FIG. 54 is a side perspective view of device 850; and FIG. 55 is an end elevational view taken from the right side of FIG. 53. FIG. 56 is an enlarged cross-sectional view taken along line 56—56 of FIG. 53. Together, FIGS. 55 and 56 show that the two uni-directional cartridges 858 and 859 are arranged with their working planes at a distinct angle $\theta_D$ to one another, similar to the previous embodiment shown in FIG. 52. Angle $\theta_D$ may range from about zero° to about 40°, with a range from about 5° to about 25° being preferred, and a range for angle $\theta_D$ from about 50 to 20° being most preferred.

Cartridges 858 and 859 may be conventional cartridges of the Gillette Mach3 style widely sold during the last two years. In the Gillette Mach3 razor, the uni-directional razor blade cartridge is releasable from its handles by depressing a button. Similar, spring-loaded round buttons are shown as buttons 865 and 866 in FIGS. 53 through 55. The construction of this Mach3 style of replaceable cartridge, and its releasable handle connection is disclosed in U.S. Pat. Nos. 4,756,082 and 5,956,851, the disclosures of which are hereby incorporated by reference, and thus need not be further described here.

FIG. 56 shows one possible internal construction of razor blade heads 858 and 859. Each head includes three spring-loaded razor blade strips mounted therein, such as elongated razor blade strips 871, 872 and 873 which are respectively mounted upon elongated angled metal blade support plates 874, 875 and 876. Accordingly, the razor blade strips 871, 872 and 873 are each able to move independently from one another in a direction substantially perpendicular to working plane 888 when caused to do so by forces generated due to skin curvatures or other minor variations in the skin being shaved. Front and rear guards substantially of the same type as used in the previous two embodiments are also provided here to establish working planes 888 and 889 for the razor-sharp edges of individual razor heads 858 and 859. For example, elongated finned elastomeric front guard member 890 and elongated hard plastic rear guard member 891, which has a gently rounded exterior surface, together establish working plane 888 for the razor blade strips of cartridge 858.

Like the Gillette Mach3 cartridge, cartridge heads 858 and 859 during use each pivot independently about its own elongated hollow cylindrical supporting pivot rod 882 or 883. These rods 882 and 883 are anchored to the end sections of platforms 884 and 885 of cartridges 858 and 859, and are also rotatably journalled into arms extending from the central part of yoke half portions 862 and 863. Arms 886 and 888 of yoke portion 862 pivotally receive and hold rod 882 at spaced apart locations, while arms 887 and 889 of yoke portion 863 in a similar manner pivotally receive and hold rod 883. Rods 882 and 883, which represent the pivot axes of the cartridges 858 and 859, are preferably parallel to one another and parallel to plane 860. Further, rods 882 and 883 are preferably also substantially parallel to the central axis of hand grip section 853 of handle 852, but may be tilted several degrees, either up or down within plane 860, if desired.

As indicated in FIGS. 56, cartridges 858 and 859 are spring loaded into a nominal "at-rest" position and are operative to be swing upwardly as indicated by arrows 892 and 893 in response to being pressed against a user's skin while shaving in either of two opposite directions indicated by arrows 893 and 894. Conventional return springs (not shown) return each cartridge to its at-rest position when pivot generating forces are no longer applied. The opposite shaving directions indicated by arrows 894 and 895 are generally perpendicular to plane 860 that bisects elongated handle 852. As noted in FIG. 56, cartridges 858 and 859 are spaced apart from one another so that there is sufficient room for both cartridges to swing upwardly to an approximately horizontal position parallel to plane 896, as shown by the phantom lines which illustrate both cartridges 858 and 859 in a fully horizontal position. From the foregoing, it should be appreciated that device 850 is well-suited for shaving bi-directionally without even having to lift or partially rotate head 851 or either of the cartridges 858 or 859 during the bi-directional shaving operation. However, if the user prefers to lift and/or partially rotate handle 852 (and hence the attached razor blade cartridges) between strokes in opposite directions, device 850, with its easy-pivoting cartridge heads, will readily accommodate such techniques.

In the fifteenth and sixteenth embodiments, the razor heads are capable of pivoting. Thus, a sliding motion in the first and second opposite directions is combined with a pivoting action for improved control of the user's shaving action. This style of head and pivot coupling arrangement thus permits each set of blades operating from within its own working plane, to be brought successively into optimum shaving engagement with the skin as the razor head is moved back and forth along the skin, without the razor head being lifted from the skin, and without the need of the user to change the orientation of the handle. This class of in-line bi-directional razor shaving devices implements a concept of mine that is common to the thirteenth through eighteenth embodiments in my U.S. Pat. No. 5,522,137 that I have named the "single effective plane." I coined this term to describe those bi-directional razor blade structures, which, although not having the all of their sharpened edges of the razor blade strips generally found with a common plane of the razor head or cartridge, can nevertheless be used to shave bi-directionally without lifting the razor head from the skin or tilting the handle as the direction of shaving is changed.

The term "single effective plane" as used herein, including in the claims, is deemed to cover any arrangement of a single razor head (or cartridge) which has two working planes that are angled significantly apart from one another so that when the cutting or active blade or pair of blades is in shaving contact with the skin, the set of razor blade strips are not in cutting contact with the skin, but nevertheless, due to the self-aligning movements of the pivoting or movable razor head independently of the handle, result in each working plane of each razor head shifting into position on the user's skin as that razor head is moved in its forward direction, without the user having to consciously control these automatically performed inclination adjustments. The movable coupling structure between the razor head and the handle or hand grip is a concept which can be still used to perform shaving of an area of skin in two opposite directions without lifting the razor head or cartridge from the skin.

Thus, in accordance with this aspect of my invention, there is provided an in-line bi-directional razor shaving device with two uni-directional razor heads each having a set of razor blade strips, with each razor head nominally being oriented in its own working plane at an angle to the working plane of the other razor head, but with the heads being capable of operating in a single effective plane. This in-line speed-shaving razor blade device minimally comprises: a single elongated handle including a neck portion, first and second elongated razor heads each having a set of elongated razor blade strips, with each strip provided with a razor-sharp edge portion. The device also includes first connection means for movably attaching the first razor head to the neck portion of the handle, and second connection means for movably attaching the second razor head to the neck portion of the handle. Each of the razor heads has a blade edge guarding system defining a working plane for the razor head. Each of the razor-sharp blade edges is located substantially in the working plane of its razor head. The razor-sharp blade edges of the first razor head extend in a first direction; while the razor-sharp blade edges of the second razor head extend in a second direction generally opposite from the first direction. The connection means for each head enable that head to be pivoted relative to the neck portion and handle through a range of angles at least substantially matching the nominal angle between the two working planes when the heads are at rest and not engaging the skin. With this in-line shaving device, when the razor heads are moved back and forth across the users skin, the razor head moving in a forward direction is in cutting contact with the user skin. and in continuous contact with the user's skin, the razor-sharp blade edge portion of the first razor head, and the razor-sharp blade edge portion of the second razor head are successively presented in shaving relation to the user's skin as the device is respectively moved in first and second opposite directions, thus accomplishing bi-directional shaving in a single effective working plane. As with a number of other embodiments in the other aspects of the present invention, third and fourth blade strips are preferably provided and are respectively located adjacent and parallel to the first and second blade strips, so that to provide a pair of razor blades in the first and second working plane.

Bi-directional Shaving Methods.

Having described my several exemplary embodiments of the in-line bi-directional razors of the present invention, it is now useful to summarize the shaving methods associated with the different classes of embodiments of my in-line bi-directional razor shaving devices.

In order to shave, either rapidly or slowly if desired, with any one of my in-line bi-directional razors, the user holds the device by the handle in the normal manner in which he or she might grasp and hold a hair brush, or a small stick used for pointing. The user grasps the razor handle and contacts the face portion of the razor head adjacent the skin portion to be shaved. For example, the razor head is shown placed against the skin. The user may stroke the razor first in one direction, and then, at the end of the stroke, reverse the movement to stroke in the opposite direction. This back-and-forth motion is indicated by the arrows adjacent the handle and the head in FIG. 32. Thus, no special grip and no unnatural motion is required to shave bi-directionally with my new manual in-line bi-directional razors. In other words, the required back and forth shaving technique is performed with a grip style very similar to the user's previous experience with uni-directional T-bar manual safety razors which used to shave one's face, arms or legs. The required back and forth motion of the arm is a natural, comfortable motion. Anyone who has rubbed a cleaning cloth back and forth along a surface, or rubbed an eraser against the blackboard, or performed any like task, has often performed this kind of to and fro movement.

One of the advantages of my single-plane in-line bi-directional razor blade shaving devices is that they need not be tilted, or lifted, or repositioned for the return strokes or to cut in an opposite direction, as is the practice with a normal uni-directional razor. Hence, my in-line bi-directional razors may simply be moved back-and-forth, fairly rapidly, to complete the shaving process bi-directionally and expeditiously.

Some of my in-line shaving devices have two distinct working planes with a significant angle between the two half faces, and thus the working planes. Examples include the second, third and fifth embodiments. To use these two-working plane devices, the user grips the razor handle of the device in the same manner as those which have only a single working plane. The user still moves the handle in the same manner as well after the razor has been placed against the skin. Most importantly, the user can stroke and cut hair in both directions without lifting the two-plane in-line razor head from the skin, or changing either the hand's position or grip with the fingers and thumb on the handle as the direction of razor head travel is changed.

For my two working plane embodiments with a significant angle between the planes, the user will have to incorporate a slight twisting motion of the razor head at the end of each stroke, or at the beginning of the next stroke, in order to place the other working plane into contact with the skin to be shaved as the razor blade head is moved in a second direction. In other words, upon a reversal of direction, one shaving zone or working plane of the razor head will have to come off of the skin, and the other working plane will have to engage the skin as the direction of razor head travel is reversed.

My last three embodiments shown and discussed above incorporate pivotable cartridge heads which allow the face of each uni-directional cartridge to be pressed against the skin to be shaved. Since the uni-directional heads pivot in these two embodiments, a user's wrist need not be turned as much, and perhaps not at all, as the razor head is moved back and forth in two opposite directions. One benefit of these last two embodiments is that the user need not be as concerned with keeping the face of the cartridges exactly aligned with the plane of the skin to be shaved. This is because each pivoting cartridge automatically tends to orient its working plane to be fully tangent to the skin, as the head is pressed lightly against and moved along the skin to be shaved. Thus, it may be said that the dual-plane pivoting in-line bi-directional razor shaving devices are optimized to faithfully track along the skin, even as it curves or undulates, thereby minimizing the amount of attention which even a new user must apply to the task of shaving bi-directionally.

As noted earlier, In the single plane embodiments of my in-line bi-directional razor shaving devices, the set of razor blade strips pointing away from the direction of travel are not actually cutting hair; rather they are being dragged along the skin, and are functioning as part of the rear guard and as rear glide means. The use of one or two metal razor blade strips at an angle anywhere between close to zero° up to about 20° from the horizontal, over even up to 35° from the horizontal provides a smooth stable rear glide surface that helps define the working plane of the forward razor blade strips actually involved in the cutting of hair.

It should be appreciated that most if not all of my in-line bi-directional razor shaving devices, particularly those which are assembled devices made from components that can be mass-produced, lend themselves to being efficiently constructed and economically mass-produced using current manual safety razor construction and automated assembly techniques. In particular, all molded plastic components can all be made from conventional plastic material using available molding machinery with dies that have been machined to produce finished parts. The blade strips and blade spacers, if desired, both with their registration holes, can be made using conventional equipment. Special tooling can easily be made to allow my in-line bi-directional razor blade shaving devices to be automatically assembled using conventional equipment at very low cost.

Reducing Blade Edge Exposure For Faster, Safer Shaving.

Further steps can be taken with the in-line bi-directional shaving devices disclosed herein, if desired, in order to reduce the chance of accidental nicks or cuts. The first step is to reduce the exposure of the blade-sharp edge within each cartridge, that is, the distance by which the razor-sharp edge projects into its working plane. According to this step, the razor blade edge is mounted in the cartridge or razor head so that the conventional amount the razor-sharp edge of the razor blade strip projects into its working plane is reduced, in comparison to conventional uni-directional cartridges optimized for face shaving. Preferably, this reduction is by about 0.0003 inch (about 8 microns) to about 0.0015 inch (about 40 microns). The working plane of course is established by the top exposed surfaces of the front and rear guard members of that razor blade head or cartridge. The second step is to place the razor blade strips within a single head or cartridge closer together, and also to place the razor-sharp edge of the razor blade strips closer to the front and rear guard members. In this manner, there is less space between the blade strips, which means that there is less opportunity for skin to be accidentally snagged by entering into the space between the razor-sharp edge and adjacent guard or the space between the two parallel razor-sharp edges. The third step is to place a series of fine parallel wires transversely across the razor blade strips. Such a wire guard means preferably may be a series of turns of a thin metallic wire wrapped at spaced intervals about blade cartridge structure. These wires sit tautly on top of and run across, and preferably perpendicular to, the exposed razor-sharp blade edges. This kind of wire guard structure provides an additional means for safely guarding the sharpened exposed edges of the blade strips, against accidentally cutting into the skin during shaving, while still permitting hair stubble to be closely shaved from the skin being shaved. This technique of wire-wrapping a set of blade strips is presently employed in the widely-available Schick Protector®, razors from Warner-Lambert Co., which are uni-directional razor shaving devices used in a conventional T-bar style handle. One, two or all three of these steps may be taken on any of the embodiments disclosed herein.

These steps should all assist in producing still faster, safer shaving with the bi-directional in-line devices of the present invention. One or more of these steps may be taken without reducing the quality of shave, because the hair stubble to be shaved is virtually always cut from two directions when using the devices of the present invention. Thus, with these devices, it is an easy matter to quickly shave over an area two or three times (or even more) from both directions. As is well-known, shaving the same area of skin closely from two different directions typically results in a closer shave then shaving in one direction only. Also, shaving an area more than once from both directions can improve the quality of the shave. Since the devices of the present invention help do this quickly, they may also lead to closer shaves and significantly less time when shaving arms and legs than was previously possible with conventional T-bar devices.

Preferred Dimensions.

Many of my in-line bi-directional razors shown in the Figures and described here are preferably sized and configured to be aesthetically pleasing, well-balanced, and comfortable to hold and use. Due to the need to be able to emphasize and clearly show key features under discussion, the Figures are not always shown to scale. As can be seen from the Figures and from various dimensions which were provided, however, the overall size of a number of my in-line bi-directional razor designs will very likely be regarded by a typical user of a wet razor as being really not much bigger or heavier, than the existing uni-directional wet razor he or she may be using. The size, weight, balance and overall appearance of my in-line bi-directional razor designs should be readily accepted by consumers and by workers in medical facilities and care givers in assisted-living situations. Further, once the distinct advantages of in-line bi-directional razors and shaving methods are appreciated by consumers, such in-line bi-directional razors may well achieve widespread use, even by barbers, stylists or others having need to shave other individuals.

Epilogue.

The term "razor blade strip" as used herein, including the claims, encompasses any elongated blade device having a razor-sharp edge, no matter how constructed, and no matter whether flat or angled. Thus, this term covers blade strips made of a single piece of metal or other sharpened or sharpenable material. It also covers razor blade strips made by bonding a thin gauge strip of metal to a more rigid piece of metal, by laser spot welding or the like, like the blades used in the Gillette Sensor and Gillette Mach3 razors.

While the foregoing embodiments have all been described with respect to the razor blade edges pointing outwardly, my in-line bi-directional shaving devices may be constructed with the razor blade edges pointed inwardly, that is toward each other, rather than outwardly. In other words, the sharpened edges of the first and second sets of the razor blade strips would be generally point inwardly, that is generally toward one another, while still being at an acute angle relative to their respective working plane. In other words, I definitely would not want the razor blade strips pointing directly at one another; instead the rigid blade strips would need to remain at an acute angle relative to the common working plane, or in those embodiments having inwardly pointing razor blades, with two distinct working planes, the working planes should still be at an angle relative to one another, with the planes with the working plane facing generally away from one another. Although this inwardly-pointing construction is not preferred, it nonetheless will work. Accordingly, the broader aspects of the invention as claimed below, which are not limited to in-line shaving devices having outwardly-pointing razor blade strips, should be understood to apply to such inwardly-pointing opposed razor blade constructions of the in-line bi-directional shaving devices of the present invention.

It should be appreciated that my in-line bi-directional razor heads may be used with conventional razor blade handles that are commercially available, provided that an appropriate handle-to-head coupling mechanism, including any return-to-center mechanism which may be required or desirable, is also furnished. Also, a series of spaced parallel fine protective wire segments arranged over the razor-sharp edges of the razor blade strips, as taught for example in U.S. Pat. Nos. 5,063,668 and 5,579,580 to Althaus, or as found in the commercially available Schick razor blade shaving devices for women, may be used to further protect the skin against accidental cuts or scrapes. These protective wires may be incorporated into any of the bi-directional razor heads or uni-directional half-heads of my in-line razor blade devices, if desired. Those in the art should appreciate that my in-line bi-directional razor blade shaving devices may also be constructed from flexible razor heads (including but not limited to the flexible cartridge disclosed in FIGS. 40 through 42 of my U.S. Pat. No. 5,522,137), as well as from rigid elongated bi-directional razor heads and cartridges that are shown herein.

A number of other possible modifications have already been described above. Further changes are clearly possible, as different features and aspects of one embodiment may be combined with another embodiment to provide an in-line bi-directional shaving device with the desired features from both. Thus, it is to be understood that the present invention is by no means limited to the particular constructions herein disclosed and/or shown in the drawings. Instead, the present invention also encompasses any modifications or equivalents within the scope of the disclosures that are fairly covered by the claims set forth below.

What is claimed is:

1. An in-line-bi-directional manual shaving razor blade device for bi-directional rapid-shaving of large skin areas of a person's body, including the legs and arms, the device comprising:

an elongated handle structure; and an effective single bi-directional razor head having a central longitudinal axis and first and second elongated uni-directional razor head structures arranged substantially parallel to the central longitudinal axis and to one another and arranged near to but separated from one another, each uni-directional razor head structure having (a) an elongated front guard portion including at least a longitudinal edge, (b) an elongated rear guard portion including at least a longitudinal edge, and (c) a face and a central longitudinal axis, both generally located between the longitudinal edges of the front and rear guard portions of the uni-directional head structure, the longitudinal edges of the front and rear guard portions of the first uni-directional head structure defining a first working plane extending therebetween, the longitudinal edges of the front and rear guard portions of the first uni-directional head structure defining a second working plane extending therebetween, the front guard portions of the first and second elongated uni-directional razor head structures together defining a front guard plane extending therebetween, the single effective bi-directional razor head being generally symmetrical about a plane of symmetry perpendicular to the front guard plane, the central longitudinal axis of the razor head being located within the plane of symmetry, the elongated handle structure connected to and supporting the razor head for manual movement by a user of the razor blade device, the handle structure having a handgrip portion with a principal axis, the elongated handle structure generally extending outwardly away from the single effective bi-directional razor head in a direction such that the principal axis of the handle structure is generally located in the plane of symmetry, a first elongated razor blade strip supported by and forming part of the first uni-directional head structure and having a sharpened blade edge portion extending outwardly at an acute angle relative to the face of the first uni-directional head structure and projecting generally toward the front guard portion thereof and away from the central longitudinal axis of the bi-directional razor head, the blade edge portion including a straight elongated razor-sharp edge generally positioned in the first working plane, and a second elongated razor blade strip supported by and forming part of the second uni-directional head structure and having a sharpened blade edge portion extending outwardly at an acute angle relative to the face of the second uni-directional head structure and projecting generally toward the front guard portion thereof and away from the central longitudinal axis of the bi-directional razor head, the blade edge portion including a straight elongated razor-sharp edge generally positioned in the second working plane, and the handgrip portion of the razor handle structure being arranged and adapted for being manually grasped and for moving the handle structure so that the razor head is movable in a first direction along a user's skin that is generally perpendicular to the principal axis of handgrip portion, in order to shave hair extending from the skin while moving in the first direction using the straight razor-sharp edge of the first uni-directional razor head while the first working plane of the first uni-directional razor head structure is in contact with the skin, and then, for reversing the direction of movement of the handle structure so that the razor head is movable in a second direction along a user's skin that is opposite to the first direction, in order to shave hair extending therefrom using the straight razor-sharp edge of the second razor blade strip while the second working plane of the second uni-directional razor head structure is in contact with the skin, without the need to lift the effective single bi-directional razor head from the user's skin during movements in the opposite directions, whereby the user of the in-line razor blade device may rapidly slide the bi-directional razor head back and forth along the skin to be shaved in opposite strokes, while maintaining at least one of the working planes of razor head in contact with the skin during the strokes, in order to shave in the first and second directions.

2. An in-line shaving device as in claim 1, having only first and second uni-directional razor head structures and wherein:

each of the first and second uni-directional razor head structures has first and second end portions extending generally transversely to the central longitudinal axis of the uni-directional razor head structure, each of the straight razor-sharp edges of the razor blade strips are continuous elongated edges extending along substantially the entire length of razor blade strip between the first and second end portions of its respective uni-directional razor head structure, and the handle structure is connected to and supports each of the uni-directional razor head structures from the first end thereof, and the handle structure is arranged so that the principal axis of the handgrip portion thereof is generally parallel to the central longitudinal axis of the bi-directional razor head.

3. An in-line shaving device as in claim 1, wherein the first and second working planes are substantially co-planar and substantially identical in location to the front guard plane, whereby a user need not rotate the handle structure as the in-line razor blade device is moved back and forth along the user's skin.

4. An in-line shaving device as in claim 1, wherein:

the first and second uni-directional head structures are identical and each have a length of more than three times its width and are spaced from one another by a distance substantially less than the width of each uni-directional head structure.

5. An in-line shaving device as in claim 1, wherein the effective single bi-directional head is arranged and configured such that the longitudinal edge of each elongated rear guard portion is elevated to a substantially identical height with respect to the front guard plane, such that the first and second working planes intersect one another at an included angle of more than about ten degrees.

6. An in-line shaving device as in claim 1, wherein:

the effective single bi-directional head is arranged and configured with the longitudinal edge of each elongated rear guard portion being substantially located only slightly above the front guard plane, such that the first and second working planes intersect one another at a sufficiently small included angle of less than about ten degrees, whereby each is effectively substantially co-planar with the front guard plane, such that a user need not rotate the handle structure as the razor blade device is moved back and forth along the user's skin, since the first and second working planes normally engage the skin as the razor head is stroked respectively in the first and second directions.

7. An in-line shaving device as in claim 1, wherein the handle structure has a neck portion generally located between the handgrip portion and the effective single bi-directional razor head, the neck portion having and being arranged with a central section and first and second outer sections that extend outwardly from the central section and that connect to and respectively support the first and second uni-directional razor head structures.

8. An in-line shaving device as in claim 7, wherein each uni-directional razor head structure has a central longitudinal axis and the principal axis of the handgrip portion is generally parallel to the central longitudinal axis of each uni-directional razor head structure.

9. An in-line shaving device as in claim 8, wherein the neck portion of the handle structure is symmetrically arranged about the plane of symmetry and generally extends in a direction that is transverse to the central longitudinal axis of the bi-directional razor head.

10. An in-line shaving device as in claim 7, wherein the first and second outer sections that extend outwardly from the central section of the neck portion extend outwardly in substantially opposite directions.

11. An in-line shaving device as in claim 7, wherein the principal axis of the handgrip portion is generally in line with the central longitudinal axis of the effective single bi-directional razor head.

12. An in-line shaving device as in claim 1, wherein the handgrip portion of the handle structure along most of its length has a transverse cross-section that is symmetrical about the plane of symmetry, and that is substantially continuously increasing as the distance from the razor head increases.

13. An in-line shaving device as in claim 1, wherein:

the handgrip portion of the handle structure along most of its length has at least a first exterior surface that is generally planar, and is arranged generally parallel to the front guard plane of the bi-directional razor head.

14. An in-line shaving device as in claim 1, wherein:

the handgrip portion of the handle structure along most of its length has at least first and second exterior surfaces spaced from one another and generally arranged respectively along first and second exterior planes, which exterior planes are arranged substantially orthogonally to the front guard plane of the razor head.

15. An in-line shaving device as in claim 1, wherein the handle structure along at least most of its length has a cross-section perpendicular to the principal axis of the handgrip portion that is generally elongated, and the handle structure has a principal plane that is generally parallel to the front guard plane of the razor head.

16. An in-line shaving device as in claim 1, wherein the handgrip portion of the handle structure along at least most of its length has an outer shape when viewed in cross-section perpendicular to its principal axis that is a regular shape selected from the group of regular shapes consisting of rectangles, circles, ovals, triangles and trapezoids.

17. An in-line shaving device as in claim 1, further comprising:

a third razor blade strip supported by the first uni-directional razor head structure and provided with a sharpened edge portion substantially identical in length to the sharpened edge portion of the first razor blade strip and extending in the substantially same direction, and including an elongated razor-sharp edge generally positioned in the first working plane, the sharpened edge portion of the third blade strip being arranged to be closely adjacent to and spaced a short distance from the sharpened edge portion of the first blade strip so that the first and third blade strips cut hair substantially simultaneously as the razor head is moved in the first direction along the user's skin; and a fourth razor blade strip supported by the second uni-directional razor head structure and provided with a sharpened edge portion substantially identical in length to the sharpened edge portion of the second razor blade strip and extending in the substantially same direction, and including an elongated razor-sharp edge generally positioned in the second working plane, the sharpened edge portion of the fourth blade strip being arranged to be closely adjacent to and spaced a short distance from the sharpened edge portion of the second blade strip so that the second and fourth blade strips cut hair substantially simultaneously as the razor head is moved in the second direction opposite the first direction along the user's skin.

18. An in-line shaving device as in claim 17, wherein:

the razor head has first and second end portions extending generally transversely to the central longitudinal axis of the razor head, each of the straight razor-sharp edges of the first through fourth razor blade strips are continuous elongated edges extending along substantially the entire length of its respective razor blade strip between the first and second end portions of the razor head, the handle structure has a neck portion generally located between the handgrip portion and the razor head, the neck portion connecting the head to the handgrip portion, and the handle structure is arranged so that the principal axis of the handgrip portion is generally parallel to the central longitudinal axis of the razor head.

19. An in-line shaving device as in claim 18, wherein:

the neck portion of the handle structure is generally arranged along its own central axis that extends in a direction that is transverse to the longitudinal axis of the razor head and to the principal axis of the handgrip portion, such that the longitudinal axis of the razor head is laterally offset from the principal axis of the handgrip portion, and the front guard portions of the razor head are arranged to help smooth and stretch the skin prior to the skin being shaved.

20. An in-line shaving device as in claim 17, wherein:

the razor-sharp elongated edge of the first and third razor blade strips are arranged at slightly different elevations relative to the first working plane, such that the razor-sharp edge of the first razor blade strip sits lower in relation to the first working plane than the razor-sharp edge of the third razor blade strip, and the razor-sharp elongated edge of the second and fourth razor blade strips are arranged at slightly different elevations relative to the second working plane, such that the razor-sharp edge of the second razor blade strip sits lower in relation to the second working plane than the razor-sharp edge of the fourth razor blade strip, whereby the razor-sharp edge of the third razor blade strip projects very slightly further toward the person's skin than does the razor-sharp edge of the first razor blade strip, and whereby the razor-sharp edge of the fourth razor blade strip projects very slightly further toward the person's skin than does the razor-sharp edge of the second razor blade strip.

21. An in-line shaving device as in claim 1, wherein the handle structure and the razor head are permanently attached to one another.

22. An in-line shaving device as in claim 21, wherein at least part of the handle structure and at least part of each uni-directional razor head structure are integrally formed of the same molded plastic material.

23. An in-line shaving device as in claim 1, wherein:

each uni-directional razor head structure includes a connection portion, and the handle structure includes two connection portions which are arranged for removably connecting the uni-directional razor head structure to the handle structure, whereby, when the razor blade strips of each uni-directional razor head are dulled with use, the uni-directional razor head structures may each be removed from the handle structure and replaced with a substantially identical uni-directional razor head structure having at least one fresh razor blade strip.

24. An in-line shaving device as in claim 23, wherein:

each uni-directional razor head structure has a base portion generally opposite of the face thereof, the base portion including the connection portion of the uni-directional head structure arranged below the front guard plane of the bi-directional razor head and being provided with at least one socket portion for receiving at least part of the connection portion of the handle structure; and the two connection portions of the handle structure are located at a proximal end of the handle structure and each includes at least one male portion complementary to the socket portion of a respective connection portion of one of the uni-directional head structures and is receivable at least partially therein.

25. An in-line shaving device as in claim 1, wherein:

each of the uni-directional razor head structures of the bi-directional razor head is a uni-directional razor blade cartridge and has a base portion connected to the handle structure, each of the base portions is provided with a cartridge connection mechanism for receiving and supporting the rest of its respective uni-directional cartridge, each of the uni-directional cartridges includes at least two razor blade strips arranged substantially parallel to one another and a platform structure arranged for supporting the razor blade strips, and the platform structure including a base-connecting mechanism which interlockingly engages with the cartridge connection mechanism of the base portion.

26. An in-line shaving device as in claim 1, wherein:

the first and second elongated uni-directional razor structures are formed as uni-directional cartridges and each cartridge has a base portion connected to the handle structure in pivoting relation, each of the base portions including first and second pivoting cartridge connection mechanisms spaced from one another, which interlockingly engage first and second base pivot connection mechanisms provided as part of the handle, and the first and second elongated cartridges respectively having first and second elongated central axes which are substantially parallel to and located on opposite sides of the central longitudinal axis of the razor head.

27. An in-line shaving device as in claim 26, wherein:

the first and second pivoting cartridge connection mechanisms of the first single-direction razor blade cartridge are arranged substantially concentrically to the first elongated central axis associated with the first single-direction cartridge, and the first and second pivoting cartridge connection mechanisms of the second single-direction razor blade cartridge are arranged substantially concentrically to the second elongated central axis associated with the first single-direction cartridge.

28. An in-line shaving device as in claim 27, wherein:

the first and second single-direction razor blade cartridges each includes a lubricant strip located immediately adjacent to its respective rear guard portion, and the first and second pivoting cartridge connection mechanisms of the first and second single-direction razor blade cartridges are shell-bearing connection mechanisms.

29. An in-line shaving device as in claim 1, wherein:

the bi-directional razor head includes first and second substantially identical elongated uni-directional razor head portions respectively provided with the first and second razor blade strips and blade-strip support structures arranged for respectively supporting the first and second razor blade strips, the uni-directional razor head portions being physically separate from one another, and each having a support connection mechanism; and the handle structure includes a common neck section and first and second neck sections which generally diverge away from the one another, the first and second neck sections including connector mechanisms for respectively receiving the support connection mechanisms of the first and second uni-directional head portions.

30. An in-line shaving device as in claim 29, wherein:

the uni-directional razor head portions are constructed as removable cartridges which are each arranged and constructed to pivot with respect to its respective neck section and the handle structure in response to forces applied during shaving.

31. An in-line shaving device as in claim 30, wherein:

the first uni-directional razor head portion includes at least one other razor blade strip provided with a sharpened edge portion substantially identical in length to the sharpened edge portion of the first razor blade strip and extending in the substantially same direction, and including an elongated razor-sharp edge generally positioned in the first working plane, the sharpened edge portion of this at least one other blade strip being arranged to be closely adjacent to and spaced a short distance from the sharpened edge portion of the first blade strip so that it and the first blade strip cut hair substantially simultaneously as the razor is moved in the first direction along the user's skin; and the second uni-directional razor head portion includes at least one other razor blade strip provided with a sharpened edge portion substantially identical in length to the sharpened edge portion of the second razor blade strip and extending in the substantially same direction, and including an elongated razor-sharp edge generally positioned in the second working plane, the sharpened edge portion of this at least one other blade strip being arranged to be closely adjacent to and spaced a short distance from the sharpened edge portion of the second blade strip so that it and the second blade strip cut hair substantially simultaneously as the razor is moved in the second direction along the user's skin, and the first and second uni-directional razor head portions each include shell-bearing connection mechanisms for enabling the razor head portions to pivot.

32. An in-line shaving device as in claim 29, wherein:

the uni-directional razor head portions each have first and second end portions positioned at opposite ends of the elongated blade strip of the head portion, and a pivoting mechanism that includes an elongated shaft provided with first and second ends mounted to the first and second end portions.

33. An in-line shaving device as in claim 29, wherein:

the first and second uni-directional head portions respectively have first and second face portions that include substantially flat surface areas on their respective front and rear guard portions, which pairs of front and rear face portions correspond to the first and second working planes, and the first and second face portions are arranged to be nominally sufficiently tilted away from one another, such that, when the device is at rest, the first and second working planes are respectively defined solely by the first and second single-direction head portions.

34. An in-line shaving device as in claim 33, wherein:

the first and second uni-directional head portions are respectively constructed as removable cartridges, whereby, when the razor blade strips of a given head portion are dulled with use, that razor head portion may be removed from the handle structure and replaced with a substantially identical razor head having fresh razor blade strips, and wherein each of the cartridges includes a mechanism for enabling the cartridge to pivot relative to the connector mechanism and neck section which support the cartridge for movement.

35. An in-line shaving device as in claim 29, wherein:

the handle structure includes an elongated handgrip portion that extends substantially away from the common neck section and away from the first and second neck sections, the handgrip portion having a transverse cross-section that is substantially uniform along most of its length, the elongated handgrip portion being arranged to be gripped with the user's fingers wrapped thereabout.

36. A single-head bi-directional razor blade device having an in-line handle and being arranged for rapidly shaving large skin areas of the body including the legs and arms, the razor blade device comprising:

a single elongated razor head having a central longitudinal axis at least first and second cutting zone structures respectively including substantially flat first and second cutting zones respectively provided with first and second working planes arranged at a distinct included angle of at least about ten degrees to one another and intersecting one another along an imaginary line spaced from and generally parallel to the central longitudinal axis, the imaginary line and longitudinal axis defining an overall plane of symmetry for the device, an elongated in-line handle structure connected to the razor head and supporting the head for manual shaving movement by a user of the razor blade device in each of first and second opposite directions, the handle structure having a handgrip portion with a principal axis located generally in the plane of symmetry, the handgrip portion extending generally away from and being spaced from the razor head, whereby a user grasping the handgrip portion need not contact the razor head, the razor head and the handle structure each being arranged and configured to be generally symmetrically disposed about the plane of symmetry, the first cutting zone structure of the razor head being at least substantially on a first side of the plane of symmetry and including first blade-supporting means and front and rear elongated straight guard portions spaced from one another that in major part define the first working plane, and including at least a first razor blade strip provided with an inner portion supported by the first blade supporting means and an outer edge portion provided with a straight elongated razor-sharp edge generally disposed in the first working plane and spaced between and from the first front and rear guard portions, the outer edge portion extending outwardly at an acute angle relative to the first working plane and projecting generally toward the first front guard portion and away from the longitudinal axis, and the second cutting zone structure of the razor head being at least substantially on a second side of the plane of symmetry opposite the first side and including second blade-supporting means and front and rear elongated straight guard portions spaced from one another that in major part define the second working plane, and including at least a second razor blade strip provided with an inner portion supported by the second blade supporting means and an outer portion provided with a straight elongated razor-sharp edge generally disposed in the second working plane and spaced between and from the second front and rear guard portions, the outer edge portion extending outwardly at an acute angle relative to the second working plane and projecting generally toward the second front guard portion and away from the longitudinal axis, the handgrip portion of the razor handle structure being arranged and adapted for manually grasping and moving the handle structure back and forth in repetitive strokes and for partially rotating the handle structure at the ends of the strokes, thereby enabling a user to safely move razor head in a first direction along a user's skin that is generally perpendicular to the principal axis of the handgrip portion in order to shave hair extending from the skin using any available razor-sharp edge in the first cutting zone 'while the first front and rear guard portions are in contact with the skin, and then at the end of a stroke in the first direction, slightly rotating the handle structure and reversing the direction of movement of the handle structure, so that the razor head moves in a second direction along a user's skin that is opposite the first direction, in order to shave hair extending therefrom using any available razor-sharp edge in the second cutting zone while the second front and rear guard portions are in contact with the skin, without need for the user to change or alter the user's grasp of the handgrip portion of the handle structure during movements in the opposite directions along the user's skin, but with the need to rotate the handgrip portion of the handle structure slightly back and forth by an angle of rotation corresponding to the distinct included angle of inclination between the first and second working planes, in order to respectively and sequentially place the first and second cutting zones into contact with the user's skin to be shaved while cutting hair in the first and second opposite directions, whereby the user of the razor may move the razor head to and fro along the skin to be shaved in a rapid manner, and accomplish shaving of the skin in two opposite directions.

37. The in-line razor device of claim 36, wherein:

the handle structure includes a connection portion which connects directly to the razor head and neck portion between the connection portion and handgrip portion, and the principal axis of the handgrip portion extends generally parallel to the longitudinal axis of the razor head, and at least a majority of the handgrip portion of the handle structure is spaced away from the razor head.

38. The in-line razor device of claim 37, wherein the distinct angle between the first and second working planes is in the range of about 20° to about 90°.

39. The in-line razor device of claim 37, wherein the handle structure includes a connection portion which connects directly to the razor head and neck portion between the connection portion and handgrip portion, and the principal axis of the handgrip portion extends generally parallel to the longitudinal axis of the razor head, and at least a majority of the handgrip portion of the handle structure is spaced away from the razor head.

40. The in-line razor device of claim 37, wherein:

the neck portion of the handle structure extends laterally away at a transverse angle from the razor head, and the principal axis of the handle grip portion is offset from the longitudinal axis of the razor head and is spaced therefrom on a side of the longitudinal axis opposite the imaginary line.

41. The in-line razor device of claim 37, wherein the razor head further includes:

a third razor blade strip arranged closely adjacent to the first blade strip and having an inner portion supported by first-blade supporting means and an outer portion with a straight elongated razor-sharp edge generally disposed in the first working plane and spaced between and from the first front and rear guard portions, and arranged generally parallel to and spaced a short distance from the razor-sharp edge of the first razor blade strip, whereby the first and third blade strips cut hair simultaneously as the razor head is moved in the first direction along the user's skin, and a fourth razor blade strip arranged closely adjacent to the second blade strip and having an inner portion supported by second-blade supporting means and an outer portion with a straight elongated razor-sharp edge generally disposed in the second working plane and spaced between and from the second front and rear guard portions, and arranged generally parallel to and spaced a short distance from the razor-sharp edge of the second razor blade strip, whereby the second and fourth blade strips cut hair simultaneously as the razor head is moved in the second direction along the user's skin.

42. The in-line razor device of claim 37, wherein the straight razor-sharp edge of third razor blade strip is disposed slightly higher relative to the first working plane than is the straight razor-sharp edge of first razor blade strip, and the straight razor-sharp edge of fourth razor blade strip is disposed slightly higher relative to the second working plane than is the straight razor-sharp edge of second razor blade strip.

43. The in-line razor device of claim 37, wherein:

the neck portion of the handle structure extends laterally away at a transverse angle from the razor head, and the principal axis of the handgrip portion is offset from the longitudinal axis of the razor head and is spaced therefrom on a side of the longitudinal axis opposite the imaginary line.

44. The in-line razor device of claim 43, wherein the neck portion of the handle structure is connected to one end of the razor head.

45. The in-line razor device of claim 43, wherein:

the elongated razor head has a face including the first and second cutting zones and a rearward portion opposite the face to which the neck portion of the handle structure is connected, the neck portion extends away from razor head in a direction generally perpendicular to the longitudinal axis of the razor head, and the neck portion is rigidly connected to the handle portion.

46. The in-line razor device of claim 37, wherein the razor head is a structure having:

first and second guard portions respectively forming the first and second elongated generally flat edges of the razor head, each of the guard portions being arranged for smoothing and stretching the skin immediately prior to such skin being shaved by any blade strip adjacent to such guard portions.

47. The in-line razor device of claim 46, wherein each guard portion includes a plurality of elongated elastomeric fins.

48. A method for rapidly shaving hair stubble from large areas of skin on a body, such as a leg or an arm, with a manual razor blade device having an in-line handle and a bi-directional razor head with two opposed shaving zones, by cutting hair in two opposite directions without changing one's handgrip and while maintaining substantially continuous contact between the razor head and the skin as the razor head is stroked along the skin in opposite directions, the method comprising the steps of:

(a) providing a manual bi-directional razor blade device having an in-line handle including a handgrip portion with a principal axis and a single elongated bi-directional razor head having a central longitudinal axis that is in a common plane of symmetry with the principal axis of the handgrip portion, the razor head provided with first and second front guard portions, at least first and second blade strips, and first and second working planes respectively formed in part by the first and second guard portions, the first and second working planes arranged at a distinct included angle of at least about ten degrees to one another and intersecting one another along an imaginary line, substantially within the plane of symmetry, spaced from and generally parallel to the central longitudinal axis, each blade strip being associated with one of the working planes and having a single substantially straight razor-sharp edge arranged to be substantially within its respective working plane, the first blade having a sharpened edge that faces away from the sharpened blade edge of the second blade, the sharpened edges of the blade strips facing toward their respective front guard portions; and (b) moving the handle and razor head of the razor in a first direction perpendicular to the central longitudinal axis of the razor head along a user's skin in order to shave hair extending from the skin using the razor-sharp edge of the first razor blade, while the first front guard portion and the working plane are substantially in contact with the skin, and (c) then, at the end of a stroke in the first direction, turning the handle structure in a first rotary direction required to place the second front guard portion and second working plane in contact with the skin; and (d) reversing the direction of movement of the handle structure, so that the razor head moves in a second direction along a user's skin that is opposite the first direction, in order to shave hair extending therefrom using the razor-sharp edge of the second razor blade while the second front guard portion and working plane are in contact with the skin, and (e) then, at the end of a stroke in the second direction, turning the handle structure about the principal axis of the handgrip portion in a second direction required to place the first front guard portion and first working plane in contact with the skin, in preparation for shaving in the first direction; and (f) successively performing steps (b) through (e) during repetitive shaving of a large body area of the user, whereby the in-line razor blade device is used by quickly moving the handle structure back and forth in repetitive strokes and by partially turning the handle structure at the ends of those strokes, thereby enabling the user of the in-line bi-directional razor blade device to move the bi-directional razor head to and fro along the skin to be shaved in a rapid manner, and thus shave the same skin from the two opposite directions.

49. A method of rapidly shaving bi-directionally as in claim 48, wherein:

as part of step (a), a manual razor is provided that has third and fourth blades each of which has a single substantially straight razor-sharp edge, the third blade being associated with and spaced closely to the first blade and forming therewith a first set of blades that operate together, the fourth blade being associated with and spaced closely to the third blade and forming therewith a second set of blades that operate together, and wherein during step (b), both the razor-sharp edges of the first and third blades are operative to cut hair as the first front guard portion and first working plane of the razor head are moved in the first direction along the skin; and during step (c), both the razor-sharp edges of the second and fourth blades are operative to cut hair as the second front guard portion and second working plane of the razor head are moved in the second direction along the skin.

50. A method of a user rapidly shaving large areas of the user's own body such as a leg or an arm with a manual razor blade device having an in-line handle and a bi-directional razor head with two opposed shaving zones by moving the razor head against the skin so as to cut hair in two opposite directions while maintaining substantially continuous contact between the razor head and the skin as the razor head successively shaves while moving in opposite directions, without any need to partially rotate the handle in opposed first and second rotary directions at the ends of shaving strokes, the method comprising the steps of:

(a) providing a manual razor blade device having an in-line handle including a handgrip portion with a principal axis and a single elongated bi-directional razor head having a central longitudinal axis that is in a common plane of symmetry with the principal axis of the handgrip portion, the razor head provided with first and second front guard portions, at least first and second razor blade strips, and first and second working planes respectively formed in part by the first and second guard portions, the first and second working planes arranged at an included angle of less than 10 degrees to one another and intersecting one another along an imaginary line, substantially within the plane of symmetry, spaced from and generally parallel to the central longitudinal axis, each blade strip being associated with one of the working planes and having a single substantially straight razor-sharp edge arranged to be substantially within its respective working plane, the first blade strip having its razor-sharp edge facing away from the razor-sharp blade edge of the second blade strip, the razor-sharp edges of the blade strips each facing toward its respective front guard portion; and (b) moving the handle and razor head of the shaving device in a first direction perpendicular to the central longitudinal axis of the razor head along a user's skin in order to shave hair extending from the skin using the razor-sharp edge of the first razor blade strip, while the first front guard portion and the working plane are substantially in contact with the skin; and (c) then, at the end of a stroke in the first direction, without turning the handle structure, reversing the direction of movement of the handle structure, so that the razor head moves in a second direction along a user's skin that is opposite the first direction, in order to shave hair extending therefrom using the razor-sharp edge of the second razor blade strip while the second front guard portion and working plane are in contact with the skin; and (d) then, at the end of a stroke in the second direction, then, without turning the handle structure, reversing the direction of movement of the handle structure, and thereafter repeating step (b) and then step (c), whereby steps (b) through (d) repetitively perform the shaving of a large body area of the user from first and second opposite directions, without the need to lift the razor head from the skin.

51. A method of rapidly shaving bi-directionally using an in-line shaving device as in claim 50, wherein:

as part of step (a), a razor head having first and second working planes that are substantially co-planar is provided, and during step (b), the razor-sharp edge of the second blade strip is scraped along the skin without cutting hair while maintaining said specified plane of inclination, and during step (c), the razor-sharp edge of the first blade strip is scraped along the skin without cutting hair while maintaining said specified plane of inclination.

* * * * *